US006140038A

United States Patent [19]

Ishizuka et al.

[11] Patent Number: 6,140,038

[45] Date of Patent: Oct. 31, 2000

[54] HEAT-DEVELOPABLE IMAGE-RECORDING MATERIAL

[75] Inventors: Takahiro Ishizuka; Kunio Ishigaki, both of Minami-ashigara, Japan

[73] Assignee: Fuji Photo Film Co., LTD, Kanagawa, Japan

[21] Appl. No.: 09/349,468

[22] Filed: Jul. 9, 1999

[30] Foreign Application Priority Data

Jul. 9, 1998 [JP] Japan ..... 10-210385

[51] Int. Cl.[7] ..... G03C 1/498

[52] U.S. Cl. ..... 430/619; 430/531; 430/620; 430/627

[58] Field of Search ..... 430/619, 533, 430/531, 535, 536, 620, 627

[56] References Cited

U.S. PATENT DOCUMENTS 5,143,954 9/1992 Hutton et al. ..... 524/106

5,710,095 1/1998 Horsten et al. .

FOREIGN PATENT DOCUMENTS 60-80857 5/1985 Japan .

08137045 5/1996 Japan .

*Primary Examiner*—Thorl Chea

*Attorney, Agent, or Firm*—Birch, Stewart, Kolasch & Birch, LLP

[57] ABSTRACT

A heat-developable image-recording material comprising, on a support, at least one image-forming layer containing an organic silver salt, a reducing agent, and a light-sensitive silver halide, and at least one protective layer provided on the image-forming layer, wherein the image-forming layer and the protective layer contain a polymer latex as a binder, and the polymer latex of the image-forming layer and/or the protective layer comprises a self-crosslinkable polymer latex.

9 Claims, 1 Drawing Sheet

HEAT-DEVELOPABLE IMAGE-RECORDING MATERIAL

FIELD OF THE INVENTION

The present invention relates to a heat-developable image-recording material used for, in particular, photomechanical processes. More precisely, the present invention relates to a heat-developable image-recording material exhibiting high contrast photographic property, and excellent suitability for heat development or suitability for pinhole correction (suitability for opaquing) after the heat treatment.

BACKGROUND OF THE INVENTION

A large number of light-sensitive materials comprising a support having thereon a light-sensitive layer are known, where the image formation is performed by imagewise exposing the light-sensitive material. Of these, a technique of forming an image by heat development is a system capable of satisfying the issue of environmental conservation or simplifying the image formation means.

In recent years, reduction of the amount of waste processing solutions is keenly demanded in the field of photomechanical process from the standpoint of environmental conservation and space savings. To cope with this, techniques are required to produce light-sensitive heat-developable materials for use in photomechanical process, which can be effectively exposed by a laser scanner or laser image setter and can form a clear black image having high resolution and sharpness. Such light-sensitive heat-developable materials can provide to users a heat development processing system being dispensable with use of solution-type processing chemicals, simple and freed from incurring environmental destruction.

Methods for forming an image by heat development are described, for example, in U.S. Pat. Nos. 3,152,904 and 3,457,075 and D. Morgan and B. Shely, *Imaging Processes and Materials, "Thermally Processed Silver Systems" A,* 8th ed., page 2, compiled by Sturge, V. Walworth and A. Shepp, Neblette (1969). The light-sensitive material used contains a light-insensitive silver source (e.g., organic silver salt) capable of reduction, a photocatalyst (e.g., silver halide) in a catalytic activity amount, and a reducing agent for silver, which are usually dispersed in an organic binder matrix. This light-sensitive material is stable at room temperature. However, when it is heated at a high temperature (e.g., 80° C. or higher) after the exposure, silver is produced through an oxidation-reduction reaction between the silver source (which functions as an oxidizing agent) capable of reduction and the reducing agent. The oxidation-reduction reaction is accelerated by the catalytic action of a latent image generated upon exposure. The silver produced by the reaction of the silver salt capable of reduction in the exposure region provides a black image and this presents a contrast to the non-exposure region. Thus, an image is formed.

This type of heat-developable light-sensitive material has been heretofore known but in many of such light-sensitive materials, the light-sensitive layer is formed by coating a coating solution using an organic solvent such as toluene, methyl ethyl ketone or methanol, as a solvent. However, use of an organic solvent as a solvent is not preferred because of its adverse effect on a human body during the production process, and organic gas emission, which may be a cause of global warming, or in view of the cost for recovery of the solvent, requirement for explosion protection facilities or the like.

These problems may be overcome by using water as an application solvent (application scheme utilizing water as an application solvent will be referred to as "aqueous application" hereinafter). For example, JP-A-49-52626 (the code "JP-A" as used herein means an "unexamined published Japanese patent application"), JP-A-53-116144 and the like disclose use of a gelatin binder. JP-A-50-151138 discloses use of polyvinyl alcohol as a binder.

However, such use of water-soluble binders leads to simultaneous dehydration shrinkage and thermal expansion of the binders during the heat development, and these phenomena produce corrugates of films because their degrees are different from that of thermal expansion of supports. Thus, the use exclusively produce films unsuitable for color printing, wherein the films are laminated for use.

This problem may be solved by using a polymer latex. For example, WO97/4355, JP-A-8-137045 and the like disclose the production of heat-developable image-recording materials through aqueous application by utilizing a polymer latex as a binder.

However, in order to form uniform image-forming layer and protective layer without impairing photographic properties, it is necessary to use a polymer latex application solution having a low MFT (minimum film-forming temperature), and for this, it is essential to form an applied film at an appropriate MFT by utilizing a polymer latex and/or film-forming aid having a low Tg (glass transition temperature). However, a lowered MFT affords a softer applied film after application and drying, and such a film is likely to suffer problems. For example, such a film may adhere to members of heat-developing apparatus (e.g., transportation rollers, guide panels etc.) to cause transportation error or become likely to have scratches. Further, correction solutions containing an organic solvent as a dissolution medium are often used for correction of pinholes in images after the heat development. Such correction solutions may dissolve or greatly swell applied films of corrected portions to degrade images.

Various crosslinking agents have generally been used to crosslink polymers aiming at improvements of heat resistance, durability, mechanical properties and the like of the polymers. In general, these techniques often use a high crosslinking reaction temperature. Therefore, they may cause problems, for example, they cause high fogging, and make it difficult to obtain high contrast, in particular, when a nucleating agent is used in order to obtain high contrast photographic properties. In addition, many of crosslinking agents are reactive with active hydrogen (e.g., epoxy groups), and even when a crosslinking agent is added to a protective layer, it may be transferred to an image-forming layer by diffusion. The crosslinking agent transferred in such a manner may disadvantageously react also with reagents necessary for the image formation to degrade photographic performance. Therefore, there has been desired a heat-developable image-recording material that allows crosslinking without degrading photographic properties, and exhibits excellent suitability for heat development or suitability for image correction after the heat development.

SUMMARY OF THE INVENTION

Accordingly, an object of the present invention is to provide a heat-developable image-recording material for use in photomechanical processes, particularly, for a scanner or image setter, having good photographic properties of high contrast and low fog, and exhibiting excellent suitability for image correction after heat development (suitability for opaquing), and suitability for heat development.

The present inventors earnestly conducted studies in order to achieve the aforementioned object. As a result, they found that a heat-developable image-recording material of excellent performance can be afforded by utilizing a self-crosslinkable polymer latex as a polymer latex of the image-forming layer and/or the protective layer, and thus completed the present invention.

That is, the present invention provides a heat-developable image-recording material comprising, on a support, at least one image-forming layer containing an organic silver salt, a reducing agent, and a light-sensitive silver halide, and at least one protective layer provided on the image-forming layer, wherein the image-forming layer and the protective layer contain a polymer latex as a binder, and the polymer latex of the image-forming layer and/or the protective layer comprises a self-crosslinkable polymer latex.

In a preferred embodiment of the present invention, the self-crosslinkable polymer latex is contained as the polymer latex of the protective layer.

In another preferred embodiment of the present invention, content of the self-crosslinkable polymer latex in the image-forming layer and/or the protective layer as a solid content based on the polymer latex component of each layer is 40% by weight to 100% by weight, more preferably 60% by weight to 100% by weight, particularly preferably 80% by weight to 100% by weight.

In another preferred embodiment of the present invention, the self-crosslinkable polymer latex is a latex of polymer having a poly-1,2-butadiene structure. This latex of polymer having a poly-1,2-butadiene structure is preferably a latex obtained by polymerization of one or more kinds of vinyl monomers in the presence of maleinated poly-1,2-butadiene. The vinyl monomers are preferably selected from methacrylates, acrylates, carboxyl group-containing vinyl monomers, amide group-containing vinyl monomers, styrenes, halogenated ethylenes, vinyl esters and polymerizable aliphatic hydrocarbons.

In another preferred embodiment of the present invention, the self-crosslinkable polymer latex is a latex of polymer prepared by using an alkali neutralization product of maleinated poly-1,2-butadiene.

BRIEF DESCRIPTION OF THE DRAWING

In FIG. 1, there are shown a halogen lamp 1, heat drum 2, feed rollers 3, continuous belt 4, heat-developable image-recording material 5, exit 6, straightening guide panel 7, feed roller pair 8, flat guide panels 9, feed roller pair 10, and cooling fans 11.

DETAILED DESCRIPTION OF THE INVENTION

Figure 1:
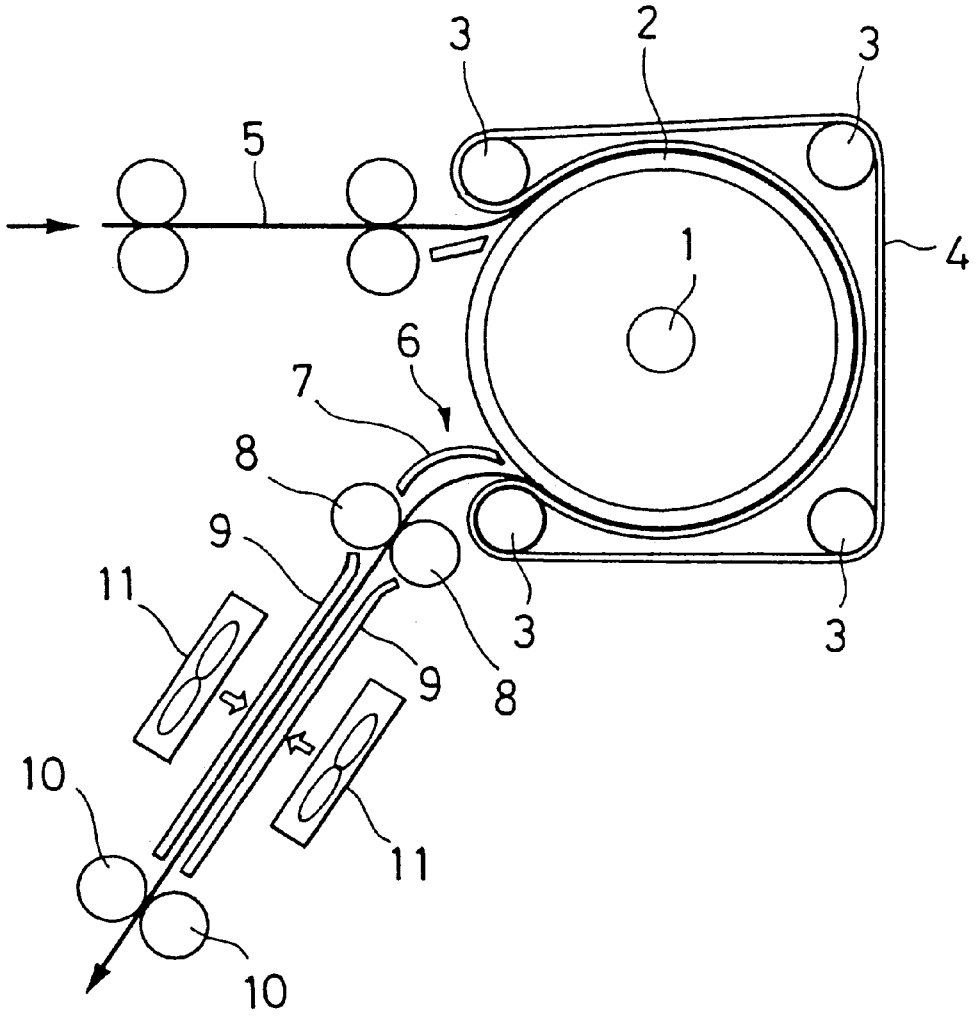
FIG. 1 is side view of an exemplary heat developing apparatus used for the present invention.

Embodiments of the present invention and specific ways of practicing the present invention will be explained in detail hereinafter.

The heat-developable image-recording material of the present invention comprises an image-forming layer containing an organic silver salt, a reducing agent, and a light-sensitive silver halide, and a protective layer provided on the image-forming layer, and it utilizes a polymer latex as a binder of the image-forming layer and the protective layer, which enables aqueous application advantageous from the viewpoints of environmental protection and cost. By utilizing a self-crosslinkable polymer latex as the polymer latex of the image-forming layer and/or the protective layer (preferably the protective layer) in such a heat-developable image-recording material as mentioned above, a heat-developable image-recording material exhibiting excellent suitability for opaquing can be obtained while good photographic performance is maintained. Further, by utilizing a ratio of 40% by weight or more (solid content) for the self-crosslinkable polymer latex in the polymer latex component (solid content) of the protective layer, the suitability for the heat development can advantageously be further improved. The suitability for opaquing and the suitability for heat development can further be improved by utilizing a polymer latex of a polymer having a poly-1,2-butadiene structure as the self-crosslinkable polymer latex.

If the self-crosslinkable polymer latex is not used as the polymer latex, those advantages of the present invention cannot be provided.

According to the present invention, the polymer latex used for the image-forming layer preferably constitutes at least 50% by weight of the total binder thereof. The polymer latex used for the protective layer preferably constitutes at least 80% by weight of the total binder thereof. The polymer latex may be used not only in the image-forming layer and the protective layer, but also in the back layer. When the heat-developable image-recording material of the present invention is used for printing in which the dimensional change causes a problem, the polymer latex is necessary to be used also in the back layer. The "polymer latex" as used herein means a polymer latex comprising water-insoluble hydrophobic polymer fine particles dispersed in a water-soluble dispersion medium. With respect to the dispersion state, the polymer may be emulsified in the dispersion medium, emulsion-polymerized or micell dispersed, or the polymer may have a partial hydrophilic structure in the polymer molecule so that the molecular chains themselves are molecular dispersed. The dispersed particles preferably have an average particle size of from 1 to 50,000 nm, more preferably from about 5 to about 1,000 nm. The particle size is determined by the light scattering method described in the following publications. The particle size distribution of the dispersed particles is not particularly limited, and the dispersed particles may have a broad particle size distribution or a monodisperse particle size distribution. The polymer latex is described in *Gosei Jushi Emulsion* (*Synthetic Resin Emulsion*), compiled by Taira Okuda and Hiroshi Inagaki, issued by Kobunshi Kanko Kai (1978), and Soichi Muroi, *Kobunshi Latex no Kagaku* (*Chemistry of Polymer Latex*), Kobunshi Kanko Kai (1970) and the like.

The self-crosslinkable polymer latex used for the present invention refers to a polymer latex that undergoes crosslinking reaction even at a temperature of 60° C. or lower without adding a crosslinking agent after a film is formed by application. The content of the self-crosslinkable polymer latex used for the image-forming layer or the protective layer according to the present invention is preferably 40% by weight to 100% by weight based on the total latex as a solid content (when a polymer latex which is not a self-crosslinkable polymer latex is particularly indicated, it will be referred to as a "non-self-crosslinkable polymer latex" hereinafter).

As the polymer latex for use in the present invention, a so-called core/shell type latex may be used other than the normal polymer latex having a uniform structure. In this case, it is preferred in some cases that the core and the shell have different Tg (glass transition temperatures).

The polymer latex used as a binder in the present invention has a glass transition temperature (Tg) of which preferred range may be different among those for the protective layer, the back layer and the image-forming layer. In the image-forming layer, the glass transition temperature is preferably 40° C. or lower, more preferably from −30 to 40° C. so as to accelerate the diffusion of the photographically useful materials at the time of heat development, whereas in the protective layer or the back layer, it is preferably from 25 to 70° C. because the layers are put into contact with various kinds of equipment.

The polymer latex for use in the present invention preferably has a minimum film-forming temperature (MFT) of from −30 to 90° C., more preferably from 0 to 70"C. In order to control the MFT, a film-forming aid may be added. The film-forming aid is also called a plasticizer, and is an organic compound (usually an organic solvent) capable of reducing the MFT of the polymer latex. This organic compound is described in Souichi Muroi, *Gosei Latex no Kagaku* (*Chemistry of Synthetic Latex*), Kobunshi Kanko Kai (1970), supra.

The polymer species of the polymer latex for use in the present invention may be an acrylic resin, a vinyl acetate resin, a polyester resin, a polyurethane resin, a rubber-based resin, a vinyl chloride resin, a vinylidene chloride resin, a polyolefin resin or a copolymer thereof. The polymer may be a straight-chained polymer, a branched polymer or a cross-linked polymer. The polymer may be a so-called homopolymer obtained by polymerizing a single kind of monomer or may be a copolymer obtained by polymerizing two or more kinds of monomers. The polymer preferably has a number average molecular weight of from 5,000 to 1,000,000, more preferably on the order of from 10,000 to 100,000. If the molecular weight is too small, the image-forming layer is deficient in the mechanical strength, whereas if it is excessively large, the film-forming property is disadvantageously poor.

The image-forming layer of the heat-developable image-recording material according to the present invention preferably contains the polymer latex in an amount of 50% by weight or more, particularly preferably 70% by weight or more, based on the total binder. The protective layer preferably contains the polymer latex in an amount of 80% by weight or more, particularly preferably 90% by weight or more, based on the total binder.

Specific examples of the non-self-crosslinkable polymer latex used as a binder in the present invention include methyl methacrylate/ethyl acrylate/methacrylic acid copolymer latexes, methyl methacrylate/2-ethylhexyl acrylate/styrene/acrylic acid copolymer latexes, styrene/butadiene/acrylic acid copolymer latexes, styrene/butadiene/divinylbenzene/methacrylic acid copolymer latexes, methyl methacrylate/vinyl chloride/acrylic acid copolymer latexes, vinylidene chloride/ethyl acrylate/acrylonitrile/methacrylic acid copolymer latexes and the like. Such polymers are also commercially available and examples of the polymer which can be used include acrylic resins such as CEBIAN A-4635, 4601 (both produced by Dicel Kagaku Kogyo KK) and Nipol Lx811, 814, 821, 820, 857 (all produced by Nippon Zeon KK); polyester resins such as FINETEX ES650, 611, 675, 850 (all produced by Dai-Nippon Ink & Chemicals, Inc.), WD-size and WMS (both produced by Eastman Chemical); polyurethane resins such as HYDRAN AP10, 20, 30, 40 (all produced by Dai-Nippon Ink & Chemicals, Inc.); rubber-based resins such as LACSTAR 7310K, 3307B, 4700H, 7132C (all produced by Dai-Nippon Ink & Chemicals, Inc.), Nipol Lx416, 410, 438C and 2507 (all produced by Nippon Zeon KK); vinyl chloride resins such as G351, G756 (both produced by Nippon Zeon KK); vinylidene chloride resins such as L502, L513 (both produced by Asahi Chemical Industry Co., Ltd.), ARON D7020, D504 and D5071 (all produced by Mitsui Chemical Co., Ltd.); and olefin resins such as CHEMIPEARL S120 and SA100 (both produced by Mitsui Chemical Co., Ltd.). These polymers may be used individually or, if desired, as a blend of two or more of them.

Specific examples of the self-crosslinkable polymer latex among the polymer latex used as a binder according to the present invention include the followings: latexes of polymers containing N-methylol groups such as latexes of methyl methacrylate/ethyl acrylate/N-methylolacrylamide copolymers, latexes of methyl methacrylate/N-methylolacrylamide copolymers and latexes of butyl acrylate/N-methylolacrylamide copolymers; latexes of polymers having a poly-1,2-butadiene structure such as latexes obtained by polymerization of one or more kinds of vinyl monomers (for example, methacrylates such as methyl methacrylate, ethyl methacrylate, butyl methacrylate, hexyl methacrylate, 2-ethylhexyl methacrylate, allyl methacrylate, ethylene glycol dimethacrylate; acrylates such as methyl acrylate, ethyl acrylate, butyl acrylate, hexyl acrylate, 2-ethylhexyl acrylate, and allyl acrylate; carboxyl group-containing vinyl monomers such as acrylic acid, methacrylic acid, and itaconic acid; amide group-containing vinyl monomers such as acrylamide and methacrylamide; styrenes such as styrene, 4-methylstyrene, styrenesulfonic acid, and divinylstyrene; halogenated ethylenes such as ethylene chloride and vinylidene chloride; vinyl esters such as vinyl acetate and vinyl propionate; polymerizable aliphatic hydrocarbons such as ethylene and butadiene etc.) in the presence of maleinated poly-1,2-butadiene. Among these, latexes of polymers having a poly-1,2-butadiene structure are preferred, and those synthesized by using alkali neutralization products of maleinated poly-1,2-butadiene are preferred. As for specific synthesis methods of these, one can make reference to JP-B-51-25075 (the code "JP-B" as used herein means an "examined Japanese patent publication"). These polymers may be used alone, or as any combination of two or more kinds of them as required.

According to the present invention, the ratio of the self-crosslinkable polymer latex (solid content) in the polymer latex (solid content) used for the image-forming layer and/or the protective layer is, in each layer, preferably 40% by weight to 100% by weight, more preferably 60% by weight to 100% by weight, particularly preferably 80% by weight to 100% by weight.

The binder used for the present invention may be, if necessary, added with a binder other than those derived from the polymer latex, for example, hydrophilic polymers such as polyvinyl alcohol, polyvinylpyrrolidone, polyether, urea/formaldehyde resins, cellulose derivatives (e.g., methylcellulose, hydroxypropylcellulose, carboxymethylcellulose, cyanoethylcellulose, cellulose acetate), polyacrylamide, poly(N-alkyl-substituted acrylamide), polyacrylic acid, polymethacrylic acid, polyvinylsulfonic acid, polyvinyl imidazole, carrageenan, pectin, amylose, starch derivatives, alginic acid, pullulan, and gelatin. The content of these hydrophilic polymers is preferably not more than 50% by weight for the image-forming layer, and not more than 20% by weight for the protective layer, based on the total binder of each layer.

When the present invention is practiced, an application solution for the image-forming layer preferably contains water in an amount of 60% by weight or more (not more than 100% by weight), and that for the protective layer preferably contains water in an amount of 80% by weight or more (not more than 100% by weight) of the solvent (dispersion medium). The component other than water of the coating solutions may be a water-miscible organic solvent such as methyl alcohol, ethyl alcohol, isopropyl alcohol, methyl cellosolve, ethyl cellosolve, dimethylformamide and ethyl acetate. Specific examples of the solvent composition include water/methanol=90/10, eater/methanol=70/30, water/ethanol=90/10, water/isopropanol=90/10, water/dimethylformamide=95/5, water/methanol/dimethylformamide=80/15/5 and water/methanol/dimethylformamide=90/5/5 (the numerals are in % by weight).

The total binder amount in the protective layer according to the present invention is preferably from 0.2 to 5.0 g/m$^2$, more preferably from 0.5 to 3.0 g/m$^2$.

The total binder amount in the image-forming layer according to the present invention is preferably from 0.2 to 30 g/m$^2$, more preferably from 1.0 to 15 g/m$^2$.

The total binder amount in the back layer according to the present invention is preferably from 0.01 to 3 g/m$^2$, more preferably from 0.05 to 1.5 g/m$^2$.

Each of the image-forming layer and the back layer may contain a crosslinking agent for crosslinking, surfactant for improving coatability and the like.

Two or more layers may be provided for each of these layers. When the image-forming layer is composed of two or more layers, it is preferred that all of the layers contain a polymer latex as a binder. The protective layer is provided on the image-forming layer, and it may also be composed of two or more layers. In such a case, it is preferred that at least one layer thereof, in particular, the outermost layer of the protective layer contains a polymer latex as a binder. The back layer is provided on an undercoat layer provided on the back face of the support, and it may also be composed of two or more layers. In such a case, it is preferred that at least one layer thereof, in particular, the outermost layer of the back layer contains a polymer latex as a binder.

For the heat-developable image-recording material of the present invention, various kinds of support can be used. Typical supports comprises polyester such as polyethylene terephthalate, and polyethylene naphthalate, cellulose nitrate, cellulose ester, polyvinylacetal, polycarbonate or the like. Among these, biaxially stretched polyester, especially polyethylene terephthalate (PET), is preferred in view of strength, dimensional stability, chemical resistance and the like. The support preferably has a thickness of 90–180 $\mu$m as a base thickness except for the undercoat layer.

Preferably used as the support of the heat-developable image-recording material of the present invention is a polyester film, in particular polyethylene terephthalate film, subjected to a heat treatment in a temperature range of 130–210° C. in order to relax the internal distortion formed in the film during the biaxial stretching so that thermal shrinkage distortion occurring during the heat development should be eliminated. Such a thermal relaxation treatment may be performed at a constant temperature within the above temperature range, or it may be performed with raising the temperature.

The heat treatment of the support may be performed for the support in the form of a roll, or it may be performed for the support that is conveyed as a web. When it is performed for a support that is conveyed as a web, it is preferred that the conveying tension should be not more than 7 kg/cm$^2$, in particular, not more than 4.2 kg/cm$^2$. The lower limit of the conveying tension is, while not particularly limited, 0.5 kg/cm$^2$ or so.

This heat treatment is preferably performed after a treatment for improving adhesion of the image-forming layer and the back layer to the support, for example, application of the undercoat layer.

The thermal shrinkage of the support upon heating at 120° C. for 30 seconds is preferably −0.03% to +0.01% for the machine direction (MD), and 0 to 0.04% for the transverse direction (TD).

The support may be applied with an undercoat layer containing SBR, polyvinylidene chloride, polyester, gelatin or the like as a binder, as required. The undercoat layer may be composed of multiple layers, and may be provided on one side or both sides of the support. At least one of the undercoat layers may be an electroconductive layer. The undercoat layer generally has a thickness of 0.01–5 $\mu$m, more preferably 0.05–1 $\mu$m. When it is an electroconductive layer, it preferably has a thickness of 0.01–1 ||m, more preferably 0.03–0.8 $\mu$m.

The back layer next to the support of the heat-developable image-recording material of the present invention and the undercoat layer preferably contain metal oxides in order to reduce dust adhesion, and it is preferred that at least one of the back layer and the undercoat layer (those provided on the both side of the support) should be an electroconductive layer. However, the electroconductive layer is preferably not the outermost layer of the back layer.

As the metal oxide used for this, those disclosed in JP-A-61-20033 and JP-A-56-82504 are particularly preferred.

According to the present invention, the amount of the electroconductive metal oxide is preferably 0.05–20 g, particularly preferably 0.1–10 g per 1m$^2$ of the image-recording material. Surface resistivity of the metal oxide-containing layer is not more than $10^{12}$ Ω. preferably not more than $10^{11}$ Ω under an atmosphere of 25° C. and 25% RH. Such surface resistivity affords good antistatic preperty. The lower limit of the surface resistivity is not particularly limited, but it is generally around $10^7$ Ω.

According to the present invention, further improved antistatic property can be obtained by using a fluorine-containing surfactant in addition to the aforementioned metal oxide.

The preferred fluorine-containing surfactants for use in the invention are surfactants which have a fluoroalkyl, fluoroalkenyl or fluoroaryl group which has at least 4 carbon atoms (usually 15 or less), and which have, as ionic groups, anionic groups (for example, sulfonic acid or salts thereof, sulfuric acid or salts thereof, carboxylic acid or salts thereof, phosphoric acid or salts thereof), cationic groups (for example, amine salts, ammonium salts, aromatic amine salts, sulfonium salts, phosphonium salts), betaine groups (for example, carboxyamine salts, carboxyammonium salts, sulfoamine salts, sulfoammonium salts, phosphoammonium salts), or non-ionic groups (substituted or unsubstituted poly(oxyalkylene) groups, polyglyceryl groups or sorbitane residual groups).

Such fluorine-containing surfactants have been disclosed, for example, in JP-A-49-10722, British Patent 1,330,356, U.S. Pat. Nos. 4,335,201 and 4,347,308, British Patent 1,417,915, JP-A-55-149938, JP-A-58-196544 and British Patent No. 1,439,402. Specific examples of these materials are indicated below.

F-1

$C_8F_{17}SO_3K$

F-2

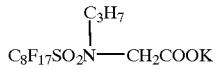

F-3

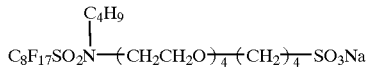

F-4

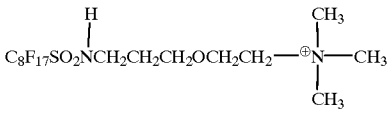

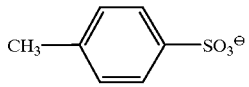

F-5

$C_8F_{17}SO_3Li$

No limitation is imposed upon the layer to which the fluorine-containing surfactant is added provided that it is included in at least one layer of the image-recording material, and it can be included, for example, in the surface protecting layer, emulsion layer, intermediate layer, undercoat layer or back layer. It is, however, preferably added to the surface protective layer, and while it may be added to one of the protective layers on the image-forming layer side and the back layer side, it is further preferably added to at least the protective layer on the image-forming layer side.

When the surface protective layer is composed of two or more layers, the fluorine-containing surfactant can be added to any of these layers, or it may be used in the form of an overcoat over the surface protective layer.

The amount of fluorine-containing surfactant used in this invention may be from 0.0001 to 1 g, preferably from 0.0002 to 0.25 g, particularly desirably from 0.0003 to 0.1 g, per 1 $m^2$ of the image-recording material.

Furthermore, two or more of the fluorine-containing surfactants can be mixed together.

Beck smoothness in the present invention can be easily determined by Japanese Industrial Standard (JIS) P8119, "Test Method for Smoothness of Paper and Paperboard by Beck Test Device" and TAPPI Standard Method T479.

Beck smoothness of at least one, or preferably both of the outermost layers of the image-forming layer side and the opposite side of the heat-developable image-recording material according to the present invention is 2000 seconds or less, preferably from 10 seconds to 2000 seconds.

Beck smoothness of the outermost layers of the image-forming layer side and the opposite side of the heat-developable image-recording material according to the present invention can be controlled by changing an average particle diameter and an addition amount of microparticles called matting agent incorporated into the outermost layers on the both sides. The matting agent is preferably contained in the outermost layer of the protective layer remotest from the support for the side of the image-forming layer, and in a layer of the back layer which is not the outermost layer for the opposite side.

The average particle diameter of the matting agent in the present invention is preferably in the range of from 1 to 10 $\mu$m. The amount of the matting agent added in the present invention is preferably in the range of from 5 to 400 mg/$m^2$, particularly in the range of from 10 to 200 mg/$m^2$.

The matting agent used in the present invention may be any solid particles so long as they do not adversely affect various photographic properties. Inorganic matting agents include silicon dioxide, titanium and aluminum oxides, zinc and calcium carbonates, barium and calcium sulfates, calcium and aluminum silicates and the like, and organic matting agents include cellulose esters, organic polymer matting agents such as those of polymethyl methacrylate, polystyrene or polydivinylbenzene, copolymers thereof and the like.

In the present invention, it is preferred to use a porous matting agent described in JP-A-3-109542, page 2, lower left column, line 8 to page 3, upper right column, line 4, a matting agent in which the surface thereof has been modified with an alkali described in JP-A-4-127142, page 3, upper right column, line 7 to page 5, lower right column, line 4, or a matting agent of an organic polymer described in JP-A-6-118542, Paragraph Nos. [0005] to [0026].

Further, two or more kinds of these matting agents may be used in combination. For example, a combination of an inorganic matting agent and an organic matting agent, a combination of a porous matting agent and a non-porous matting agent, a combination of indefinite shape matting agent and a globular matting agent, a combination of matting agents having different average particle diameters (for example, a combination of a matting agent having an average particle diameter of 1.5 $\mu$m or more and a matting agent having an average particle diameter of 1 $\mu$m or less as described in JP-A-6-118542) can be used.

According to the present invention, the outermost layers on the image-forming layer side and/or the opposite side preferably contain a lubricant.

No particular limitation is imposed upon the lubricant used in the present invention, and any compound which, when present at the surface of an object, reduces the friction coefficient of the surface relative to that when the compound is absent can be used for this purpose.

Typical examples of the lubricant which can be used in the present invention include the silicone based lubricants disclosed in U.S. Pat. No. 3,042,522, British Patent No. 955,061, U.S. Pat. Nos. 3,080,317, 4,004,927, 4,047,958 and 3,489,567, British Patent No. 1,143,118 and the like, the higher fatty acid based, alcohol based and acid amide based lubricants disclosed in U.S. Pat. Nos. 2,454,043, 2,732,305, 2,976,148 and 3,206,311, German Patent Nos. 1,284,295, 1,284,294 and the like, the metal soaps disclosed in British Patent No. 1,263,722, U.S. Pat. No. 3,933,516 and the like, the ester based and ether based lubricants disclosed in U.S. Pat. Nos. 2,588,765, 3,121,060, British Patent No. 1,198,387, the taurine based lubricants disclosed in U.S. Pat. Nos. 3,502,473 and 3,042,222 and the like.

Specific examples of the lubricant preferably used include, CELLOSOL 524 (main ingredient is carnauba wax), POLYLON A, 393, H -481 (main ingredient is polyethylene wax), HIMICRON G-110 (main ingredient is ethylene bis-stearic acid amide), HIMICRON G -270 (main ingredient is stearic acid amide) (all from Chukyo Oil & Fat).

The amount of the lubricant used is 0.1–50% by weight, preferably 0.5–30 % by weight of binder contained in a layer to which the lubricant is added.

The heat-developable image-recording material of the present invention contains a light-sensitive silver halide. The light-sensitive silver halide for use in the present invention may be any of silver chloride, silver chlorobromide, and silver iodochlorobromide. The halogen composition distribution within the grain may be uniform, or the halogen composition may be changed stepwise or continuously.

The method of forming light-sensitive silver halide used for the present invention is well known in the art and, for example, the methods described in *Research Disclosure*, No. 17029 (June, 1978) and U.S. Pat. No. 3,700,458 may be used. Specifically, a method comprising converting a part of silver in the produced organic silver salt to light-sensitive silver halide by adding a halogen-containing compound to the organic silver salt, or a method comprising adding a silver-supplying compound and a halogen-supplying compound to gelatin or other polymer solution to thereby prepare light-sensitive silver halide and mixing the silver halide with an organic silver salt may be used for the present invention. The light-sensitive silver halide grain preferably has a small grain size so as to prevent high white turbidity after the formation of an image. Specifically, the grain size is preferably 0.20 $\mu$m or less, more preferably from 0.01 to 0.15 $\mu$m, still more preferably from 0.02 to 0.12 $\mu$m. The term "grain size" as used herein means the length of an ridge of the silver halide grain in the case where the silver halide grain is a regular crystal such as cubic or octahedral grain; the diameter of a circle image having the same area as the projected area of the main surface plane in the case where the silver halide grain is a tabular silver halide grain; or the diameter of a sphere having the same volume as the silver halide grain in the case of other irregular crystals such as spherical or bar grain.

Examples of the shape of the silver halide grain include cubic form, octahedral form, tabular form, spherical form, stick form and bebble form, and among these, cubic grain and tabular grain are preferred in the present invention. When a tabular silver halide grain is used, the average aspect ratio is preferably from 100:1 to 2:1, more preferably from 50:1 to 3:1. A silver halide grain having rounded corners is also preferably used. The face index (Miller indices) of the outer surface plane of a light-sensitive silver halide grain is not particularly limited; however, it is preferred that [100] faces capable of giving a high spectral sensitization efficiency upon adsorption of the spectral sensitizing dye occupy a high ratio. The ratio is preferably 50% or more, more preferably 65% or more, still more preferably 80% or more. The ratio of [100] faces according to the Miller indices can be determined by the method described in T. Tani, *J. Imaging Sci.,* 29, 165 (1985) using the adsorption dependency of [111] face and [100] face upon adsorption of the sensitizing dye.

The light-sensitive silver halide grain for use in the present invention contains a metal or metal complex of Group VII or VIII in the Periodic Table. The center metal of the metal or metal complex of Group VII or VIII of the Periodic Table is preferably rhodium, rhenium, ruthenium, osnium or iridium. One kind of metal complex may be used or two or more kinds of complexes of the same metal or different metals may also be used in combination. The metal complex content is preferably from $1\times10^{-9}$ to $1\times10^{-2}$ mol, more preferably from $1\times10^{-8}$ to $1\times10^{-4}$ mol, per mol of silver. With respect to the specific structure of the metal complex, the metal complexes having the structures described in JP-A-7-225449 may be used.

As the rhodium compound for use in the present invention, a water-soluble rhodium compound may be used. Examples thereof include a rhodium(III) halogenide compounds and rhodium complex salts having a halogen, an amine or an oxalate as a ligand, such as hexachlororhodium (III) complex salt, pentachloroaquorhodium(III) complex salt, tetrachlorodiaquorhodium(III) complex salt, hexabromorhodium(III) complex salt, hexaamminerhodium (III) complex salt and trioxalatorhodium(III) complex salt. The rhodium compound is used after dissolving it in water or an appropriate solvent and a method commonly used for stabilizing the rhodium compound solution, that is, a method comprising adding an aqueous solution of hydrogen halogenide (e.g., hydrochloric acid, bromic acid, fluoric acid) or halogenated alkali (e.g., KCl, NaCl, KBr, NaBr) may be used. In place of using a water-soluble rhodium, separate silver halide grains previously doped with rhodium may be added and dissolved at the time of preparation of silver halide.

The amount of the rhodium compound added is preferably from $1\times10^{-8}$ to $5\times10^{-6}$ mol, more preferably from $5\times10^{-8}$ to $1\times10^{-6}$ mol, per mol of silver halide.

The rhodium compound may be appropriately added at the time of production of silver halide emulsion grains or at respective stages before coating of the emulsion. However, the rhodium compound is preferably added at the time of formation of the emulsion and integrated into the silver halide grain.

The rhenium, ruthenium or osmium for use in the present invention is added in the form of a water-soluble complex salt described in JP-A-63-2042, JP-A-1-285941, JP-A-2-20852 and JP-A-2-20855. A preferred example thereof is a six-coordinate complex salt represented by the following formula:

$$[ML_6]^{n-}$$

wherein M represents Ru, Re or Os, L represents a ligand, and n represents 0, 1, 2, 3 or 4. In this case, the counter ion plays no important role and an ammonium or alkali metal ion is used.

Preferred examples of the ligand include a halide ligand, a cyanide ligand, a cyan oxide ligand, a nitrosyl ligand and a thionitrosyl ligand. Specific examples of the complex for use in the present invention are shown below, but the present invention is by no means limited thereto.

| | | |
|---|---|---|
| $[ReCl_6]^{3-}$ | $[ReBr_6]^{3-}$ | $[ReCl_5(NO)]^{2-}$ |
| $[Re(NS)Br_5]^{2-}$ | $[Re(NO)(CN)_5]^{2-}$ | $[Re(O)_2(CN)_4]^{3-}$ |
| $[RuCl_6]^{3-}$ | $[RuCl_4(H_2O)_2]^{-}$ | $[RuCl_5(H_2O)]^{2-}$ |
| $[RuCl_5(NO)]^{2-}$ | $[RuBr_5(NS)]^{2-}$ | |
| $[Ru(CO)_3Cl_3]^{2-}$ | $[Ru(CO)Cl_5]^{2-}$ | $[Ru(CO)Br_5]^{2-}$ |
| $[OsCl_6]^{3-}$ | $[OsCl_5(NO)]^{2-}$ | $[Os(NO)(CN)_5]^{2-}$ |
| $[Os(NS)Br_5]^{2-}$ | $[Os(CN)_6]^{4-}$ | |

The addition amount of these compound is preferably from $1\times10^{-9}$ to $1\times10^{-5}$ mol, more preferably from $1\times10^{-8}$ to $1\times10^{-6}$ mol, per mol of silver halide.

These compounds may be added appropriately at the time of preparation of silver halide emulsion grains or at respective stages before coating of the emulsion, but the compounds are preferably added at the time of formation of the emulsion and integrated into a silver halide grain.

For adding the compound during the grain formation of silver halide and integrating it into a silver halide grain, a method where a metal complex powder or an aqueous solution having dissolved therein the metal complex together with NaCl or KCl is added to a water-soluble salt or water-soluble halide solution during the grain formation, a method where the compound is added as the third solution at the time of simultaneously mixing a silver salt and a halide solution to prepare silver halide grains by the triple jet method, or a method where a necessary amount of an aqueous metal complex solution is poured into a reaction vessel during the grain formation, may be used. Among these, preferred is a method comprising adding a metal complex powder or an aqueous solution having dissolved therein the metal complex together with NaCl or KCl to a water-soluble halide solution.

In order to add the compound to the grain surface, a necessary amount of an aqueous metal complex solution may be charged into a reaction vessel immediately after the grain formation, during or after completion of the physical ripening, or at the time of chemical ripening.

As the iridium compound for use in the present invention, various compounds may be used, and examples thereof include hexachloroiridium, hexammineiridium, trioxalatoiridium, hexacyanoiridium and pentachloronitrosyliridium. The iridium compound is used after dissolving it in water or an appropriate solvent, and a method commonly used for stabilizing the iridium compound solution, more specifically, a method comprising adding an aqueous solution of hydrogen halogenide (e.g., hydrochloric acid, bromic acid, fluoric acid) or halogenated alkali (e.g., KCl, NaCl, KBr, NaBr) may be used. In place of using a water-soluble iridium, separate silver halide grains previously doped with iridium may be added and dissolved at the time of preparation of silver halide.

The silver halide grain for use in the present invention may further contain a metal atom such as cobalt, iron, nickel, chromium, palladium, platinum, gold, thallium, copper and lead. In the case of cobalt, iron, chromium or ruthenium compound, a hexacyano metal complex is preferably used. Specific examples thereof include ferricyanate ion, ferrocyanate ion, hexacyanocobaltate ion, hexacyanochromate ion and hexacyanoruthenate ion. However, the present invention is by no means limited thereto. The phase of the silver halide, in which the metal complex is contained, is not particularly limited, and the phase may be uniform or the metal complex may be contained in a higher concentration in the core part or in the shell part.

The above-described metal is used preferably in an amount of from $1\times10^{-9}$ to $1\times10^{-4}$ mol per mol of silver halide. The metal may be converted into a metal salt in the form of a simple salt, a composite salt or a complex salt and added at the time of preparation of grains.

The light-sensitive silver halide grain may be desalted by water washing according to a method known in the art, such as noodle washing and flocculation, but the grain may not be desalted in the present invention.

The silver halide emulsion for use in the present invention is preferably subjected to chemical sensitization. The chemical sensitization may be performed using a known method such as sulfur sensitization, selenium sensitization, tellurium sensitization or noble metal sensitization. These sensitization method may be used alone or in any combination. When these sensitization methods are used as a combination, a combination of sulfur sensitization and gold sensitization, a combination of sulfur sensitization, selenium sensitization and gold sensitization, a combination of sulfur sensitization, tellurium sensitization and gold sensitization, and a combination of sulfur sensitization, selenium sensitization, tellurium sensitization and gold sensitization, for example, are preferred.

The sulfur sensitization preferably used in the present invention is usually performed by adding a sulfur sensitizer and stirring the emulsion at a high temperature of 40° C. or higher for a predetermined time. The sulfur sensitizer may be a known compound and examples thereof include, in addition to the sulfur compound contained in gelatin, various sulfur compounds such as thiosulfates, thioureas, thiazoles and rhodanines. Preferred sulfur compounds are a thiosulfate and a thiourea compound. The amount of the sulfur sensitizer added varies depending upon various conditions such as the pH and the temperature at the chemical ripening and the size of silver halide grain. However, it is preferably from $10^{-7}$ to $10^{-2}$ mol, more preferably from $10^{-5}$ to $10^{-3}$ mol, per mol of silver halide.

The selenium sensitizer for use in the present invention may be a known selenium compound. The selenium sensitization is usually performed by adding a labile and/or non-labile selenium compound and stirring the emulsion at a high temperature of 40° C. or higher for a predetermined time. Examples of the labile selenium compound include the compounds described in JP-B-44-15748, JP-B-43-13489, JP-A-4-25832, JP-A-4-109240 and JP-A-4-324855. Among these, particularly preferred are the compounds represented by formulae (VIII) and (IX) of JP-A-4-324855.

The tellurium sensitizer for use in the present invention is a compound of forming silver telluride presumed to work out to a sensitization nucleus, on the surface or in the inside of a silver halide grain. The rate of the formation of silver telluride in a silver halide emulsion can be examined according to a method described in JP-A-5-313284. Examples of the tellurium sensitizer include diacyl tellurides, bis (oxycarbonyl) tellurides, bis(carbamoyl) tellurides, diacyl tellurides, bis(oxycarbonyl) ditellurides, bis(carbamoyl) ditellurides, compounds having a P=Te bond, tellurocarboxylates, Te-organyltellurocarboxylic acid esters, di (poly) tellurides, tellurides, tellurols, telluroacetals, tellurosulfonates, compounds having a P—Te bond, Te-containing heterocyclic rings, tellurocarbonyl compounds, inorganic tellurium compounds and colloidal tellurium. Specific examples thereof include the compounds described in U.S. Pat. Nos. 1,623,499, 3,320,069 and 3,772,031, British Patent Nos. 235,211, 1,121,496, 1,295,462 and 1,396,696, Canadian Patent No. 800,958, JP-A-4-204640, JP-A-3-53693, JP-A-4-271341, JP-A-4-333043, JP-A-5-303157, *J. Chem. Soc. Chem. Commun.,* 635 (1980), ibid., 1102 (1979), ibid., 645 (1979), *J. Chem. Soc. Perkin. Trans.,* 1, 2191 (1980), S. Patai (compiler), *The Chemistry of Organic Selenium and Tellurium Compounds*, Vol. 1 (1986), and ibid., Vol. 2 (1987). The compounds represented by formulae (II), (III) and (IV) of JP-A-5-313284 are particularly preferred.

The amount of the selenium or tellurium sensitizer used in the present invention varies depending on silver halide grains used or chemical ripening conditions. However, it is usually from $10^{-8}$ to $10^{-2}$ mol, preferably on the order of from $10^{-7}$ to $10^{-3}$ mol, per mol of silver halide. The conditions for chemical sensitization in the present invention are not particularly restricted. However, in general, the pH is from 5 to 8, the pAg is from 6 to 11, preferably from 7 to 10, and the temperature is from 40 to 95° C., preferably from 45 to 85° C.

Noble metal sensitizers for use in the present invention include gold, platinum, palladium and iridium, and particularly, gold sensitization is preferred. Examples of the gold sensitizers used in the present invention include chloroauric acid, potassium chloroaurate, potassium aurithiocyanate and gold sulfide. They can be used in an amount of about $10^{-7}$ mol to about $10^{-2}$ mol per mol of silver halide.

In the silver halide emulsion for use in the present invention, a cadmium salt, a sulfite, a lead salt or a thallium salt may be allowed to be present together during formation or physical ripening of silver halide grains.

In the present invention, reduction sensitization may be used. Specific examples of the compound used in the reduction sensitization include an ascorbic acid, thiourea dioxide, stannous chloride, aminoiminomethanesulfinic acid, a hydrazine derivative, a borane compound, a silane compound and a polyamine compound. The reduction sensitization may be performed by ripening the grains while keeping the emulsion at a pH of 7 or more or at a pAg of 8.3 or less. Also, the reduction sensitization maybe performed by introducing a single addition part of silver ion during the formation of grains.

To the silver halide emulsion of the present invention, athiosulfonic acid compound may be added by the method described in European Patent 293917A.

In the heat-developable image-forming material used for the present invention, one kind of silver halide emulsion may be used or two or more kinds of silver halide emulsions (for example, those different in the average grain size, different in the halogen composition, different in the crystal habit or different in the chemical sensitization conditions) may be used in combination.

The amount of the light-sensitive silver halide used in the present invention is preferably from 0.01 to 0.5 mol, more preferably from 0.02 to 0.3 mol, still more preferably from 0.03 to 0.25 mol, per mol of the organic silver salt. The method and conditions for mixing light-sensitive silver halide and organic silver salt which are prepared separately are not particularly limited as far as the effect of the present invention can be brought out satisfactorily. However, a method of mixing the silver halide grains and the organic silver salt after completion of respective preparations in a high-speed stirring machine, a ball mill, a sand mill, a colloid mill, a vibrating mill or a homogenizer or the like, or a method involving preparing organic silver salt while mixing therewith light-sensitive silver halide after completion of the preparation in any timing during preparation of the organic silver salt, or the like may be used.

As a method for producing silver halides used for the present invention, the so-called halidation can also be preferably used, in which a part of silver of organic silver salts is halogenated with organic or inorganic halide. While the organic halide compound used for this method is not particularly limited so long as it can react with organic silver salt to form a silver halide, examples thereof include, for example, N-halogenoimides (N-bromosuccinimide etc.), halogenated quaternary nitrogen compounds (tetrabutylammonium bromide etc.), halogenated quaternary nitrogen compounds associated with halogen (pyridinium bromide perbromide etc.) and the like. As for the inorganic halide compound, while it is not particularly limited so long as it can react with organic silver salt to form a silver halide, examples thereof include, for example, alkali metal halides or ammonium halides (e.g., sodium chloride, lithium bromide, potassium iodide, ammonium bromide), alkali earth metal halides (e.g., calcium bromide, magnesium chloride), transition metal halides (ferric chloride, cupric bromide etc.), metal complexes having halogen ligands (sodium bromoiridate, ammonium chlororhodate etc.), halogen atoms (bromine, chlorine, iodine etc.) and the like. The organic and inorganic halides can be used in a desired combination.

The amount of the halide compounds when the halidation is used for the present invention is preferably 1 mM to 500 mM, more preferably 10 mM to 250 mM in terms of halogen atom per 1 mol of the organic silver salt.

The heat-developable image-recording material of the present invention comprises an organic silver salt. The organic silver salt which can be used in the present invention is a silver salt which is relatively stable against light but forms a silver image when it is heated at 80° C. or higher in the presence of an exposed photocatalyst (e.g., a latent image of light-sensitive silver halide) and a reducing agent. The organic silver salt may be any organic substance containing a source capable of reducing the silver ion. A silver salt of an organic acid, particularly a silver salt of a long chained aliphatic carboxylic acid (having from 10 to 30, preferably from 15 to 28 carbon atoms) is preferred. A complex of an organic or inorganic silver salt, of which ligand has a complex stability constant of from 4.0 to 10.0, is also preferred. The silver-supplying substance may constitute preferably from about 5 to 70% by weight of the image-forming layer. The preferred organic silver salt includes a silver salt of an organic compound having a carboxyl group. Examples thereof include an aliphatic carboxylic acid silver salt and an aromatic carboxylic acid silver salt. However, the present invention is by no means limited thereto. Preferred examples of the aliphatic carboxylic acid silver salt include silver behenate, silver arachidinate, silver stearate, silver oleate, silver laurate, silver caproate, silver myristate, silver palmitate, silver maleate, silver fumarate, silver tartrate, silver linoleate, silver butyrate, silver camphorate and a mixture thereof.

Silver salts of compounds having a mercapto or thione group and derivatives thereof may also be used as the organic silver salt. Preferred examples of these compounds include a silver salt of 3-mercapto-4-phenyl-1,2,4-triazole, a silver salt of 2-mercaptobenzimidazole, a silver salt of 2-mercapto-5-aminothiadiazole, a silver salt of 2-(ethylglycolamido)benzothiazole, silver salts of thioglycolic acids such as silver salts of S-alkylthioglycolic acids wherein the alkyl group has 12 to 22 carbon atoms, silver salts of dithiocarboxylic acids such as a silver salt of dithioacetic acid, silver salts of thioamides, a silver salt of 5-carboxyl-1-methyl-2-phenyl-4-thiopyridine, silver salts of mercaptotriazines, a silver salt of 2-mercaptobenzoxazole as well as silver salts of 1,2,4-mercaptothiazole derivatives such as a silver salt of 3-amino-5-benzylthio-1,2,4-thiazole as described in U.S. Pat. No. 4,123,274 and silver salts of thione compounds such as a silver salt of 3-(3-carboxyethyl)-4-methyl-4-thiazoline-2-thione as described in U.S. Pat. No. 3,301,678. Compounds containing an imino group may also be used. Preferred examples of these compounds include silver salts of benzotriazole and derivatives thereof, for example, silver salts of benzotriazoles such as silver methylbenzotriazole, silver salts of halogenated benzotriazoles such as silver 5-chlorobenzotriazole as well as silver salts of 1,2,4-triazole and 1-H-tetrazole and silver salts of imidazole and imidazole derivatives as described in U.S. Pat. No. 4,220,709. Also useful are various silver acetylide compounds as described, for example, in U.S. Pat. Nos. 4,761,361 and 4,775,613.

The shape of the organic silver salt which can be used in the present invention is not particularly limited but an acicular crystal form having a short axis and a long axis is preferred. In the present invention, the short axis is preferably from 0.01 to 0.20 $\mu$m, more preferably from 0.01 to 0.15 $\mu$m, and the long axis is preferably from 0.10 to 5.0 $\mu$m, more preferably from 0.10to 4.0 $\mu$m. The grain size distribution of the organic silver salt is preferably monodisperse. The term "monodisperse" as used herein means that the percentage of the value obtained by dividing the standard deviation of the length of the short axis or long axis by the length of the short axis or long axis, respectively, is preferably 100% or less, more preferably 80% or less, still more preferably 50% or less. The shape of the organic silver salt can be determined by the image of an organic silver salt dispersion observed through a transmission type electron microscope. Another method for determining the monodispesibility is a method involving obtaining the standard deviation of a volume load average diameter of the organic silver salt. The percentage (coefficient of variation) of the value obtained by dividing the standard deviation by the volume load average diameter is preferably 100% or less, more preferably 80% or less, still more preferably 50% or less. The grain size (volume load average diameter) for determining the monodispersibility may be obtained, for example, by irradiating a laser ray on an organic silver salt dispersed in a solution and determining an autocorrelation function of the fluctuation of the scattered light to the change in time.

The organic silver salt which can be used in the present invention is preferably desalted. The desalting method is not particularly limited and a known method may be used. Known filtration methods such as centrifugal filtration, suction filtration, ultrafiltration and flocculation washing by coagulation may be preferably used.

The organic silver salt that can be used for the present invention is converted into a dispersion of solid microparticles using a dispersant in order to obtain coagulation-free microparticles of a small size. The organic silver salt can be mechanically made into a dispersion of solid microparticles by using a known means for producing microparticles (for example, ball mill, vibrating ball mill, planet ball mill, sand mill, colloid mill, jet mill, roller mill, high pressure homogenizer) in the presence of a dispersing aid.

When the organic silver salt is made into microparticles by using a dispersant, the dispersant can be suitably selected from, for example, synthetic anionic polymers such as polyacrylic acid, copolymers of acrylic acid, maleic acid copolymers, maleic acid monoester copolymers and acryloylmethylpropanesulfonic acid copolymers, semisynthetic anionic polymers such as carboxymethylated starch and carboxymethylcellulose, anionic polymers such as alginic acid and pectic acid, anionic surfactants such as those disclosed in JP-A-52-92716, WO88/04794 and the like, compounds disclosed in JP-A-9-179243, known anionic, nonionic and cationic surfactants, other known polymers such as polyvinyl alcohol, polyvinylpyrrolidone, carboxymethylcellulose, hydroxypropylcellulose, and hydroxypropylmethylcellulose, naturally occurring polymers such as gelatin and the like.

The dispersing aid is generally mixed with the organic silver salt in a form of powder or wet cake before the dispersing operation, and fed as slurry into a dispersing apparatus. However, it may be mixed with the organic silver salt beforehand, and subjected to a treatment by heating, with solvent or the like to form organic silver salt powder or wet cake. The pH may be controlled with a suitable pH modifier during or after the dispersing operation.

Other than the dispersing operation by a mechanical means, the organic silver salt can be made into microparticles by roughly dispersing it in a solvent through pH control, and then changing the pH in the presence of a dispersant. For this operation, an organic solvent may be used as the solvent for roughly dispersing the organic silver salt, and such an organic solvent is usually removed after the formation of microparticles.

The produced dispersion can be stored with stirring in order to prevent precipitation of the microparticles during storage, or stored in a highly viscous state formed with a hydrophilic colloids (e.g., a jelly state formed with gelatin). Further, it may be added with a preservative in order to prevent saprophytic proliferation during the storage.

While the organic silver salt can be used for the present invention at any desired amount, it is preferably used in an amount of 0.1–5 g/m$^2$, more preferably 1–3 g/m$^2$ per square meter of the heat-developable image-recording material.

The heat-developable image-recording material of the present invention contains a reducing agent for organic silver salt. The reducing agent for organic silver salt may be any substance, preferably an organic substance, which reduces the silver ion to metal silver. Conventional photographic developers such as phenidone, hydroquinone and catechol are useful, but a hindered phenol reducing agent is preferred. The reducing agent is preferably contained in an amount of from 5 to 50% by mol, more preferably from 10 to 40% by mol, per mol of silver on the surface having an image-forming layer. The layer to which the reducing agent is added may be any layer on the surface having an image-forming layer. In the case of adding the reducing agent to a layer other than the image-forming layer, the reducing agent is preferably used in a slightly large amount of from 10 to 50% by mol per mol of silver. The reducing agent may also be a so-called precursor which is derived to effectively exhibit the function only at the time of development.

For the heat-developable light-sensitive material using an organic silver salt, reducing agents over a wide range are known and these are disclosed in JP-A-46-6074, JP-A-47-1238, JP-A-47-33621, JP-A-49-46427, JP-A-49-115540, JP-A-50-14334, JP-A-50-36110, JP-A-50-147711, JP-A-51-32632, JP-A-51-1023721, JP-A-51-32324, JP-A-51-51933, JP-A-52-84727, JP-A-55-108654, JP-A-56-146133, JP-A-57-82828, JP-A-57-82829, JP-A-6-3793, U.S. Pat. Nos. 3,667,9586, 3,679,426, 3,751,252, 3,751,255, 3,761,270, 3,782,949, 3,839,048, 3,928,686 and 5,464,738, German Patent No. 2,321,328, European Patent 692732 and the like. Examples thereof include amidoximes such as phenylamidoxime, 2-thienylamidoxime and p-phenoxyphenylamidoxime; azines such as 4-hydroxy-3,5-dimethoxybenzaldehyde azine; combinations of an aliphatic carboxylic acid arylhydrazide with an ascorbic acid such as a combination of 2,2-bis(hydroxymethyl)propionyl-β-phenylhydrazine with an ascorbic acid; combinations of polyhydroxybenzene with hydroxylamine, reductone and/or hydrazine such as a combination of hydroquinone with bis(ethoxyethyl)hydroxylamine, piperidinohexose reductone or formyl-4-methylphenylhydrazine; hydroxamic acids such as phenylhydroxamic acid, p-hydroxyphenylhydroxamic acid and β-anilinehydroxamic acid; combinations of an azine with a sulfonamidophenol such as a combination of phenothiazine with 2,6-dichloro-4-benzenesulfonamidophenol; α-cyanophenylacetic acid derivatives such as ethyl-α-cyano-2-methylphenylacetate and ethyl-α-cyanophenylacetate; bis-β-naphthols such as 2,2-dihydroxy-1,1-binaphthyl, 6,6-dibromo-2,2-dihydroxy-1,1-binaphthyl and bis(2-hydroxy-1-naphthyl)methane; combinations of a bis-β-naphthol with a 1,3-dihydroxybenzene derivative (e.g., 2,4-dihydroxybenzophenone, 2,4-dihydroxyacetophenone); 5-pyrazolones such as 3-methyl-1-phenyl-5-pyrazolone; reductones such as dimethylaminohexose reductone, anhydrodihydroaminohexose reductone and anhydrodihydropiperidonehexose reductone; sulfonamidophenol reducing agents such as 2,6-dichloro-4-benzenesulfonamidophenol and p-benzenesulfonamidophenol; 2-phenylindane-1,3-diones; chromans such as 2,2-dimethyl-7-t-butyl-6-hydroxychroman; 1,4-dihydropyridines such as 2,6-dimethoxy-3,5-dicarboethoxy-1,4-dihydropyridine; bisphenols such as bis(2-hydroxy-3-t-butyl-5-methylphenyl)methane, 2,2-bis(4-hydroxy-3-methylphenyl) propane, 4,4-ethylidene-bis(2-t-butyl-6-methylphenol), 1,1-bis(2-hydroxy-3,5-dimethylphenyl)-3,5,5-trimethylhexane and 2,2-bis (3,5-dimethyl-4-hydroxyphenyl)propane; ascorbic acid derivatives such as 1-ascorbyl palmitate and ascorbyl stearate; aldehydes and ketones such as benzyl and biacetyl; 3-pyrazolidone and a certain kind of indane-1,3-diones; and chromanols such as tocopherol. Particularly preferred reducing agents are bisphenols and chromanols.

The reducing agent of the present invention may be added in any form of a solution, powder and a solid microparticle dispersion. The solid microparticle dispersion is performed using a known pulverizing means (e.g., ball mill, vibrating ball mill, sand mill, colloid mill, jet mill, roller mill). At the time of solid microparticle dispersion, a dispersion aid may also be used.

When an additive known as a "color toner" capable of improving the image is added, the optical density increases in some cases. Also, the color toner is advantageous in forming a black silver image depending on the case. The color toner is preferably contained on the surface having an image-forming layer in an amount of from 0.1 to 50% by mol, more preferably from 0.5 to 20% by mol, per mol of silver. The color toner may be a so-called precursor which is derived to effectively exhibit the function only at the time of development.

For the heat-developable light-sensitive material using an organic silver salt, color toners over a wide range are known and these are disclosed in JP-A-46-6077, JP-A-47-10282, JP-A-49-5019, JP-A-49-5020, JP-A-49-91215, JP-A-49-91215, JP-A-50-2524, JP-A-50-32927, JP-A-50-67132, JP-A-50-67641, JP-A-50-114217, JP-A-51-3223, JP-A-51-27923, JP-A-52-14788, JP-A-52-99813, JP-A-53-1020, JP-A-53-76020, JP-A-54-156524, JP-A-54-156525, JP-A-61-183642, JP-A-4-56848, JP-B-49-10727, JP-B-54-20333, U.S. Pat. Nos. 3,080,254, 3,446,648, 3,782,941, 4,123,282 and 4,510,236, British Patent No. 1,380,795 and Belgian Patent No. 841910. Examples of the color toner include phthalimide and N-hydroxyphthalimide; succinimide, pyrazolin-5-ones and cyclic imides such as quinazolinone, 3-phenyl-2-pyrazolin-5-one, 1-phenylurazole, quinazoline and 2,4-thiazolidinedione; naphthalimides such as N-hydroxy-1,8-naphthalimide; cobalt complexes such as cobalt hexaminetrifluoroacetate; mercaptanes such as 3-mercapto-1,2,4-triazole, 2,4-dimercaptopyrimidine, 3-mercapto-4,5-diphenyl-1,2,4-triazole and 2,5-dimercapto-1,3,4-thiadiazole; N-(aminomethyl)aryldicarboxyimides such as N,N-(dimethylaminomethyl)phthalimide and N,N-(dimethylaminomethyl) naphthalene-2,3-dicarboxyimide; blocked pyrazoles, isothiuronium derivatives and a certain kind of photobleaching agents, such as N,N'-hexamethylenebis(1-carbamoyl-3,5-dimethylpyrazole), 1,8-(3,6-diazaoctane)bis(isothiuroniumtrifluoroacetate) and 2-(tribromomethylsulfonyl)benzothiazole; 3-ethyl-5-[(3-ethyl-2-benzothiazolinylidene)-1-methylethylidene]-2-thio-2,4-oxazolidinedione; phthalazinone, phthalazinone derivatives and metal salts thereof, such as 4-(1-naphthyl) phthalazinone, 6-chlorophthalazinone, 5,7-dimethyloxyphthalazinone or 2,3-dihydro-1,4-phthalazinedione; combinations of phthalazinone with a phthalic acid derivative (e.g., phthalic acid, 4-methylphthalic acid, 4-nitrophthalic acid, tetrachlorophthalic acid anhydride); phthalazine, phthalazine derivatives (e.g., 4-(1-naphthyl)phthalazine, 6-chlorophthalazinone, 5,7-dimethoxyphthalazine, 2,3-dihydrophthalazine) and metal salts thereof; combinations of a phthalazine and a phthalic acid derivative (e.g., phthalic acid, 4-methylphthalic acid, 4-nitrophthalic acid, tetrachlorophthalic acid anhydride), quinazolinedione, benzoxazine and naphthoxazine derivatives; rhodium complexes which function not only as a color toner but also as a halide ion source for the formation of silver halide at the site, such as ammonium hexachlororhodate(III), rhodium bromide, rhodium nitrate and potassium hexachlororhodate(III); inorganic peroxides and persulfates such as ammonium disulfide peroxide and hydrogen peroxide; benzoxazine-2,4-diones such as 1,3-benzoxazin-2,4-dione, 8-methyl-1,3-benzoxazin-2,4-dione, and 6-nitro-1,3-benzoxazin-2,4-dione; pyrimidines and asymmetric triazines such as 2,4-dihydroxpyrimidine and 2-hydroxy-4-aminopyrimidine; and azauracil and tetraazapentalene derivatives such as 3,6-dimercapto-1,4-diphenyl-1H,4H-2,3a,5,6a-tetraazapentalene and 1,4-di(o-chlorophenyl)-3,6-dimercapto-1H,4H-2,3a,5,6a-tetraazapentalene.

The color toner of the present invention may be added in any form of a solution, powder, solid microparticle dispersion and the like. The solid fine particle dispersion is performed using a known pulverization means (e.g., ball mill, vibrating ball mill, sand mill, colloid mill, jet mill, roller mill). At the time of solid microparticle dispersion, a dispersion aid may also be used.

The heat-developable image-recording material of the present invention preferably contains an ultrahigh contrast agent, preferably in the image-forming layer and/or another layer adjacent thereto so as to obtain a high-contrast image. Preferred examples of the ultrahigh contrast agent for use in the present invention include substituted alkene derivatives represented by the formula (1), substituted isooxazole derivatives represented by the formula (2), specific acetal compounds represented by the formula (3) and hydrazine derivatives.

The substituted alkene derivatives represented by the formula (1), substituted isooxazole derivatives represented by the formula (2), specific acetal compounds represented by the formula (3) for use in the present invention will be explained below.

(1)

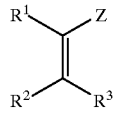

(2)

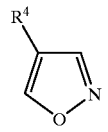

(3)

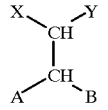

In the general formula (1), $R^1$, $R^2$ and $R^3$each independently represents a hydrogen atom or a substituent, Z represents an electron withdrawing group or a silyl group, and $R^1$ and Z, $R^2$ and $R^3$, $R^1$ and $R^2$, or $R^3$ and Z may be combined with each other to form a ring structure; in the formula (2), $R_4$ represents a substituent; and in the formula (3), X and Y each independently represents a hydrogen atom or a substituent, A and B each independently represents an alkoxy group, an alkylthio group, an alkylamino group, an aryloxy group, an arylthio group, an anilino group, a heterocyclic oxy group, a heterocyclic thio group or a heterocyclic amino group, and X and Y, or A and B may be combined with each other to form a ring structure.

The compound represented by the formula (1) is described in detail below.

In the formula (1), $R^1$, $R^2$ and $R^3$ each independently represents a hydrogen atom or a substituent, and Z represents an electron withdrawing group or a silyl group. In the formula (1), $R^1$ and Z, $R^2$ and $R^3$, $R^1$ and $R^2$, or $R^3$ and Z may be combined with each other to form a ring structure.

When $R^1$, $R^2$ or $R^3$ represents a substituent, examples of the substituent include a halogen atom (e.g., fluorine, chlorine, bromide, iodine), an alkyl group (including an aralkyl group, a cycloalkyl group and active methine group), an alkenyl group, an alkynyl group, an aryl group, a heterocyclic group (including N-substituted nitrogen-containing heterocyclic group), a quaternized nitrogen-containing heterocyclic group (e.g., pyridinio group), an acyl group, an alkoxycarbonyl group, an aryloxycarbonyl group, a carbamoyl group, a carboxy group or a salt thereof, an imino group, an imino group substituted by N atom, a thiocarbonyl group, a sulfonylcarbamoyl group, an acylcarbamoyl group, a sulfamoylcarbamoyl group, a carbazoyl group, an oxalyl group, an oxamoyl group, a cyano group, a thiocarbamoyl group, a hydroxy group (or a salt thereof), an alkoxy group (including a group containing an ethyleneoxy group or propyleneoxy group repeating unit), an aryloxy group, a heterocyclic oxy group, an acyloxy group, an (alkoxy or aryloxy) carbonyloxy group, a carbamoyloxy group, a sulfonyloxy group, an amino group, an (alkyl, aryl or heterocyclic)amino group, an acylamino group, a sulfonamido group, a ureido group, a thioureido group, an imido group, an (alkoxy or aryloxy)carbonylamino group, a sulfamoylamino group, a semicarbazide group, a thiosemicarbazide group, a hydrazino group, a quaternary ammonio group, an oxamoylamino group, an (alkyl or aryl) sulfonylureido group, an acylureido group, an acylsulfamoylamino group, a nitro group, a mercapto group or a salt thereof, an (alkyl, aryl or heterocyclic)thio group, an acylthio group, an (alkyl or aryl)sulfonyl group, an (alkyl or aryl) sulfinyl group, a sulfo group or a salt thereof, a sulfamoyl group, an acylsulfamoyl group, a sulfonylsulfamoyl group or a salt thereof, a phosphoryl group, a group containing phosphoramide or phosphoric acid ester structure, a silyl group and a stannyl group.

These substituents each may further be substituted by any of the above-described substituents.

The electron withdrawing group represented by Z in the formula (1) is a substituent having a Hammett's substituent constant $\sigma p$ of a positive value, and specific examples thereof include a cyano group, an alkoxycarbonyl group, an aryloxycarbonyl group, a carbamoyl group, an imino group, an imino group substituted by N atom, a thiocarbonyl group, a sulfamoyl group, an alkylsulfonyl group, an arylsulfonyl group, a nitro group, a halogen atom, a perfluoroalkyl group, a perfluoroalkanamido group, a sulfonamido group, an acyl group, a formyl group, a phosphoryl group, a carboxy group (or a salt thereof), a sulfo group (or a salt thereof), a heterocyclic group, an alkenyl group, an alkynyl group, an acyloxy group, an acylthio group, a sulfonyloxy group and an aryl group substituted by the above-described electron withdrawing group. The heterocyclic group is a saturated or unsaturated heterocyclic group and examples thereof include a pyridyl group, a quinolyl group, a pyrazinyl group, a quinoxalinyl group, a benzotriazolyl group, an imidazolyl group, a benzimidazolyl group, a hydantoin-1-yl group, a succinimido group and a phthalimido group.

The electron withdrawing group represented by Z in the formula (1) may further have a substituent and examples of the substituent include those described for the substituent which the substituent represented by $R^1$, $R^2$ or $R^3$ in the formula (1) may have.

In the formula (1), $R^1$ and Z, $R^2$ and $R^3$, $R^1$ and $R^2$, or $R^3$ and Z may be combined with each other to form a ring structure. The ring structure formed is a non-aromatic carbocyclic ring or a non-aromatic heterocyclic ring.

The preferred range of the compound represented by the formula (1) is described below.

The silyl group represented by Z in the formula (1) is preferably a trimethylsilyl group, a t-butyldimethylsilyl group, a phenyldimethylsilyl group, a triethylsilyl group, a triisopropylsilyl group or a trimethylsilyldimethylsilyl group.

The electron withdrawing group represented by Z in the formula (1) is preferably a group having a total carbon atom number of from 0 to 30 such as a cyano group, an alkoxycarbonyl group, an aryloxycarbonyl group, a carbamoyl group, a thiocarbonyl group, an imino group, an imino group substituted by N atom, a sulfamoyl group, an alkylsulfonyl group, an arylsulfonyl group, a nitro group, a perfluoroalkyl group, an acyl group, a formyl group, a phosphoryl group, an acyloxy group, an acylthio group or a phenyl group substituted by any electron withdrawing group, more preferably a cyano group, an alkoxycarbonyl group, a carbamoyl group, an imino group, a sulfamoyl group, an alkylsulfonyl group, an arylsulfonyl group, an acyl group, a formyl group, a phosphoryl group, a trifluoromethyl group or a phenyl group substituted by any electron withdrawing group, still more preferably a cyano group, a formyl group, an acyl group, an alkoxycarbonyl group, an imino group or a carbamoyl group.

The group represented by Z in the formula (1) is preferably an electron withdrawing group.

The substituent represented by $R^1$, $R^2$ or $R^3$ in the formula (1) is preferably a group having a total carbon atom number of from 0 to 30 and specific examples of the group include a group having the same meaning as the electron withdrawing group represented by Z in the formula (1), an alkyl group, a hydroxy group (or a salt thereof), a mercapto group (or a salt thereof), an alkoxy group, an aryloxy group, a heterocyclic oxy group, an alkylthio group, an arylthio group, a heterocyclic thio group, an amino group, an alkylamino group, an arylamino group, a heterocyclic amino group, a ureido group, an acylamino group, a sulfonamido group and a substituted or unsubstituted aryl group.

In the formula (1), $R^1$ is preferably an electron withdrawing group, an aryl group, an alkylthio group, an alkoxy group, an acylamino group, a hydrogen atom or a silyl group.

When $R^1$ represents an electron withdrawing group, the electron withdrawing group is preferably a group having a total carbon atom number of from 0 to 30 such as a cyano group, a nitro group, an acyl group, a formyl group, an alkoxycarbonyl group, an aryloxycarbonyl group, a thiocarbonyl group, an imino group, an imino group substituted by N atom, an alkylsulfonyl group, an arylsulfonyl group, a carbamoyl group, a sulfamoyl group, a trifluoromethyl group, a phosphoryl group, a carboxy group (or a salt thereof), a saturated or unsaturated heterocyclic group, more preferably a cyano group, an acyl group, a formyl group, an alkoxycarbonyl group, a carbamoyl group, an imino group, an imino group substituted by N atom, a sulfamoyl group, a carboxy group (or a salt thereof) or a saturated or unsaturated heterocyclic group, still more preferably a cyano group, a formyl group, an acyl group, an alkoxycarbonyl group, a carbamoyl group or a saturated or unsaturated heterocyclic group.

When $R^1$ represents an aryl group, the aryl group is preferably a substituted or unsubstituted phenyl group having a total carbon atom number of from 6 to 30. The substituent may be any substituent but an electron withdrawing substituent is preferred.

In the formula (1), $R^1$ is more preferably an electron withdrawing group or an aryl group.

The substituent represented by $R^2$ or $R^3$ in the formula (1) is preferably a group having the same meaning as the electron withdrawing group represented by Z in the formula (1), an alkyl group, a hydroxy group (or a salt thereof), a mercapto group (or a salt thereof), an alkoxy group, an aryloxy group, a heterocyclic oxy group, an alkylthio group, an arylthio group, a heterocyclic thio group, an amino group, an alkylamino group, an anilino group, a heterocyclic amino group, an acylamino group or a substituted or unsubstituted phenyl group.

In the formula (1), it is more preferred that one of $R^2$ and $R^3$ is a hydrogen atom and the other is a substituent. The substituent is preferably an alkyl group, a hydroxy group (or a salt thereof), a mercapto group (or a salt thereof), an alkoxy group, an aryloxy group, a heterocyclic oxy group, an alkylthio group, an arylthio group, a heterocyclic thio group, an amino group, an alkylamino group, an anilino group, a heterocyclic amino group, an acylamino group (particularly, a perfluoroalkanamido group), a sulfonamido group, a substituted or unsubstituted phenyl group or a heterocyclic group, more preferably a hydroxy group (or a salt thereof), a mercapto group (or a salt thereof), an alkoxy group, an aryloxy group, a heterocyclic oxy group, an alkylthio group, an arylthio group, a heterocyclic thio group or a heterocyclic group, still more preferably a hydroxy group (or a salt thereof), an alkoxy group or a heterocyclic group.

In the formula (1), it is also preferred that Z and $R^1$ or $R^2$ and $R^3$ form a ring structure. The ring structure formed is a non-aromatic carbocyclic ring or a non-aromatic heterocyclic ring, preferably a 5-, 6- or 7-membered ring structure having a total carbon atom number including those of substituents of from 1 to 40, more preferably from 3 to 30.

The compound represented by the formula (1) is more preferably a compound where Z represents a cyano group, a formyl group, an acyl group, an alkoxycarbonyl group, an imino group or a carbamoyl group, $R^1$ represents an electron withdrawing group or an aryl group, and one of $R^2$ and $R^3$ represents a hydrogen atom and the other represents a hydroxy group (or a salt thereof), a mercapto group (or a salt thereof), an alkoxy group, an aryloxy group, a heterocyclic oxy group, an alkylthio group, an arylthio group, a heterocyclic thio group or a heterocyclic group, more preferably a compound where Z and $R^1$ form a non-aromatic 5-, 6- or 7-membered ring structure and one of $R^2$ and $R^3$ represents a hydrogen atom and the other represents a hydroxy group (or a salt thereof), a mercapto group (or a salt thereof), an alkoxy group, an aryloxy group, a heterocyclic oxy group, an alkylthio group, an arylthio group, a heterocyclic thio group or a heterocyclic group. At this time, Z which forms a non-aromatic ring structure together with $R^1$ is preferably an acyl group, a carbamoyl group, an oxycarbonyl group, a thiocarbonyl group or a sulfonyl group and $R^1$ is preferably an acyl group, a carbamoyl group, an oxycarbonyl group, a thiocarbonyl group, a sulfonyl group, an imino group, an imino group substituted by N atom, an acylamino group or a carbonylthio group.

The compound represented by the formula (2) is described below.

In the formula (2), $R^4$ represents a substituent. Examples of the substituent represented by $R^4$ include those described for the substituent represented by $R^1$, $R^2$ or $R^3$ in the formula (1).

The substituent represented by $R^4$ is preferably an electron withdrawing group or an aryl group. When $R^4$ represents an electron withdrawing group, the electron withdrawing group is preferably a group having a total carbon atom number of from 0 to 30 such as a cyano group, a nitro group, an acyl group, a formyl group, an alkoxycarbonyl group, an aryloxycarbonyl group, an alkylsulfonyl group, an arylsulfonyl group, a carbamoyl group, a sulfamoyl group, a trifluoromethyl group, a phosphoryl group, an imino group or a saturated or unsaturated heterocyclic group, more preferably a cyano group, an acyl group, a formyl group, an alkoxycarbonyl group, a carbamoyl group, a sulfamoyl group, an alkylsulfonyl group, an arylsulfonyl group or a heterocyclic group, still more preferably a cyano group, a formyl group, an acyl group, an alkoxycarbonyl group, a carbamoyl group or a heterocyclic group.

When $R^4$ represents an aryl group, the aryl group is preferably a substituted or unsubstituted phenyl group having a total carbon atom number of from 0 to 30. Examples of the substituent include those described for the substituent represented by $R^1$, $R^2$ or $R^3$ in the formula (1).

$R^4$ is more preferably a cyano group, an alkoxycarbonyl group, a carbamoyl group, a heterocyclic group or a substituted or unsubstituted phenyl group, most preferably a cyano group, a heterocyclic group or an alkoxycarbonyl group.

The compound represented by the formula (3) is described in detail below.

In the formula (3), X and Y each independently represents a hydrogen atom or a substituent, and A and B each independently represents an alkoxy group, an alkylthio group, an alkylamino group, an aryloxy group, an arylthio group, an anilino group, a heterocyclic thio group, a heterocyclic oxy group or a heterocyclic amino group, and X and Y or A and B may be combined with each other to form a ring structure.

Examples of the substituent represented by X or Y in the formula (3) include those described for the substituent represented by $R^1$, $R^2$ or $R^3$in the formula (1). Specific examples thereof include an alkyl group (including a perfluoroalkyl group and a trichloromethyl group), an aryl group, a heterocyclic group, a halogen atom, a cyano group, a nitro group, an alkenyl group, an alkynyl group, an acyl group, a formyl group, an alkoxycarbonyl group, an aryloxycarbonyl group, an imino group, an imino group substituted by N atom, a carbamoyl group, a thiocarbonyl group, an acyloxy group, an acylthio group, an acylamino group, an alkylsulfonyl group, an arylsulfonyl group, a sulfamoyl group, a phosphoryl group, a carboxy group (or a salt thereof), a sulfo group (or a salt thereof), a hydroxy group (or a salt thereof), a mercapto group (or a salt thereof), an alkoxy group, an aryloxy group, a heterocyclic oxy group, an alkylthio group, an arylthio group, a heterocyclic thio group, an amino group, an alkylamino group, an anilino group, a heterocyclic amino group and a silyl group.

These groups each may further have a substituent. X and Y may be combined with each other to form a ring structure and the ring structure formed may be either a non-aromatic carbocyclic ring or a non-aromatic heterocyclic ring.

In the formula (3), the substituent represented by X or Y is preferably a substituent having a total carbon number of from 1 to 40, more preferably from 1 to 30, such as a cyano group, an alkoxycarbonyl group, an aryloxycarbonyl group, a carbamoyl group, an imino group, an imino group substituted by N atom, a thiocarbonyl group, a sulfamoyl group, an alkylsulfonyl group, an arylsulfonyl group, a nitro group, a perfluoroalkyl group, an acyl group, a formyl group, a phosphoryl group, an acylamino group, an acyloxy group, an acylthio group, a heterocyclic group, an alkylthio group, an alkoxy group or an aryl group.

In the formula (3), X and Y each is more preferably a cyano group, a nitro group, an alkoxycarbonyl group, a carbamoyl group, an acyl group, a formyl group, an acylthio group, an acylamino group, a thiocarbonyl group, a sulfamoyl group, an alkylsulfonyl group, an arylsulfonyl group, an imino group, an imino group substituted by N atom, a phosphoryl group, a trifluoromethyl group, a heterocyclic group or a substituted phenyl group, still more preferably a cyano group, an alkoxycarbonyl group, a carbamoyl group, an alkylsulfonyl group, an arylsulfonyl group, an acyl group, an acylthio group, an acylamino group, a thiocarbonyl group, a formyl group, an amino group, an imino group substituted by N atom, a heterocyclic group or a phenyl group substituted by any electron withdrawing group.

X and Y are also preferably combined with each other to form a non-aromatic carbocyclic ring or a non-aromatic heterocyclic ring. The ring structure formed is preferably a 5-, 6- or 7-membered ring having a total carbon atom number of from 1 to 40, more preferably from 3 to 30. X and Y for forming a ring structure each is preferably an acyl group, a carbamoyl group, an oxycarbonyl group, a thiocarbonyl group, a sulfonyl group, an imino group, an imino group substituted by N atom, an acylamino group or a carbonylthio group.

In the formula (3), A and B each independently represents an alkoxy group, an alkylthio group, an alkylamino group, an aryloxy group, an arylthio group, an anilino group, a heterocyclic thio group, a heterocyclic oxy group or a heterocyclic amino group, which may be combined with each other to form a ring structure. Those represented by A and B in the formula (3) are preferably a group having a total carbon atom number of from 1 to 40, more preferably from 1 to 30, and the group may further have a substituent.

In the formula (3), A and B are more preferably combined with each other to form a ring structure. The ring structure formed is preferably a 5-, 6- or 7-membered non-aromatic heterocyclic ring having a total carbon atom number of from 1 to 40, more preferably from 3 to 30. Examples of the linked structure (-A-B-) formed by A and B include —O—$(CH_2)_2$—O—, —O—$(CH_2)_3$—O—, —S—$(CH_2)_2$—S—, —S—$(CH_2)_3$—S—, —S—Ph—S—, —N$(CH_3)$—$(CH_2)_2$—O—, —N $(CH_3)$—$(CH_2)_2$—S—, —O—$(CH_2)_2$—S—, —O—$(CH_2)_3$—S—, —N$(CH_3)$6—Ph—O—, —N$(CH_3)$—Ph—S—and —N (Ph)—$(CH_2)$2—S—.

Into the compound represented by the formula (1), (2) or (3) for use in the present invention, an adsorptive group capable of adsorbing to silver halide may be integrated. Examples of the adsorptive group include the groups described in U.S. Pat. Nos. 4,385,108 and 4,459,347, JP-A-59-195233, JP-A-59-200231, JP-A-59-201045, JP-A-59-201046, JP-A-59-201047, JP-A-59-201048, JP-A-59-201049, JP-A-61-170733, JP-A-61-270744, JP-A-62-948, JP-A-63-234244, JP-A-63-234245 and JP-A-63-234246, such as an alkylthio group, an arylthio group, a thiourea group, a thioamide group, a mercaptoheterocyclic group and a triazole group. The adsorptive group to silver halide maybe formed into a precursor. Examples of the precursor include the groups described in JP-A-2-285344.

Into the compound represented by the formula (1), (2) or (3) for use in the present invention, a ballast group or polymer commonly used in immobile photographic additives such as a coupler may be integrated, preferably a ballast group is incorporated. The ballast group is a group having 8 or more carbon atoms and being relatively inactive to the photographic properties. Examples of the ballast group include an alkyl group, an aralkyl group, an alkoxy group, a phenyl group, an alkylphenyl group, a phenoxy group and an alkylphenoxy group. Examples of the polymer include those described in JP-A-1-100530.

The compound represented by the formula (1), (2) or (3) for use in the present invention may contain a cationic group (specifically, a group containing a quaternary ammonio group or a nitrogen-containing heterocyclic group containing a quaternized nitrogen atom), a group containing an ethyleneoxy group or a propyleneoxy group as a repeating unit, an (alkyl, aryl or heterocyclic) thio group, or a dissociative group capable of dissociation by a base (e.g., carboxy group, sulfo group, acylsulfamoyl group, carbamoylsulfamoyl group), preferably a group containing an ethyleneoxy group or a propyleneoxy group as a repeating unit, or an (alkyl, aryl or heterocyclic)thio group. Specific examples of these groups include the compounds described in JP-A-7-234471, JP-A-5-333466, JP-A-6-19032, JP-A-6-19031, JP-A-5-45761, U.S. Pat. Nos. 4,994,365 and 4,988,604, JP-A-3-259240, JP-A-7-5610, JP-A-7-244348 and German Patent No. 4,006,032.

Specific examples of the compounds represented by the formulae (1) to (3) for use in the present invention are shown below. However, the present invention is by no means limited to the following compounds.

C-1

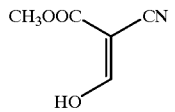

C-2

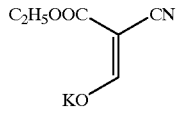

C-3

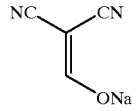

C-4

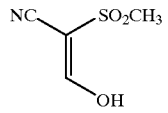

C-5

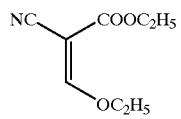

-continued
C-6
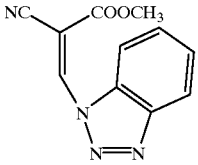
C-7
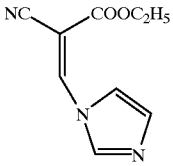
C-8
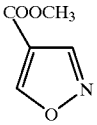
C-9
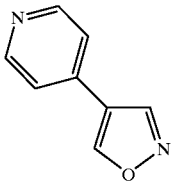
C-10
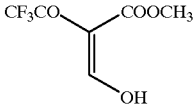
C-11
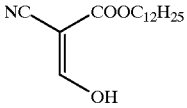
C-12
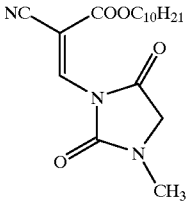
C-13
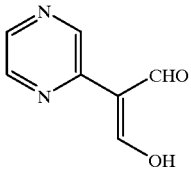
C-14
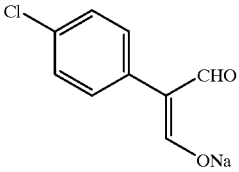
-continued
C-15
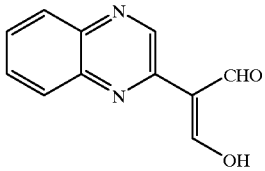
C-16
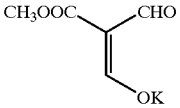
C-17
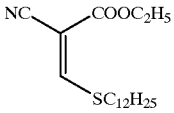
C-18
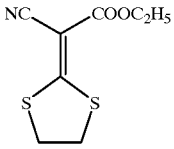
C-19
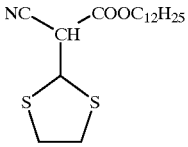
C-20
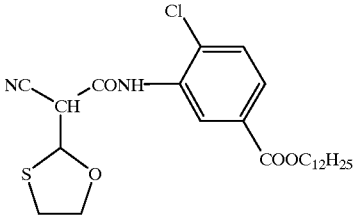
C-21
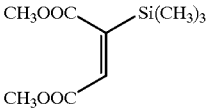
C-22
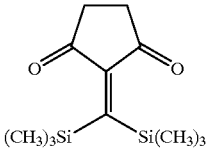
C-23
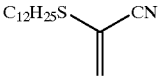
C-24
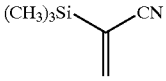

-continued
C-25
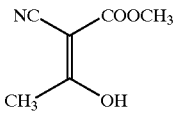
C-26
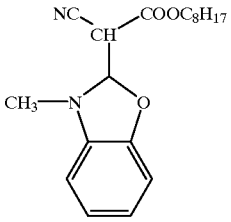
C-27
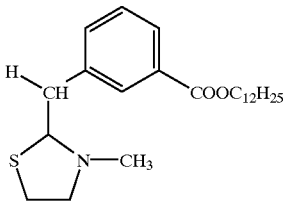
C-28
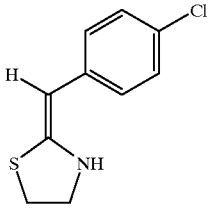
C-29
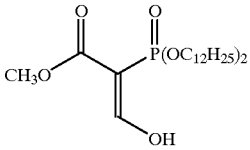
C-30
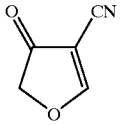
C-31
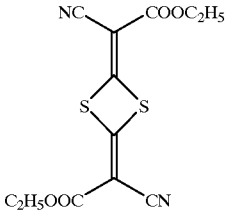
C-32
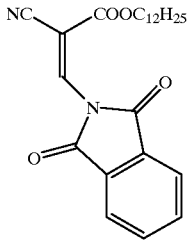
-continued
C-33
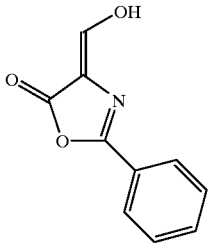
C-34
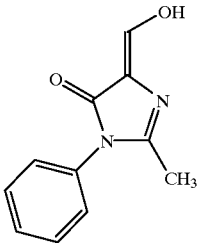
C-35
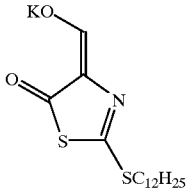
C-36
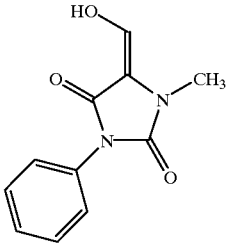
C-37
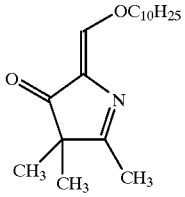
C-38
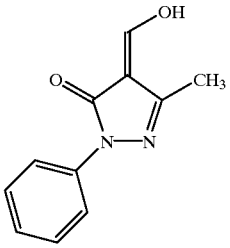

-continued
C-39
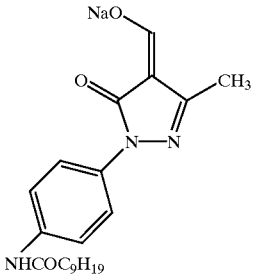
C-40
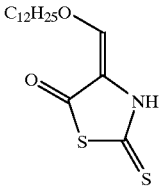
C-41
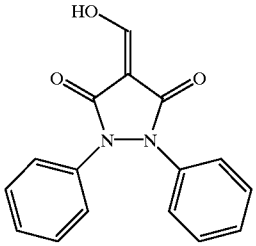
C-42
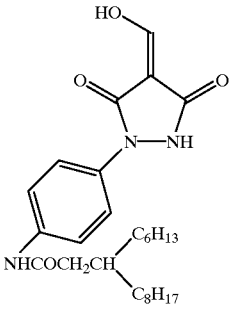
C-43
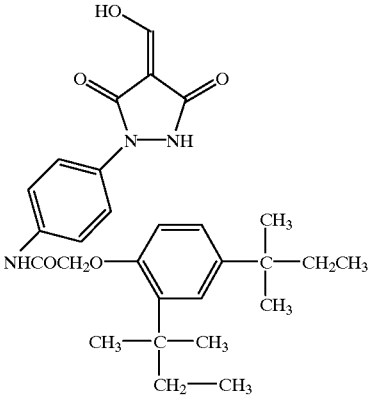
-continued
C-44
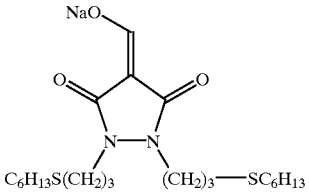
C-45
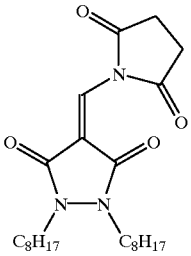
C-46
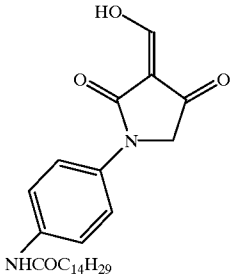
C-47
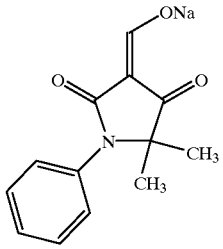
C-48
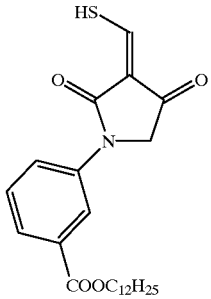
C-49
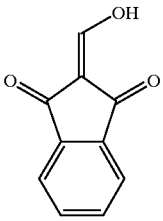

-continued
C-50
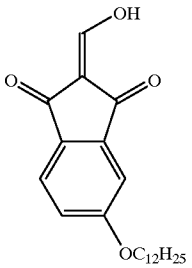
C-51
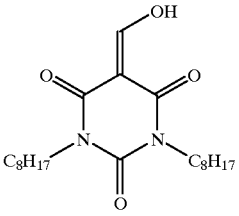
C-52
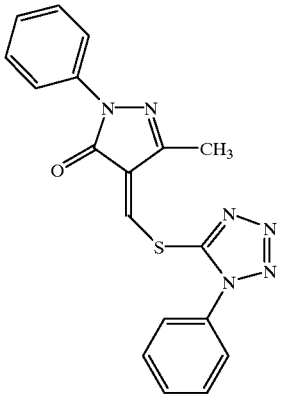
C-53
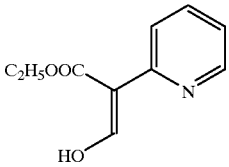
C-54
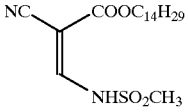
C-55
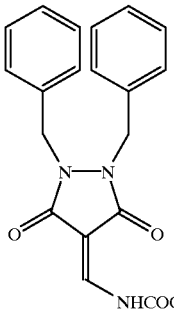
-continued
C-56
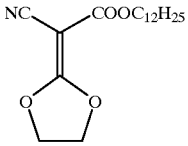
C-57
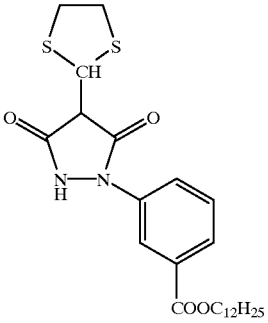
C-58
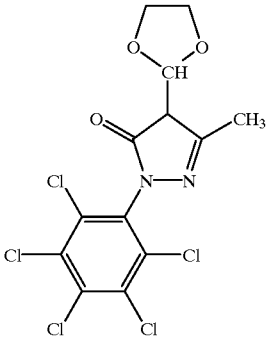
C-59
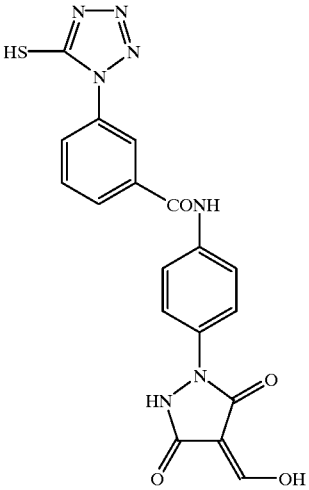
C-60
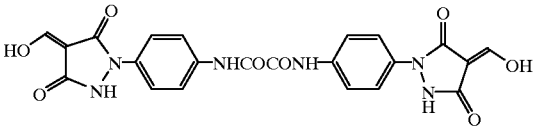
The compounds represented by the formulae (1) to (3) for use in the present invention each may be used after dissolving it in water or an appropriate organic solvent such as an alcohol (e.g., methanol, ethanol, propanol, fluorinated alcohol), a ketone (e.g., acetone, methyl ethyl ketone), dimethylformamide, dimethylsulfoxide or methyl cellosolve.

Also, the compounds represented by the formulae (1) to (3) for use in the present invention each may be dissolved by an already well-known emulsification dispersion method using an oil such as dibutyl phthalate, tricresyl phosphate, glyceryl triacetate or diethyl phthalate, or an auxiliary solvent such as ethyl acetate or cyclohexanone, and mechanically formed into an emulsified dispersion before use. Furthermore, the compounds represented by the formulae (1) to (3) each may be used after dispersing the powder of the compound in an appropriate solvent such as water by a method known as a solid dispersion method, using a ball mill, a colloid mill or an ultrasonic wave.

The compounds represented by the formulae (1) to (3) for use in the present invention each may be added to a layer in the image-recording layer side on the support, namely, an image-forming layer, or any other layers; however, the compounds each is preferably added to an image-forming layer or a layer adjacent thereto.

The addition amount of the compound represented by the formula (1), (2) or (3) for use in the present invention is preferably from $1\times10^{-6}$ to 1 mol, more preferably from $1\times10^{-5}$ to $5\times10^{-1}$ mol, most preferably from $2\times10^{-5}$ to $2\times10^{-1}$ mol, per mol of silver.

The compounds represented by formulae (1) to (3) can be easily synthesized according to known methods and may be synthesized by referring, for example, to U.S. Pat. Nos. 5,545,515, 5,635,339 and 5,654,130, International Patent Publication WO97/34196 or Japanese Patent Application Nos. 9-354107, 9-309813 and 9-272002.

The compounds represented by the formulae (1) to (3) may be used individually or in combination of two or more thereof. In addition to these compounds, a compound described in U.S. Pat. Nos. 5,545,515, 5,635,339 and 5,654,130, International Patent Publication WO97/34196, U.S. Pat. No. 5,686,228 or Japanese Patent Application Nos. 9-228881, 9-273935, 9-354107, 9-309813, 9-296174, 9-282564, 9-272002, 9-272003 and 9-332388 may also be used in combination. They can also be used in combination with such hydrazine derivatives as mentioned below.

The hydrazine derivative for use in the present invention as an ultrahigh contrast agent is preferably a compound represented by the following general formula (H):

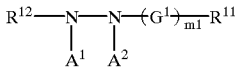

(H)

In the formula, $R^{12}$ represents an aliphatic group, an aromatic group or a heterocyclic group, $R^{11}$represents a hydrogen atom or a block group, $G^1$ represents —CO—, —COCO—, —C(=S)—, —$SO_2$—, —SO—, —PO($R^{13}$)— (wherein $R^{13}$ is a group selected from the groups within the range defined for $R^{11}$, and $R^3$ may be different from $R^{11}$), or an iminomethylene group, $A^1$ and $A^2$ both represents a hydrogen atom or one represents a hydrogen atom and the other represents a substituted or unsubstituted alkylsulfonyl group, a substituted or unsubstituted arylsulfonyl group, or a substituted or unsubstituted acyl group, and ml represents 0 or 1 and when $m^1$ is 0, $R^1$ represents an aliphatic group, an aromatic group or a heterocyclic group.

In the formula (H), the aliphatic group represented by $R^{12}$ is preferably a substituted or unsubstituted, linear, branched or cyclic alkyl group, an alkenyl group or an alkynyl group having from 1 to 30 carbon atoms.

In the formula (H), the aromatic group represented by $R^{12}$ is a monocyclic or condensed cyclic aryl group, and examples thereof include a phenyl group and a naphthalene group. The heterocyclic group represented by $R^{12}$ is a monocyclic or condensed cyclic, saturated or unsaturated, aromatic or non-aromatic heterocyclic group, and examples thereof include a pyridine ring, a pyrimidine ring, an imidazole ring, a pyrazole ring, a quinoline ring, an isoquinoline ring, a benzimidazole ring, a thiazole ring, a benzothiazole ring, a piperidine ring, a triazine ring, a morpholino ring, a piperidine ring and a piperazine ring.

$R^{12}$ is preferably an aryl group or an alkyl group.

$R^{12}$ may be substituted and representative examples of the substituent include a halogen atom (e.g., fluorine, chlorine, bromine, iodine), an alkyl group (including an aralkyl group, a cycloalkyl group and an active methine group), an alkenyl group, an alkynyl group, an aryl group, a heterocyclic group, a heterocyclic group containing a quaternized nitrogen atom (e.g., pyridinio group), an acyl group, an alkoxycarbonyl group, an aryloxycarbonyl group, a carbamoyl group, a carboxy group or a salt thereof, a sulfonylcarbamoyl group, an acylcarbamoyl group, a sulfamoylcarbamoyl group, a carbazoyl group, an oxalyl group, an oxamoyl group, a cyano group, a thiocarbamoyl group, a hydroxy group, an alkoxy group (including a group containing an ethyleneoxy group or a propylene oxy group repeating unit), an aryloxy group, a heterocyclic oxy group, an acyloxy group, an (alkoxy or aryloxy)carbonyloxy group, a carbamoyloxy group, a sulfonyloxy group, an amino group, an (alkyl, aryl or heterocyclic) amino group, a N-substituted nitrogen-containing heterocyclic group, an acylamino group, a sulfonamido group, a ureido group, a thioureido group, an imido group, an (alkoxy or aryloxy)carbonylamino group, a sulfamoylamino group, a semicarbazide group, thiosemicarbazide group, a hydrazino group, a quaternary ammonio group, an oxamoylamino group, an (alkyl or aryl) sulfonylureido group, an acylureido group, an acylsulfamoylamino group, a nitro group, a mercapto group, an (alkyl, aryl or heterocyclic)thio group, an (alkyl or aryl) sulfonyl group, an (alkyl or aryl)sulfinyl group, a sulfo group or a salt thereof, a sulfamoyl group, an acylsulfamoyl group, a sulfonylsulfamoyl group or a salt thereof, and a group containing a phosphoramido or phosphoric acid ester structure.

These substituents each may further be substituted by any of the above-described substituents.

When $R^{12}$ represents an aromatic group or a heterocyclic group, the substituent of $R^{12}$ is preferably an alkyl group (including an active methylene group), an aralkyl group, a heterocyclic group, a substituted amino group, an acylamino group, a sulfonamido group, a ureido group, a sulfamoylamino group, an imido group, a thioureido group, a phosphoramido group, a hydroxy group, an alkoxy group, an aryloxy group, an acyloxy group, an acyl group, an alkoxycarbonyl group, an aryloxycarbonyl group, a carbamoyl group, a carboxy group (including a salt thereof), an (alkyl, aryl or heterocyclic) thio group, a sulfo group (including a salt thereof), a sulfamoyl group, a halogen atom, a cyano group or a nitro group.

When $R^{12}$ represents an aliphatic group, the substituent is preferably an alkyl group, an aryl group, a heterocyclic group, an amino group, anacylamino group, a sulfonamido group, a ureido group, a sulfamoylamino group, an imido group, a thioureido group, a phosphoramido group, a hydroxy group, an alkoxy group, an aryloxy group, an acyloxy group, an acyl group, an alkoxycarbonyl group, an aryloxycarbonyl group, a carbamoyl group, a carboxy group (including a salt thereof), an (alkyl, aryl or heterocyclic) thio group, a sulfo group (including a salt thereof), a sulfamoyl group, a halogen atom, a cyano group or a nitro group.

In the formula (H), $R^{11}$ represents a hydrogen atom or a block group. The block group is specifically an aliphatic group (specifically, an alkyl group, an alkenyl group or an alkynyl group), an aromatic group (e.g., a monocyclic or condensed cyclic aryl group), a heterocyclic group, an alkoxy group, an aryloxy group, an amino group or a hydrazino group.

The alkyl group represented by $R^{11}$ is preferably a substituted or unsubstituted alkyl group having from 1 to 10 carbon atoms, and examples thereof include a methyl group, an ethyl group, a trifluoromethyl group, a difluoromethyl group, a 2-carboxytetrafluoroethyl group, a pyridiniomethyl group, a difluoromethoxymethyl group, a difluorocarboxymethyl group, a 3-hydroxypropyl group, a 3-methanesulfonamidopropyl group, a phenylsulfonylmethyl group, an o-hydroxybenzyl group, a methoxymethyl group, a phenoxymethyl group, a 4-ethylphenoxymethyl group, a phenylthiomethyl group, a t-butyl group, a dicyanomethyl group, a diphenylmethyl group, a triphenylmethyl group, a methoxycarbonyldiphenylmethyl group, a cyanodiphenylmethyl group and a methylthiodiphenylmethyl group. The alkenyl group is preferably an alkenyl group having from 1 to 10 carbon atoms, and examples thereof include a vinyl group, a 2-ethoxycarbonylvinyl group and a 2-trifluoro-2-methoxycarbonylvinyl group. The alkynyl group is an alkynyl group having from 1 to 10 carbon atoms, and examples thereof include an ethynyl group and a 2-methoxycarbonylethynyl group. The aryl group is preferably a monocyclic or condensed cyclic aryl group, more preferably an aryl group containing a benzene ring, and examples thereof include a phenyl group, a perfluorophenyl group, a 3,5-dichlorophenyl group, a 2-methanesulfonamidophenyl group, a 2-carbamoylphenyl group, a 4,5-dicyanophenyl group, a 2-hydroxymethylphenyl group, 2,6-dichloro-4-cyanophenyl group and 2-chloro-5-octylsulfamoylphenyl group.

The heterocyclic group is preferably a 5- or 6-membered, saturated or unsaturated, monocyclic or condensed heterocyclic group containing at least one nitrogen, oxygen or sulfur atom, and examples thereof include a morpholino group, a piperidino group (N-substituted), an imidazolyl group, an indazolyl group (e.g., 4-nitroindazolyl group), a pyrazolyl group, a triazolyl group, a benzoimidazolyl group, a tetrazolyl group, a pyridyl group, a pyridinio group (e.g., N-methyl-3-pyridinio group), a quinolinio group and a quinolyl group.

The alkoxy group is preferably an alkoxy group having from 1 to 8 carbon atoms, and examples thereof include a methoxy group, a 2-hydroxyethoxy group, a benzyloxy group and a t-butoxy group. The aryloxy group is preferably a substituted or unsubstituted phenoxy group, and the amino group is preferably an unsubstituted amino group, an alkylamino group having from 1 to 10 carbon atoms, an arylamino group or a saturated or unsaturated heterocyclic amino group (including a nitrogen-containing heterocyclic amino group containing a quaternized nitrogen atom). Examples of the amino group include 2,2,6,6-tetramethylpiperidin-4-ylamino group, a propylamino group, a 2-hydroxyethylamino group, an anilino group, an o-hydroxyanilino group, a 5-benzotriazolylamino group and a N-benzyl-3-pyridinioamino group. The hydrazino group is preferably a substituted or unsubstituted hydrazino group or a substituted or unsubstituted phenylhydrazino group (e.g., 4-benzenesulfonamidophenylhydrazino group).

The group represented by $R^{1}$" may be substituted, and examples of the substituent include those described as the substituent of $R^{12}$.

In the formula (H), $R^{11}$ may be one which cleaves the $G^1$-$R^{11}$ moiety from the residual molecule and causes a cyclization reaction to form a cyclic structure containing the atoms in the -$G^1$-$R^{11}$ moiety, and examples thereof include those described in JP-A-63-29751.

Into the hydrazine derivative represented by the formula (H), an adsorptive group capable of adsorbing to silver halide may be integrated. Examples of the adsorptive group include the groups described in U.S. Pat. Nos. 4,385,108 and 4,459,347, JP-A-59-195233, JP-A-59-200231, JP-A-59-201045, JP-A-59-201046, JP-A-59-201047, JP-A-59-201048, JP-A-59-201049, JP-A-61-170733, JP-A-61-270744, JP-A-62-948, JP-A-63-234244, JP-A-63-234245 and JP-A-63-234246, such as an alkylthio group, an arylthio group, a thiourea group, a thioamide group, a mercaptoheterocyclic group and a triazole group. The adsorptive group to silver halide may be formed into a precursor. Examples of the precursor include the groups described in JP-A-2-285344.

In the formula (H), $R^{11}$ or $R^{12}$ may be one into which a ballast group or polymer commonly used in immobile photographic additives such as a coupler maybe integrated. The ballast group is a group having 8 or more carbon atoms and being relatively inactive to the photographic properties. Examples of the ballast group include an alkyl group, an aralkyl group, an alkoxy group, a phenyl group, an alkylphenyl group, a phenoxy group and an alkylphenoxy group. Examples of the polymer include those described in JP-A-1-100530.

In the formula (H), $R^1$ or $R^2$ may contain a plurality of hydrazino groups as the substituent. At this time, the compound represented by the formula (H) is a polymer product with respect to the hydrazino group, and specific examples thereof include the compounds described in JP-A-64-86134, JP-A-4-16938, JP-A-5-197091, WO95-32452, WO95-32453, Japanese Patent Application Nos. 7-351132, 7-351269, 7-351168, 7-351287 and 9-351279.

In the formula (H), $R^{11}$ or $R^{12}$ may contain a cationic group (specifically, a group containing a quaternary ammonio group or a nitrogen-containing heterocyclic group containing a quaternized nitrogen atom), a group containing an ethyleneoxy group or a propyleneoxy group as a repeating unit, an (alkyl, aryl or heterocyclic) thio group, or a dissociative group capable of dissociation by a base (e.g., carboxy group, sulfo group, acylsulfamoyl group, carbamoylsulfamoyl group). Examples of the compound containing such a group include the compounds described in JP-A-7-234471, JP-A-5-333466, JP-A-6-19032, JP-A-6-19031, JP-A-5-45761, U.S. Pat. Nos. 4,994,365 and 4,988,604, JP-A-3-259240, JP-A-7-5610, JP-A-7-244348 and German Patent No. 4,006,032.

In the formula (H), $A^1$ and $A^2$ each represents a hydrogen atom, an alkyl- or arylsulfonyl group having 20 or less carbon atoms (preferably a phenylsulfonyl group or a phenylsulfonyl group substituted such that the sum of Hammett's substituent constants is −0.5 or more), an acyl group having 20 or less carbon atoms (preferably a benzoyl group, a benzoyl group substituted such that the sum of Hammett's substituent constants is −0.5 or more, or a linear, branched or cyclic, substituted or unsubstituted aliphatic acyl group (examples of the substituent include a halogen atom, an ether group, a sulfonamido group, a carbonamido group, a hydroxy group, a carboxy group and a sulfo group)).

$A^1$ and $A^2$ each is most preferably a hydrogen atom.

A particularly preferred embodiment of the hydrazine derivative for use in the present invention is described below.

$R^{12}$ is preferably a phenyl group or a substituted alkyl group having from 1 to 3 carbon atoms.

When $R^{12}$ represents a phenyl group, the substituent therefor is preferably a nitro group, an alkoxy group, an alkyl group, an acylamino group, a ureido group, a sulfonamido group, a thioureido group, a carbamoyl group, a sulfamoyl group, a carboxy group (or a salt thereof), a sulfo group (or a salt thereof), an alkoxycarbonyl group or a chlorine atom.

When $R^{12}$ represents a substituted phenyl group, the substituent is preferably substituted directly or through a linking group by at least one of a ballast group, an adsorptive group to silver halide, a group containing a quaternary ammonio group, a nitrogen-containing heterocyclic group containing a quaternized nitrogen, a group containing an ethyleneoxy group as a repeating unit, an (alkyl, aryl or heterocyclic) thio group, a nitro group, an alkoxy group, an acylamino group, a sulfonamido group, a dissociative group (e.g., carboxy group, sulfo group, acylsulfamoyl group, carbamoylsulfamoyl group) and a hydrazino group capable of forming a polymer product (a group represented by $-NHNH-G^1-R^{11}$).

When $R^{12}$ represents a substituted alkyl group having from 1 to 3 carbon atoms, $R^{12}$ is more preferably a substituted methyl group, more preferably a disubstituted or trisubstituted methyl group, and the substituent therefor is preferably a methyl group, a phenyl group, a cyano group, an (alkyl, aryl or heterocyclic)thio group, an alkoxy group, an aryloxy group, a chlorine atom, a heterocyclic group, an alkoxycarbonyl group, an aryloxycarbonyl group, a carbamoyl group, a sulfamoyl group, an amino group, an acylamino group or a sulfonamido group, more preferably a substituted or unsubstituted phenyl group.

When $R^{12}$ represents a substituted methyl group, $R^{12}$ is preferably a t-butyl group, a dicyanomethyl group, a dicyanophenylmethyl group, a triphenylmethyl group (trityl group), a diphenylmethyl group, a methoxycarbonyldiphenylmethyl group, a cyanodiphenylmethyl group, a methylthiodiphenylmethyl group or a cyclopropyldiphenylmethyl group, most preferably a trityl group.

In the formula (H), $R^{12}$ is most preferably a substituted phenyl group.

In the formula (H), $m^1$ represents 1 or 0. When ml is 0, $R^{11}$ is an aliphatic group, an aromatic group or a heterocyclic group, preferably a phenyl group or a substituted alkyl group having from 1 to 3 carbon atoms, and these groups have the same preferred range as described above for $R^{12}$.

$m^1$ is preferably 1.

The preferred embodiment of the group represented by $R^{11}$ is described below. When $R^{12}$ is a phenyl group and $G^1$ is —CO— group, $R^{11}$ is preferably a hydrogen atom, an alkyl group, an alkenyl group, an alkynyl group, an aryl group or a heterocyclic group, more preferably a hydrogen atom, an alkyl group or an aryl group, and most preferably a hydrogen atom or an alkyl group. In the case where $R^{11}$ represents an alkyl group, the substituent therefor is preferably a halogen atom, an alkoxy group, an aryloxy group, an alkylthio group, an arylthio group or a carboxy group.

When $R^{12}$ is a substituted methyl group and $G^1$ is —CO— group, $R^{11}$ is preferably a hydrogen atom, an alkyl group, an aryl group, a heterocyclic group, an alkoxy group or an amino group (e.g., unsubstituted amino group, alkylamino group, arylamino group, heterocyclic amino group), more preferably a hydrogen atom, an alkyl group, an aryl group, a heterocyclic group, an alkoxy group, an alkylamino group, an arylamino group or a heterocyclic amino group. When $G^1$ is —COCO— group, $R^{11}$ is preferably, irrespective of $R^{12}$, an alkoxy group, an aryloxy group or an amino group, more preferably a substituted amino group, specifically, an alkylamino group, an arylamino group or a saturated or unsaturated heterocyclic amino group.

When $G^1$ is $—SO_2—$ group, $R^{11}$ is preferably, irrespective of $R^{12}$, an alkyl group, an aryl group or a substituted amino group.

In the formula (H), $G^1$is preferably —CO— or —COCO— group, more preferably —CO— group.

Specific examples of the compound represented by the formula (H) are shown below. However, the present invention is by no means limited to those compounds.

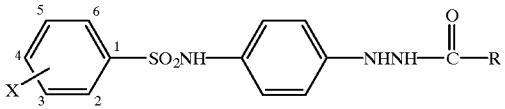
| | X = | R = —H | —$C_2F_4$—COOH or (—$C_2F_4$—$COO^{\ominus}$ $K^{\oplus}$) | 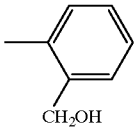 | 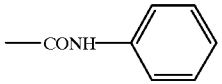 |
|---|---|---|---|---|---|
| 1 | 3-NHCO-$C_9H_{19}$(n) | 1a | 1b | 1c | 1d |
| 2 | 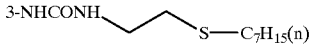 | 2a | 2b | 2c | 2d |
| 3 | 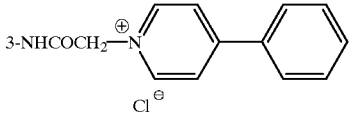 | 3a | 3b | 3c | 3d |
| 4 | 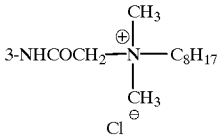 | 4a | 4b | 4c | 4d |
| 5 | 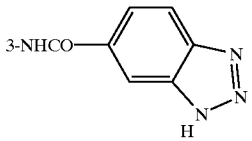 | 5a | 5b | 5c | 5d |
| 6 | 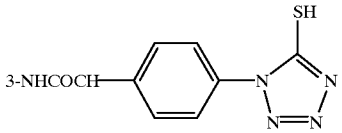 | 6a | 6b | 6c | 6d |

-continued
| | | | | | |
|---|---|---|---|---|---|
| 7 | 2,4-$(CH_3)_2$-3-$SC_2H_4$—$(OC_2H_4)_4$—$OC_8H_{17}$ | 7a | 7b | 7c | 7d |
| | 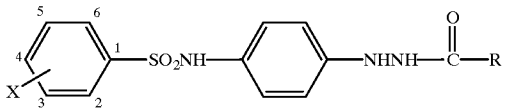 | | | | |
| | | R = | | | |
| | X = | —H | —$CF_2H$ | 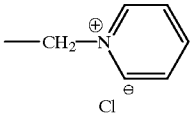 | 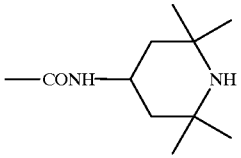 |
| 8 | 3-$CONHCH_2CH(C_2H_5)$—$C_4H_9$ | 8a | 8e | 8f | 8g |
| 9 | 6-$OCH_3$-3-$C_5H_{11}$(t) | 9a | 9e | 9f | 9g |
| 10 | 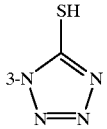 | 10a | 10e | 10f | 10g |
| 11 | 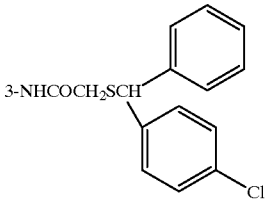 | 11a | 11e | 11f | 11g |
| 12 | 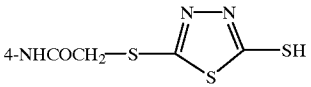 | 12a | 12e | 12f | 12g |

-continued
| | | | | | |
|---|---|---|---|---|---|
| 13 | 3-NHCOCH(CH$_2$COOH)—C$_8$H$_{17}$ | 13a | 13e | 13f | 13g |
| 14 | 3,5—(CONHCH$_2$CH(C$_2$H$_5$)—C$_4$H$_9$)$_2$ | 14a | 14e | 14f | 14g |
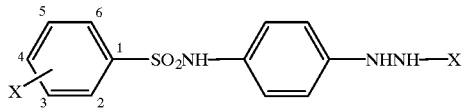
| | Y= | X = —CHO | —COCF$_3$ | —SO$_2$CH$_3$ | —P(=O)(OC$_2$H$_5$)$_2$ |
|---|---|---|---|---|---|
| 15 | 3-NHCOCH$_2$N$^{\oplus}$(Cl$^{\ominus}$)—CONHC$_4$H$_9$ | 15a | 15h | 15i | 15j |
| 16 | 4-NHCO(CH$_2$)$_2$N$^{\oplus}$(Cl$^{\ominus}$)—C$_6$H$_{13}$ | 16a | 16h | 16i | 16j |
| 17 | 3-SO$_2$NH—(CH$_2$CH$_2$O)$_4$—OC$_4$H$_9$ | 17a | 17h | 17i | 17j |
| 18 | 3,4-(COOCH(CH$_3$)COOC$_4$H$_9$)$_2$ | 18a | 18h | 18i | 18j |
| 19 | 3-NHCO—(CH$_2$)$_4$—(1,2-dithiolane) | 19a | 19h | 19i | 19j |

-continued
| | | | | | | |
|---|---|---|---|---|---|---|
| 20 | 3-$NHSO_2NH—C_8H_{17}$ | 20a | 20h | 20i | 20j | |
| 21 | 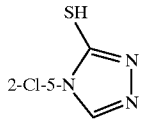 | 21a | 21h | 21i | 21j | |
| | | | R = | | | |
| | | | —H | —$CF_3$ | 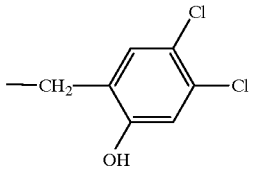 | 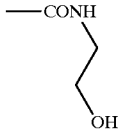 |
| 22 | 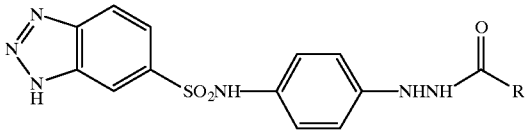 | | 22a | 22h | 22k | 22l |
| 23 | 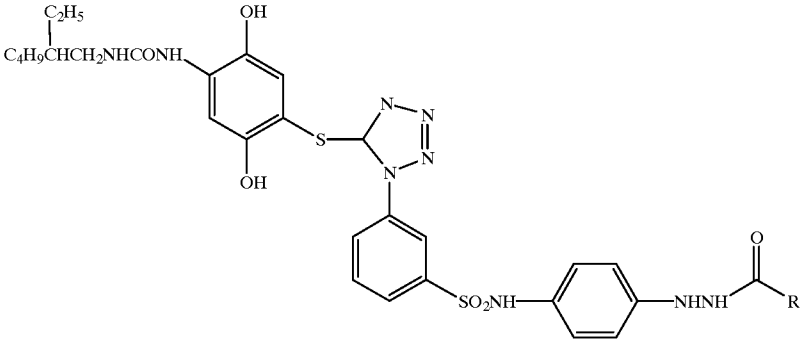 | | 23a | 23h | 23k | 23l |

-continued
| | | | | | |
|---|---|---|---|---|---|
| 24 | 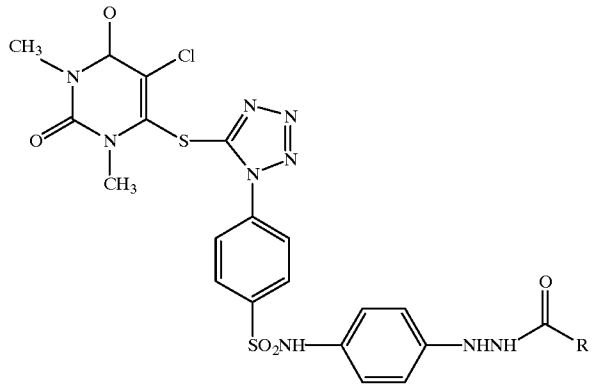 | 24a | 24h | 24k | 24l |
| 25 | 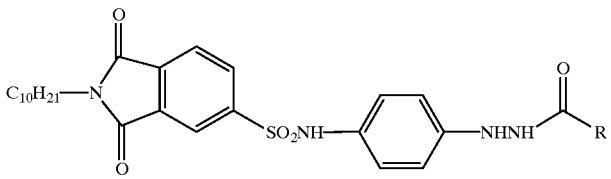 | 25a | 25h | 25k | 25l |
| 26 | 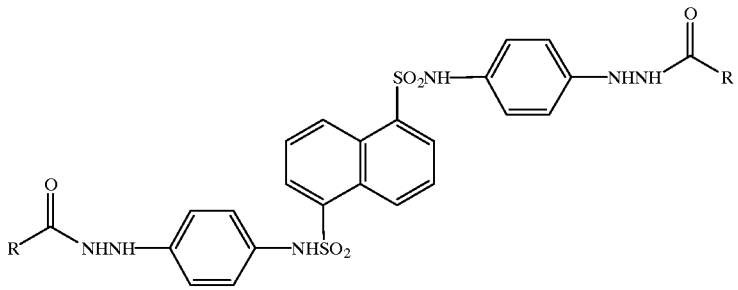 | 26a | 26h | 26k | 26l |

-continued
| | | | | | |
|---|---|---|---|---|---|
| 27 | 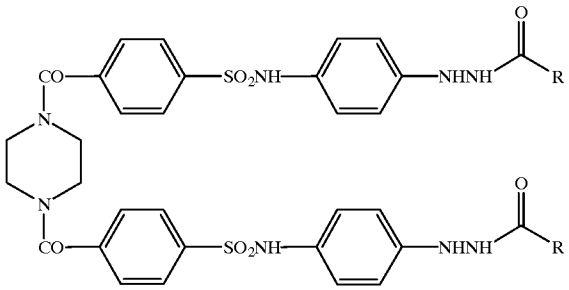 | 27a | 27h | 27k | 27l |
| 28 | 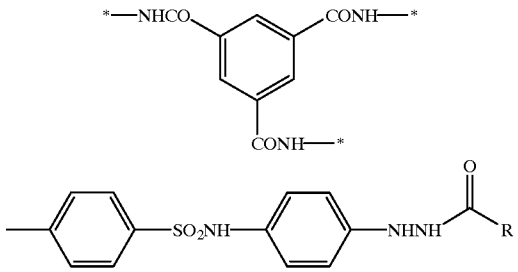 | 28a | 28h | 28k | 28l |
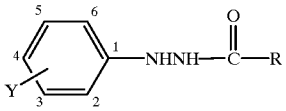
R =
| Y = | —H | —$CH_2OCH_3$ | 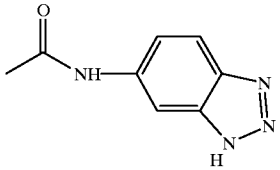 | 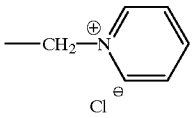 |
|---|---|---|---|---|

-continued
| | | | | | |
|---|---|---|---|---|---|
| 29 | 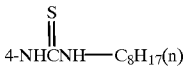 | 29a | 29m | 29n | 29f |
| 30 | 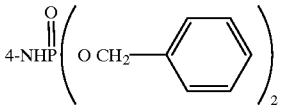 | 30a | 30m | 30n | 30f |
| 31 | 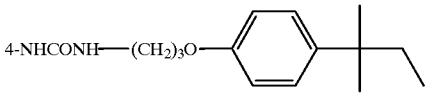 | 31a | 31m | 31n | 31f |
| 32 | 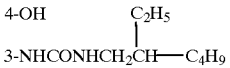 | 32a | 32m | 32n | 32f |
| 33 | 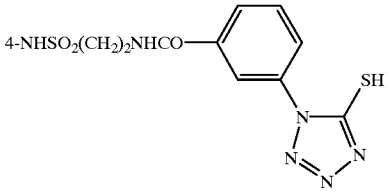 | 33a | 33m | 33n | 33f |
| 34 | 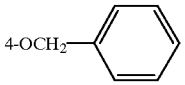 | 34a | 34m | 34n | 34f |
| 35 | 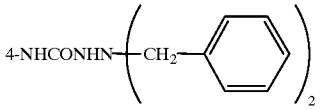 | 35a | 35m | 35n | 35f |

-continued
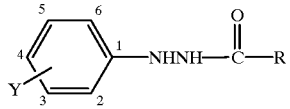
| | Y = | R = —H | —$CF_2SCH_3$ | —$CONHCH_3$ | 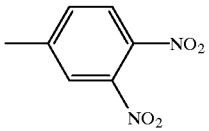 |
|---|---|---|---|---|---|
| 36 | 2-$NHSO_2CH_3$— <br> 4-$NHCONH(CH_2)_3$— 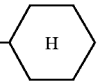 | 36a | 36o | 36p | 36q |
| 37 | 2-$OCH_3$- <br> 4-$NHSO_2C_{12}H_{25}$ | 37a | 37o | 37p | 37q |
| 38 | 3-$NHCOC_{11}H_{23}$- <br> 4-$NHSO_2CF_3$ | 38a | 38o | 38p | 38q |
| 39 | 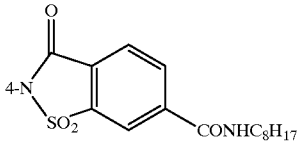 | 39a | 39o | 39p | 39q |
| 40 | 4-$OCO(CH_2)_2COOC_6H_{13}$ | 40a | 40o | 40p | 40q |
| 41 | 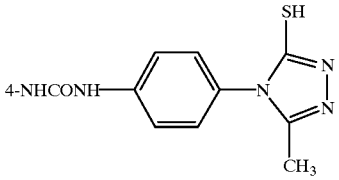 | 41a | 41o | 41p | 41q |

-continued
| | | | | | |
|---|---|---|---|---|---|
| 42 | 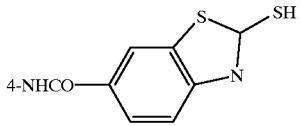 | 42a | 42o | 42p | 42q |
43
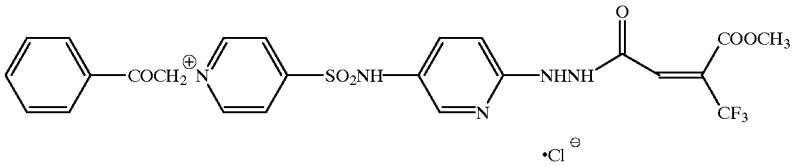
44
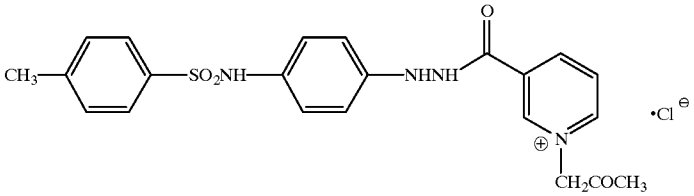
45
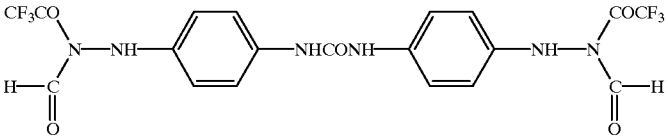
46
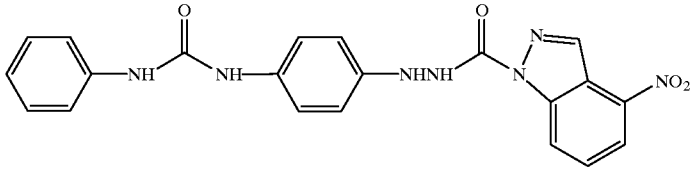
47
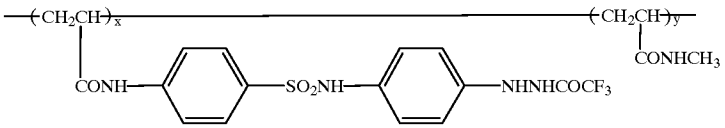
X:Y = 3:97
平均分子量 ≒ 10 万

-continued
48
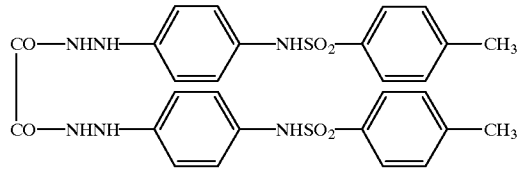
49
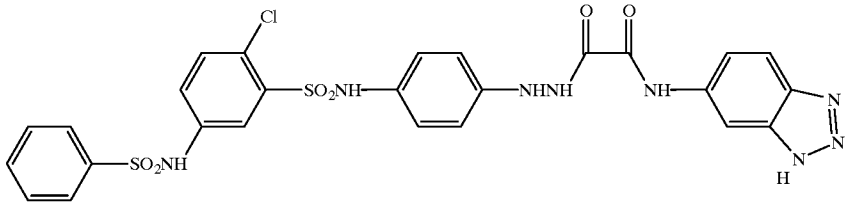
50
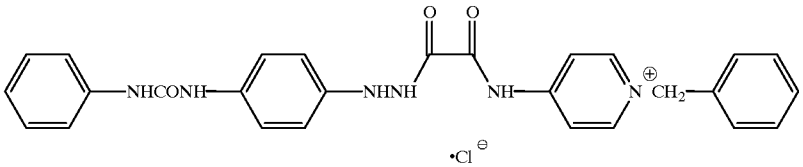
51
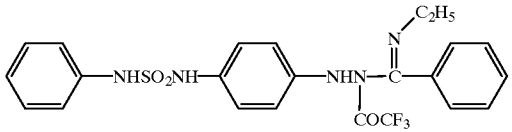
52
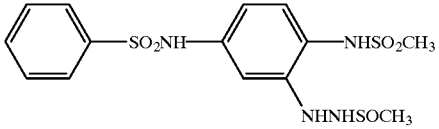
53
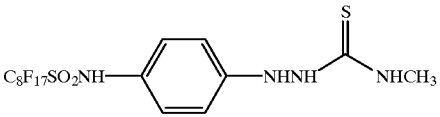

-continued
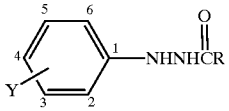
| | Y= | R = —H | —$CH_2OCH_3$ | —$CH_2O$— 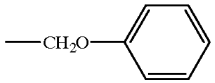 | —$CONHC_3H_7$ |
|---|---|---|---|---|---|
| 54 | 2-$OCH_3$ | 54a | 54m | 54r | 54s |
| 55 | 2-$OCH_3$ 5-$C_8H_{17}$(t) | 55a | 55m | 55r | 55s |
| 56 | 4-$NO_2$ | 56a | 56m | 56r | 56s |
| 57 | 4-$CH_3$ | 57a | 57m | 57r | 57s |
| 58 | 4-NHCO— 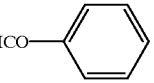 | 58a | 58m | 58r | 58s |
| 59 | 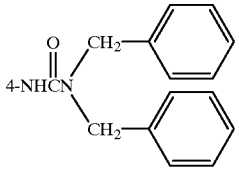 | 59a | 59m | 59r | 59s |

-continued
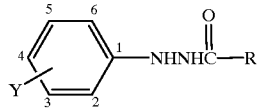
| | Y = | R = —H | 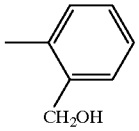 | 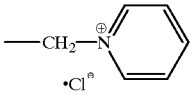 | 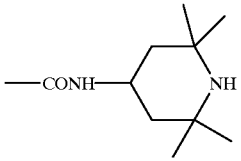 |
|---|---|---|---|---|---|
| 60 | 2-$OCH_3$ 5-$OCH_3$ | 60a | 60c | 60f | 60g |
| 61 | 4-$C_8H_{17}$(t) | 61a | 61c | 61f | 61g |
| 62 | 4-$OCH_3$ | 62a | 62c | 62f | 62g |
| 63 | 3-$NO_2$ | 63a | 63c | 63f | 63g |
| 64 | 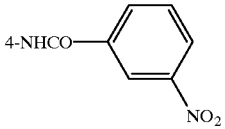 | 64a | 64c | 64f | 64g |
| 65 | 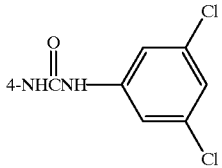 | 65a | 65c | 65f | 65g |

-continued
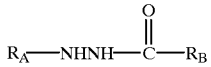
| | $R_A$ = | $R_B$ = —H | —$CH_2O$— 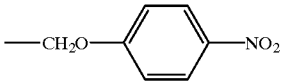 | 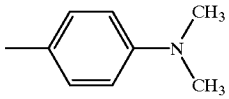 | 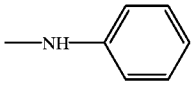 |
|---|---|---|---|---|---|
| 66 | 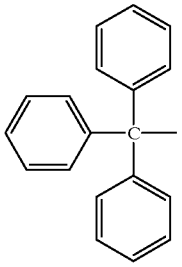 | 66a | 66u | 66v | 66t |
| 67 | 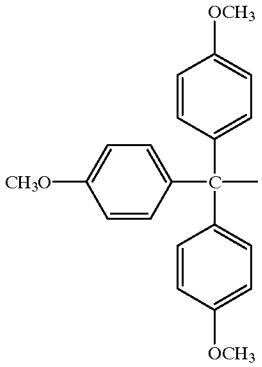 | 67a | 67u | 67v | 67t |

-continued
| | | | | | |
|---|---|---|---|---|---|
| 68 | 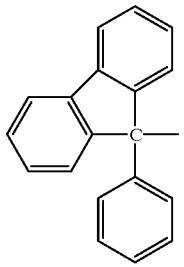 | 68a | 68u | 68v | 68t |
| 69 | 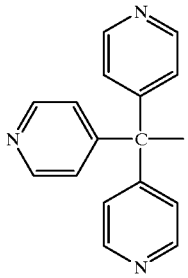 | 69a | 69u | 69v | 69t |
| 70 | 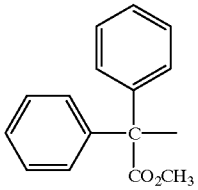 | 70a | 70u | 70v | 70t |
| 71 | 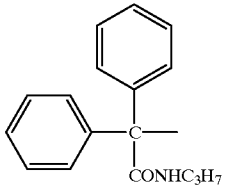 | 71a | 71u | 71v | 71t |

-continued
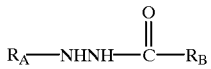
| | $R_A$ = | $R_B$ = | | | |
|---|---|---|---|---|---|
| | | 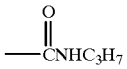 | 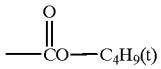 | $—OC_4H_9(t)$ | 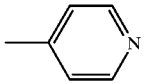 |
| 72 | 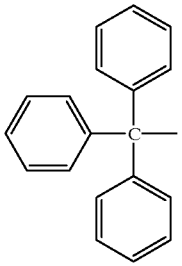 | 72s | 72x | 72y | 72w |
| 73 | 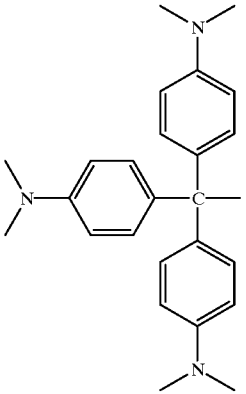 | 73s | 73x | 73y | 73w |

-continued
| | | | | | |
|---|---|---|---|---|---|
| 74 | 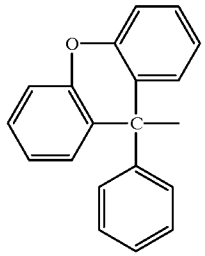 | 74s | 74x | 74y | 74w |
| 75 | 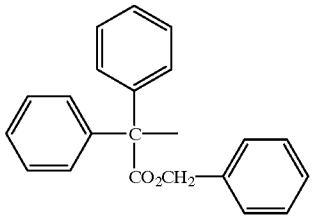 | 75s | 75x | 75y | 75w |
| 76 | 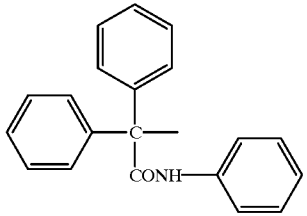 | 76s | 76x | 76y | 76w |

-continued
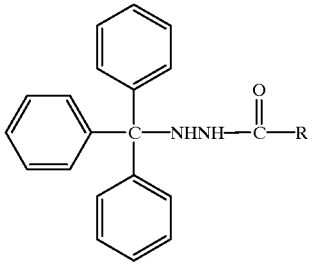
R =
77
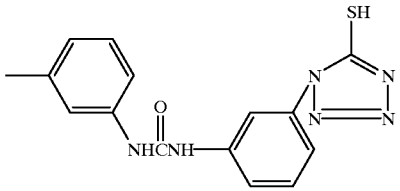
78
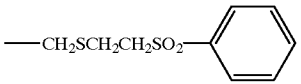
79 $—CH_2OCH_2CH_2SCH_2CH_2OCH_3$
80 $—CF_2CF_2COOH$
81
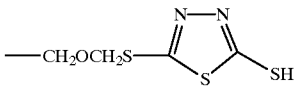
82
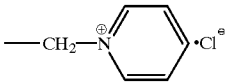

-continued
83
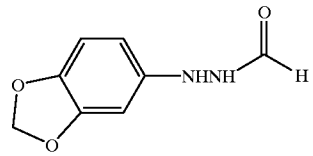
84
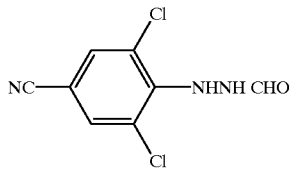
85
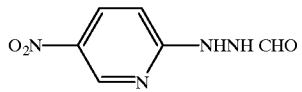
86
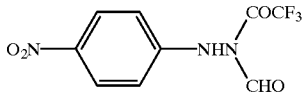
87
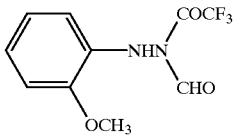
88
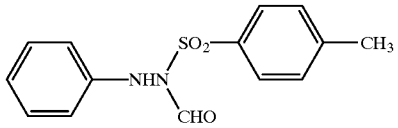
89
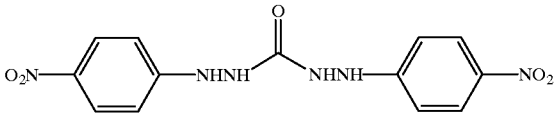

-continued
90
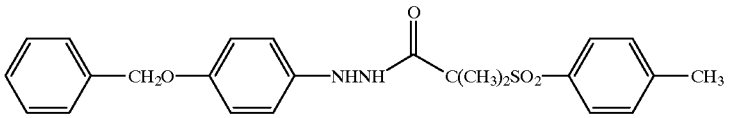
91
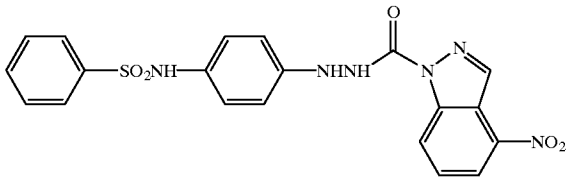
92
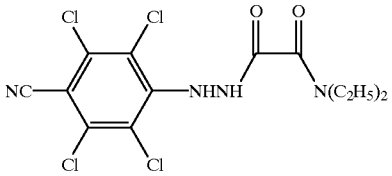
93
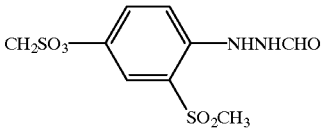
94
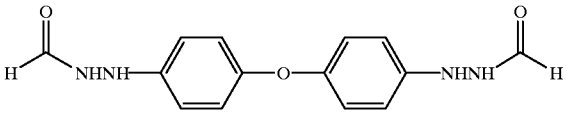

-continued
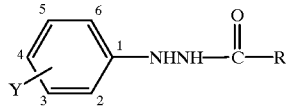
| | Y = | R = 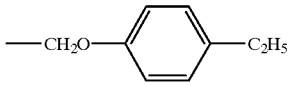 | 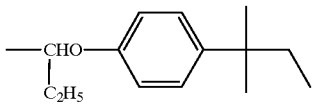 | 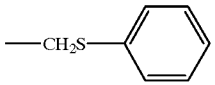 | $—CH_2—Cl$ |
|---|---|---|---|---|---|
| 95 | 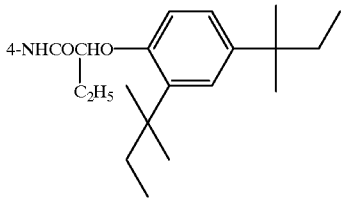 | 95-1 | 95-2 | 95-3 | 95-4 |
| 96 | 4-COOH | 96-1 | 96-2 | 96-3 | 96-4 |
| 97 | 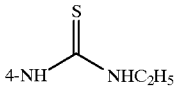 | 97-1 | 97-2 | 97-3 | 97-4 |
| 98 | 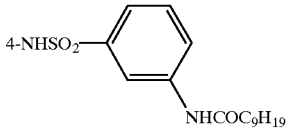 | 98-1 | 98-2 | 98-3 | 98-4 |
| 99 | 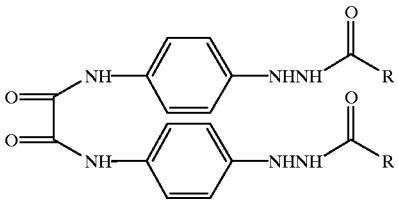 | 99-1 | 99-2 | 99-3 | 99-4 |

-continued
| 100 | 4-NHCONHCH$_2$CH($C_2H_5$)($C_4H_9$) | 100-1 | 100-2 | 100-3 | 100-4 |
|---|---|---|---|---|---|
| | | 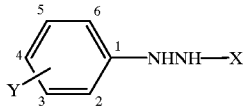 | | | |
| | | X = | | | |
| | Y = | 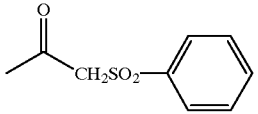 | 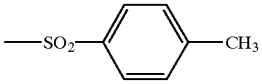 | 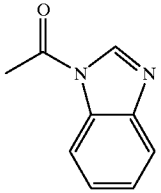 | 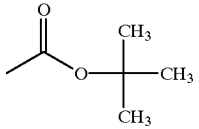 |
| 101 | 4—$NO_2$ | 101-5 | 101-6 | 101-7 | 101y |
| 102 | 2,4-$OCH_3$ | 102-5 | 102-6 | 102-7 | 102y |
| 103 | 4-NHCOCH$_2$O— 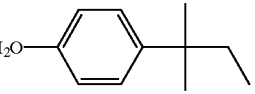 | 103-5 | 103-6 | 103-7 | 103y |
| | | X = | | | |
| | Y = | 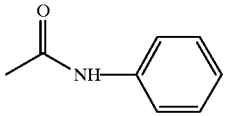 | 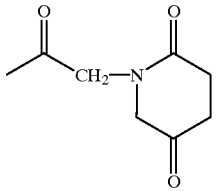 | 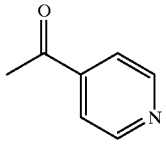 | 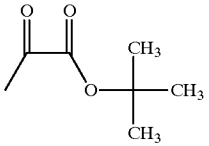 |
| 104 | 4-NHCONH 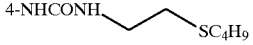 $SC_4H_9$ | 104-8 | 104-9 | 104w' | 104x |

-continued
| | | | | | |
|---|---|---|---|---|---|
| 105 | 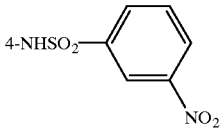 | 105-8 | 105-9 | 105w' | 105x |
| | | Y—NH NH—X | | | |
| | | X = | | | |
| | Y = | 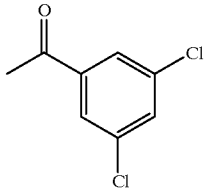 | 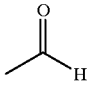 | 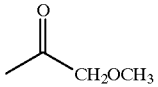 | 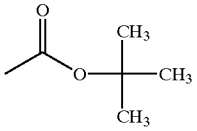 |
| 106 | 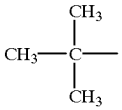 | 106-10 | 106a | 106m | 106y |
| 107 | 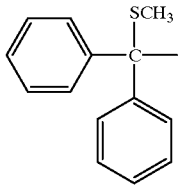 | 107-10 | 107a | 107m | 107y |
| 108 | 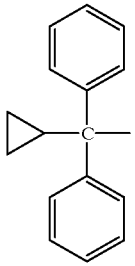 | 108-10 | 108a | 108m | 108y |

-continued
| | | | | | |
|---|---|---|---|---|---|
| 109 | 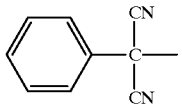 | 109-10 | 109a | 109m | 109y |
| 110 | 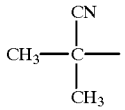 | 110-10 | 110a | 110m | 110y |
| 111 | 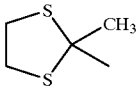 | 111-10 | 111a | 111m | 111y |
Y—NH NH—X
| | X = | | | |
|---|---|---|---|---|
| Y = | 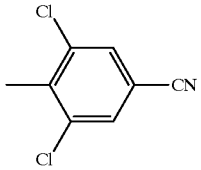 | 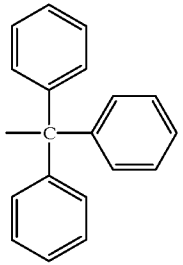 | 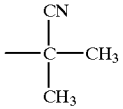 | 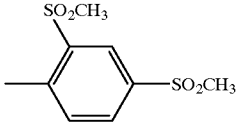 |
| 112 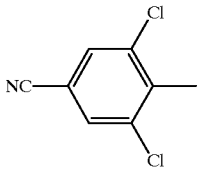 | 112-11 | 112-12 | 112-13 | 112-14 |

-continued
| | | | | | |
|---|---|---|---|---|---|
| 113 | 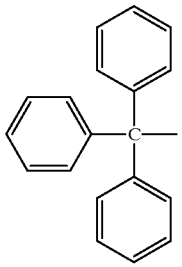 | 113-11 | 113-12 | 113-13 | 113-14 |
| 114 | 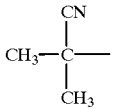 | 114-11 | 114-12 | 114-13 | 114-14 |
| 115 | 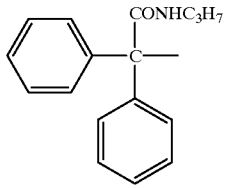 | 115-11 | 115-12 | 115-13 | 115-14 |
| 116 | 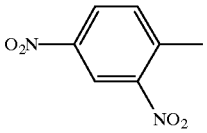 | 116-11 | 116-12 | 116-13 | 116-14 |
| 117 | 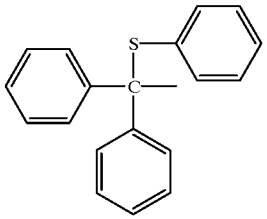 | 117-11 | 117-12 | 117-13 | 117-14 |

-continued
118
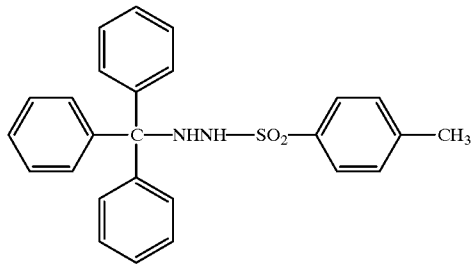
119
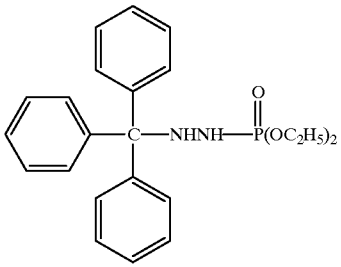
120
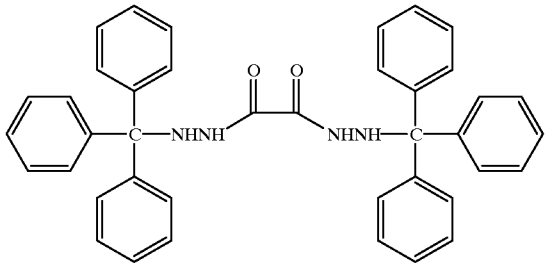

-continued
121
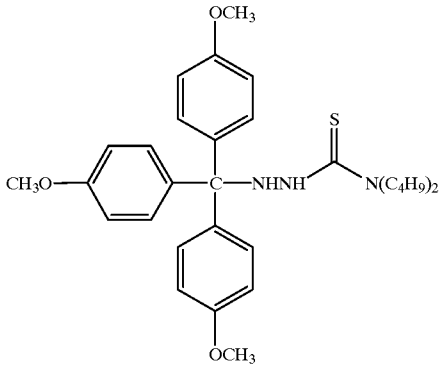
122
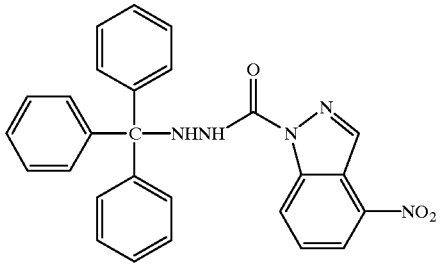
123
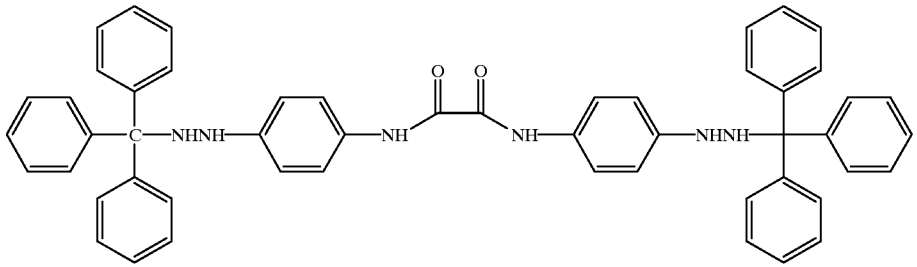

-continued
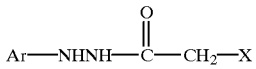
| | | X = | | | | | |
|---|---|---|---|---|---|---|---|
| | Ar= | —OH | —SH | —$NHCOCF_3$ | —$NHSO_2CH_3$ | —$NHSO_2ph$ | —$N(CH_3)_2$ |
| 124 | 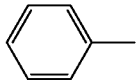 | 124a | 124b | 124c | 124d | 124e | 124f |
| 125 | 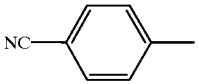 | 125a | 125b | 125c | 125d | 125e | 125f |
| 126 | 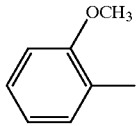 | 126a | 126b | 126c | 126d | 126e | 126f |
| 127 | 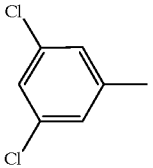 | 127a | 127b | 127c | 127d | 127e | 127f |
| 128 | 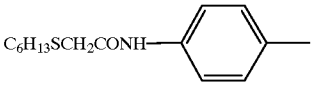 | 128a | 128b | 128c | 128d | 128e | 128f |
| 129 | 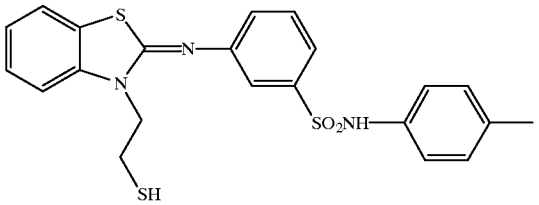 | 129a | 129b | 129c | 129d | 129e | 129f |

-continued
| | | | | | | | |
|---|---|---|---|---|---|---|---|
| 130 | 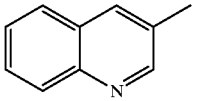 | 130a | 130b | 130c | 130d | 130e | 130f |
| 131 | 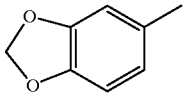 | 131a | 131b | 131c | 131d | 131e | 131f |
| 132 | 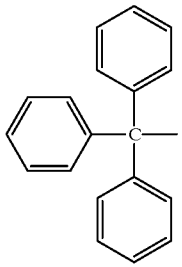 | 132a | 132b | 132c | 132d | 132e | 132f |
| 133 | 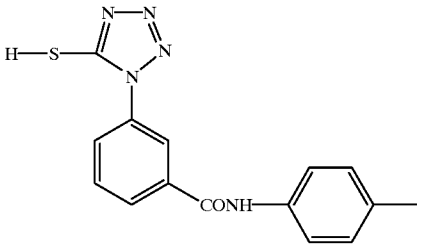 | 133a | 133b | 133c | 133d | 133e | 133f |
| 134 | 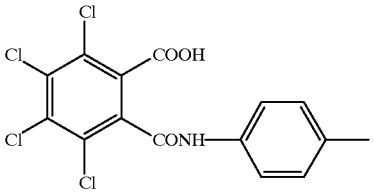 | 134a | 134b | 134c | 134d | 134e | 134f |

-continued
| | |
|---|---|
| 135 | 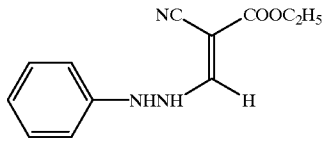 |
| 136 | 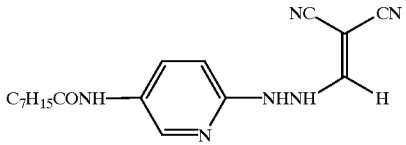 |
| 137 | 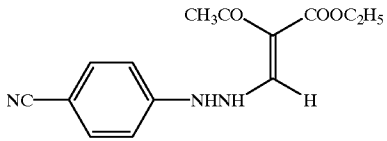 |

The hydrazine derivatives represented by the formula (H) can be used alone or in any combination of two or more kinds of them.

In addition to the above-described hydrazine derivatives, the hydrazine derivatives described below may also be preferably used in the present invention (depending on the case, the hydrazine derivatives may be used in combination). Furthermore, the hydrazine derivative for use in the present invention can be synthesized by various methods described in the following patent publications.

Examples of the hydrazine derivative other than the hydrazine derivative described in the foregoing include the compounds represented by (Chem. 1) of JP-B-6-77138, specifically, compounds described at pages 3 and 4 of the publication; the compounds represented by the formula (I) of JP-B-6-93082, specifically, Compounds 1–38 described at pages 8 to 18 of the publication; the compounds represented by the formulae (4), (5) and (6) of JP-A-6-230497, specifically, Compounds 4-1 to 4-10 described at pages 25 and 26, Compounds 5-1 to 5-42 described at pages 28 to 36 and Compounds 6-1 to 6-7 described at pages 39 and 40 of the publication; the compounds represented by the formulae (1) and (2) of JP-A-6-289520, specifically, Compounds 1-1) to 1-17) and 2-1) described at pages 5 to 7 of the publication; the compounds represented by (Chem. 2) and (Chem. 3) of JP-A-6-313936, specifically, compounds described at pages 6 to 19 of the publication; the compound represented by (Chem. 1) of JP-A-6-313951, specifically, the compounds described at pages 3 to 5 of the publication; the compound represented by the formula (I) of JP-A-7-5610, specifically, Compounds I-1 to I-38 described at pages 5 to 10 of the publication; the compounds represented by the formula (II) of JP-A-7-77783, specifically, Compounds II-1 to II-102 described at pages 10 to 27 of the publication; the compounds represented by the formulae (H) and (Ha) of JP-A-7-104426, specifically, Compounds H-1 to H-44 described at pages 8 to 15 of the publication; the compounds characterized by having in the vicinity of the hydrazine group an anionic group or a nonionic group capable of forming an internal hydrogen bond with a hydrogen atom of hydrazine, described in JP-A-9-22082, particularly, the compounds represented by the formulae (A), (B), (C), (D), (E) and (F), specifically, Compounds N-1 to N-30 described in the publication; the compound represented by the formula (1) described in JP-A-9-22082, specifically, Compounds D-1 to D-55 described in the publication; various hydrazine derivatives described at pages 25 to 34 of *Kochi Gijutsu* (*Known Techniques*), pages 1 to 207, Aztech (issued on Mar. 22, 1991); and Compounds D-2 and D-39 described in JP-A-62-86354 (pages 6 and 7).

The hydrazine derivatives for use in the present invention may be used after dissolving it in an appropriate organic solvent such as an alcohol (e.g., methanol, ethanol, propanol, fluorinated alcohol), a ketone (e.g., acetone, methyl ethyl ketone), dimethylformamide, dimethylsulfoxide or methyl cellosolve.

Also, the hydrazine derivatives for use in the present invention each may be dissolved by an already well-known emulsification dispersion method using an oil such as dibutyl phthalate, tricresyl phosphate, glyceryl triacetate or diethyl phthalate, or an auxiliary solvent such as ethyl acetate or cyclohexanone, and mechanically formed into an emulsified dispersion before use. Furthermore, they may be used after dispersing the powder of the hydrazine derivative in water by a method known as a solid dispersion method, using a ball mill, colloid mill or ultrasonic wave.

The hydrazine derivatives for use in the present invention may be added to any layers on the image-forming layer side on the support, i.e., the image-forming layer or other layers on that layer side; however, they are preferably added to an image-forming layer or a layer adjacent thereto.

The addition amount of the hydrazine derivatives for use in the present invention is preferably from $1\times10^{-6}$ to $1\times10^{-2}$ mol, more preferably from $1\times10^{-5}$ to $5^{-10-3}$ mol, most preferably from $2\times10^{-5}$ to $5\times10^{-3}$ mol, per mol of silver.

In the present invention, a contrast accelerator may be used in combination with the above-described ultrahigh contrast agent so as to form an ultrahigh contrast image. Examples thereof include amine compounds described in U.S. Pat. No. 5,545,505, specifically, AM-1 to AM-5; hydroxamic acids described in U.S. Pat. No. 5,545,507, specifically, HA-1 to HA-11; acrylonitriles described in U.S. Pat. No. 5,545,507, specifically, CN-1 to CN-13, hydrazine compounds described in U.S. Pat. No. 5,558,983, specifically, CA-1 to CA-6; and onium salts described in JP-A-9-297368, specifically, A-1 to A-42, B-1 to B-27 and C-1 to C-14.

The synthesis methods, addition methods and addition amounts of the aforementioned ultrahigh contrast agents and the contrast accelerators may be according to those described in the patent publications cited above.

The heat-developable image-recording material of the present invention may contain a sensitizing dye. The sensitizing dye may be any one of those that can spectrally sensitize the halogenated silver halide particles at a desired wavelength region when they are adorbed on the halogenated silver halide particles. As such sensitizing dyes, usable are, for example, cyanine dyes, merocyanine dyes, complex cyanine dyes, complex merocyanine dyes, holopolar cyanine dyes, styryl dyes, hemicyanine dyes, oxonole dyes and hemioxonole dyes. Sensitizing dyes which are usable in the present invention are described, for example, in Research Disclosure, Item 17643, IV-A (December, 1978, page 23), Item 1831X (August, 1978, page 437) and also in the references as referred to in them. In particular, sensitizing dyes having a color sensitivity suitable for spectral characteristics of light sources of various laser imagers, scanners, image setters, process cameras and the like can advantageously be selected.

Exemplary dyes for spectral sensitization to so-called red light from light sources such as He—Ne laser, red semiconductor laser, and LED include Compounds I-1 to I-38 disclosed in JP-A-54-18726, Compounds I-1 to I-35 disclosed in JP-A-6-75322, Compounds I-1 to I-34 disclosed in JP-A-7-287338, Dyes 1 to 20 disclosed in JP-B-55-39818, Compounds I-1 to I-37 disclosed in JP-A-62-284343, and Compounds I-1 to I-34 disclosed in JP-A-7-287338.

Spectral sensitization as to the wavelength region of from 750 to 1,400 nm from semiconductor laser light sources can advantageously be obtained with various known dyes such as a cyanine dye, a merocyanine dye, a styryl dye, a hemicyanine dye, an oxonol dye, a hemioxonol dye and a xanthene dye. Useful cyanine dyes are cyanine dyes having a basic nucleus such as thiazoline nucleus, oxazoline nucleus, pyrroline nucleus, pyridine nucleus, oxazole nucleus, thiazole nucleus, selenazole nucleus or imidazole nucleus. Useful merocyanine dyes are merocyanine dyes having the above-described basic nucleus or an acidic nucleus such as thiohydantoin nucleus, rhodanine nucleus, oxazolidinedione nucleus, thiazolinedione nucleus, barbituric acid nucleus, thiazolinone nucleus, malononitrile nucleus or pyrazolone nucleus. Of these cyanine and merocyanine dyes, those having an imino group or a carboxyl group are particularly effective. The dye may be appropriately selected from known dyes described, for example, in U.S. Pat. Nos. 3,761,279, 3,719,495 and 3,877,943, British Patent Nos. 1,466,201, 1,469,117 and 1,422,057, JP-B-3-10391, JP-B-6-52387, JP-A-5-341432, JP-A-6-194781 and JP-A-6-301141.

The dyes particularly preferably used for the present invention are cyanine dyes having a thioether bond (e.g., cyanine dyes described in JP-A-62-58239, JP-A-3-138638, JP-A-3-138642, JP-A-4-255840, JP-A-5-72659, JP-A-5-72661, JP-A-6-222491, JP-A-2-230506, JP-A-6-258757, JP-A-6-317868, JP-A-6-324425, JP-W-A-7-500926 (the code "JP-W-A" as used herein means an "international application published in Japanese for Japanese national phase"), and U.S. Pat. No. 5,541,054), dyes having a carboxylic acid group (e.g., dyes disclosed in JP-A-3-163440, JP-A-6-301141, and U.S. Pat. No. 5,441,899), merocyanine dyes, polynuclear merocyanine dyes and polynuclear cyanine dyes (dyes disclosed in JP-A-47-6329, JP-A-49-105524, JP-A-51-127719, JP-A-52-80829, JP-A-54-61517, JP-A-59-214846, JP-A-60-6750, JP-A-63-159841, JP-A-6-35109, JP-A-6-59381, JP-A-7-146537, JP-A-7-146537, JP-A-W-55-50111, British Patent No. 1,467,638, and U.S. Pat. No. 5,281,515) and the like.

Dyes forming J-band have been disclosed in U.S. Pat. Nos. 5,510,236, 3,871,887 (Example 5), JP-A-2-96131, JP-A-59-48753 and the like, and they can preferably be used for the present invention.

These sensitizing dyes may be used either individually or in combination of two or more thereof. The combination of sensitizing dyes is often used for the purpose of supersensitization. In combination with the sensitizing dye, a dye which itself has no spectral sensitization effect or a material which absorbs substantially no visible light, but which exhibits supersensitization may be incorporated into the emulsion. Useful sensitizing dyes, combinations of dyes which exhibit supersensitization, and materials which show supersensitization are described in Research Disclosure, Vol. 176, 17643, page 23, Item IV-J (December, 1978), JP-B-49-25500, JP-B-43-4933, JP-A-59-19032, JP-A-59-192242 and the like.

The sensitizing dyes may be used in combination of two or more of them for the present invention. The sensitizing dye may be added to the silver halide emulsion by dispersing it directly in the emulsion or may be added to the emulsion after dissolving it in a solvent such as water, methanol, ethanol, propanol, acetone, methyl cellosolve, 2,2,3,3-tetrafluoropropanol, 2,2,2-trifluoroethanol, 3-methoxy-1-propanol, 3-methoxy-1-butanol, 1-methoxy-2-propanol and N,N-dimethylformamide, and the solvent may be a sole solvent or a mixed solvent.

Furthermore, the sensitizing dye may be added using a method disclosed in U.S. Pat. No. 3,469,987 where a dye is dissolved in a volatile organic solvent, the solution is dispersed in water or hydrophilic colloid, and the dispersion is added to an emulsion, a method disclosed in JP-B-44-23389, JP-B-44-27555 and JP-B-57-22091 where a dye is dissolved in an acid and the solution is added to an emulsion or the solution is formed into an aqueous solution while allowing the presence together of an acid or base and then added to an emulsion, a method disclosed in U.S. Pat. Nos. 3,822,135 and 4,006,025 where an aqueous solution or colloid dispersion of a dye is formed in the presence of a surface active agent and the solution or dispersion is added to an emulsion, a method disclosed in JP-A-53-102733 and JP-A-58-105141 where a dye is dissolved directly in hydrophilic colloid and the dispersion is added to an emulsion, or a method disclosed in JP-A-51-74624 where a dye is dissolved using a compound capable of red shifting and the solution is added to an emulsion. An ultrasonic wave may also be used in dissolving the dye.

The sensitizing dye for use in the present invention may be added to a silver halide emulsion for use in the present invention in any step heretofore known to be useful in the preparation of an emulsion. The sensitizing dye may be added in any time period or step before the coating of the emulsion, for example, in the grain formation process of silver halide and/or before desalting or during the desalting process and/or the time period from desalting until initiation of chemical ripening, as disclosed in U.S. Pat. Nos. 2,735,766, 3,628,960, 4,183,756 and 4,225,666, JP-A-58-184142 and JP-A-60-196749, or immediately before or during the chemical ripening process or in the time period after chemical ripening until coating, as disclosed in JP-A-58-113920. Furthermore, as disclosed in U.S. Pat. No. 4,225,666 and JP-A-58-7629, the same compound by itself may be added in parts or a compound in combination with another compound having a different structure may be added in parts, for example, one part is added during grain formation and another part is added during or after chemical ripening, or one part is added before or during chemical ripening and another part is added after completion of the chemical ripening, and when the compound is added in parts, the combination of the compound added in parts with another compound may also be changed.

The amount of the sensitizing dye used in the present invention may be selected according to the performance such as sensitivity or fog; however, it is preferably from $10^{-6}$ to 1 mol, more preferably from $10^{-4}$ to $10^{-1}$ mol, per mol of silver halide in the light-sensitive layer that is the image-forming layer.

The silver halide emulsion and/or organic silver salt for use in the present invention can be further prevented from the production of additional fog or stabilized against the reduction in sensitivity during the stock storage, by an antifoggant, a stabilizer or a stabilizer precursor. Examples of antifoggants, stabilizers and stabilizer precursors which can be appropriately used individually or in combination include thiazonium salts described in U.S. Pat. Nos. 2,131,038 and 2,694,716, azaindenes described in U.S. Pat. Nos. 2,886,437 and 2,444,605, mercury salts described in U.S. Pat. No. 2,728,663, urazoles described in U.S. Pat. No. 3,287,135, sulfocatechol described in U.S. Pat. No. 3,235,652, oximes, nitrons and nitroindazoles described in British Patent No. 623,448, polyvalent metal salts described in U.S. Pat. No. 2,839,405, thiuronium salts described in U.S. Pat. No. 3,220,839, palladium, platinum and gold salts described in U.S. Pat. Nos. 2,566,263 and 2,597,915, halogen-substituted organic compounds described in U.S. Pat. Nos. 4,108,665 and 4,442,202, triazines described in U.S. Pat. Nos. 4,128,557, 4,137,079, 4,138,365 and 4,459,350, and phosphorus compounds described in U.S. Pat. No. 4,411,985.

The antifoggant which is preferably used in the present invention is an organic halide, and examples thereof include the compounds described in JP-A-50-119624, JP-A-50-120328, JP-A-51-121332, JP-A-54-58022, JP-A-56-70543, JP-A-56-99335, JP-A-59-90842, JP-A-61-129642, JP-A-62-129845, JP-A-6-208191, JP-A-7-5621, JP-A-7-2781, JP-A-8-15809 and U.S. Pat. Nos. 5,340,712, 5,369,000 and 5,464,737.

The antifoggant for use in the present invention may be added in any form of a solution, powder, solid microparticle dispersion and the like. The solid microparticle dispersion is performed using a known pulverization means (e.g., ball mill, vibrating ball mill, sand mill, colloid mill, jet mill, roller mill). At the time of solid microparticle dispersion, a dispersion aid may also be used.

Although not necessary for practicing the present invention, it is advantageous in some cases to add a mercury (II) salt as an antifoggant to the image-forming layer. Preferred mercury(II) salts for this purpose are mercury acetate and mercury bromide. The addition amount of mercury for use in the present invention is preferably from $1\times10^{-9}$ to $1\times10^{-3}$ mol. more preferably from $1\times10^{-8}$ to $1\times10^{-4}$ mol, per mol of silver coated.

The heat-developable image-recording material of the present invention may contain a benzoic acid compound for the purpose of achieving high sensitivity or preventing fog. The benzoic acid compound for use in the present invention may be any benzoic acid derivative, but preferred examples of the structure include the compounds described in U.S. Pat. Nos. 4,784,939 and 4,152,160 and JP-A-9-329863, JP-A-9-329864 and JP-A-9-281637. The benzoic acid compound for use in the present invention may be added to any site of the light-sensitive material, but the layer to which the benzoic acid is added is preferably a layer on the surface having the image-forming layer such as a light-sensitive layer, more preferably an organic silver salt-containing layer that is the image-forming layer. The benzoic acid compound for use in the present invention may be added at any step during the preparation of the coating solution. In the case of adding the benzoic acid compound to an organic silver salt-containing layer, it may be added at any step from the preparation of the organic silver salt until the preparation of the coating solution, but is preferably added in the period after the preparation of the organic silver salt and immediately before the coating. The benzoic acid compound for use in the present invention may be added in any form of a powder, solution, microparticle dispersion and the like, or may be added as a solution containing a mixture of the benzoic acid compound with other additives such as a sensitizing dye, a reducing agent and a color toner. The benzoic acid compound for use in the present invention may be added in any amount; however, the addition amount thereof is preferably from $1\times10^{-6}$ to 2 mol, more preferably from $1\times10^{-3}$ to 0.5 mol, per mol of silver.

The heat-developable image-recording material of the present invention may contain a mercapto compound, a disulfide compound or a thione compound so as to control the development by inhibiting or accelerating the development, improve the spectral sensitization efficiency or improve the storage stability before or after the development.

In the case of using a mercapto compound in the present invention, any structure may be used but those represented by Ar—SM or Ar—S—S—Ar are preferred, wherein M is a hydrogen atom or an alkali metal atom, and Ar is an aromatic ring or condensed aromatic ring containing one or more nitrogen, sulfur, oxygen, selenium or tellurium atoms, preferably a heteroaromatic ring such as benzimidazole, naphthimidazole, benzothiazole, naphthothiazole, benzoxazole, naphthoxazole, benzoselenazole, benzotellurazole, imidazole, oxazole, pyrazole, triazole, thiadiazole, tetrazole, triazine, pyrimidine, pyridazine, pyrazine, pyridine, purine, quinoline and quinazolinone. The heteroaromatic ring may have a substituent selected from, for example, the group-consistingofhalogen (e.g., Br, Cl), hydroxy, amino, carboxy, alkyl (e.g., alkyl having one or more carbon atoms, preferably from 1 to 4 carbon atoms), and alkoxy (e.g., alkoxy having one or more carbon atoms, preferably from 1 to 4 carbon atoms). Examples of the mercapto substituted heteroaromatic compound include 2-mercaptobenzimidazole, 2-mercaptobenzoxazole, 2-mercaptobenzothiazole, 2-mercapto-5-methylbenzimidazole, 6-ethoxy-2-mercaptobenzothiazole, 2,2'-dithiobis(benzothiazole), 3-mercapto-1,2,4-triazole, 4,5-diphenyl-2-imidazolethiol, 2-mercaptoimidazole, 1-ethyl-2-mercaptobenzimidazole, 2-mercaptoquinoline, 8-mercaptopurine, 2-mercapto-4(3H)-quinazolinone, 7-trifluoromethyl-4-quinolinethiol, 2,3,5,6-tetrachloro-4-pyridinethiol, 4-amino-6-hydroxy-2-mercaptopyrimidine monohydrate, 2-amino-5-mercapto-1,3,4-thiadiazole, 3-amino-5-mercapto-1,2,4-triazole, 4-hydroxy-2-mercaptopyrimidine, 2-mercaptopyrimidine, 4,6-diamino-2-mercaptopyrimidine, 2-mercapto-4-methylpyrimidine hydrochloride, 3-mercapto-5-phenyl-1,2,4-triazole, 2-mercapto-4-phenyloxazole and the like. However, the present invention is by no means limited thereto.

The amount of the mercapto compound added is preferably from 0.0001 to 1.0 mol, more preferably from 0.001 to 0.3 mol, per mol of silver in an emulsion layer.

The image-forming layer such as a light-sensitive layer for use in the present invention may contain a plasticizer or lubricant, and examples thereof include polyhydric alcohols (for example, glycerins and diols described in U.S. Pat. No. 2,960,404), fatty acids or esters described in U.S. Pat. Nos. 2,588,765 and 3,121,060, and silicone resins described in British Patent No. 955,061.

The heat-developable photographic emulsion for use in the present invention is coated on a support to form one or more layers. In the case of a single-layer structure, the layer must contain an organic silver salt, a silver halide, a developer, a binder and additional desired materials such as a color toner, a coating aid and other auxiliary agents. In the case of a two-layer structure, the first emulsion layer (usually a layer adjacent to the substrate) must contain an organic silver salt and a silver halide and the second layer or both layer must contain some other components. However, a two-layer structure constituted by a single emulsion layer containing all components and a protective topcoat may also be used. A multi-color light-sensitive heat-developable photographic material may have a structure such that a combination of the above-described two layers is provided for respective colors, or, as described in U.S. Pat. No. 4,708,928, a structure such that a single layer contains all components. In the case of a multi-dye multi-color light-sensitive heat-developable photographic material, respective emulsion layers (light-sensitive layers) are generally kept away from each other by using a functional or non-functional barrier layer between respective light-sensitive layers as described in U.S. Pat. No. 4,460,681.

The light-sensitive layer that is the image-forming layer for use in the present invention may contain a dye or pigment of various types so as to improve the color tone or prevent the irradiation. Any dye or pigment may be used in the light-sensitive layer for use in the present invention, and examples thereof include pigments and dyes described in the color index. Specific examples thereof include organic pigments and inorganic pigments such as a pyrazoloazole dye, an anthraquinone dye, an azo dye, an azomethine dye, an oxonol dye, a carbocyanine dye, a styryl dye, a triphenylmethane dye, an indoaniline dye, an indophenol dye and phthalocyanine. Preferred examples of the dye for use in the present invention include anthraquinone dyes (e.g., Compounds 1 to 9 described in JP-A-5-341441, Compounds 3-6 to 3-18 and 3-23 to 3-38 described in JP-A-5-165147), azomethine dyes (e.g., Compounds 17 to 47 described in JP-A-5-341441), indoaniline dyes (e.g., Compounds 11 to 19 described in JP-A-5-289227, Compound 47 described in JP-A-5-341441, Compounds 2-10 and 2-11 described in JP-A-5-165147) and azo dyes (Compounds 10 to 16 described in JP-A-5-341441). The dye maybe added in any form of a solution, emulsified product or solid microparticle dispersion or may be added in the state mordanted with a polymer mordant. The amount of such a compound used may be determined according to the objective amount absorbed but, in general, the compound is preferably used in an amount of from $1\times10^{-6}$ to 1 g per square meter of the heat-developable image-recording material.

The heat-developable image-recording material of the present invention may comprise an antihalation layer on a side remoter from the light source than the light-sensitive layer. The antihalation layer preferably has a maximum absorption in a desired region of exposure light wavelength of from about 0.3 to 2, more preferably 0.5 to 2. Further, it preferably has an optical density in the visible region of from 0.005 to 0.5, more preferably from 0.001 to 0.3 after the treatment.

In the case when an antihalation dye is used in the present invention, the dye may be any compound so long as the compound has an objective absorption in the desired wavelength region, the absorption in the visible region can be sufficiently reduced after the processing, and the antihalation layer can have a preferred absorption spectrum form. While examples thereof include those described in the following patent publications, the present invention is by no means limited thereto: as a single dye, the compounds described in JP-A-59-56458, JP-A-2-216140, JP-A-7-13295, JP-A-7-11432, U.S. Pat. No. 5,380,635, JP-A-2-68539 (from page 13, left lower column, line 1 to page 14, left lower column, line 9) and JP-A-3-24539 (from page 14, left lower column to page 16, right lower column); and as a dye which is decolored after the processing, the compounds described in JP-A-52-139136, JP-A-53-132334, JP-A-56-501480, JP-A-57-16060, JP-A-57-68831, JP-A-57-101835, JP-A-59-182436, JP-A-7-36145, JP-A-7-199409, JP-B-48-33692, JP-A-B-50-16648, JP-B-2-41734 and U.S. Pat. Nos. 4,088,497, 4,283,487, 4,548,896 and 5,187,049.

The heat-developable image-recording material of the present invention is preferably a so-called single-sided image-recording material comprising a support having on one side thereof at least one image-forming layer such as a light-sensitive layer containing a silver halide emulsion and on the other side thereof a back layer (backing layer).

In the present invention, the back layer preferably has a maximum absorption in a desired wavelength region of from about 0.3 to 2, more preferably 0.5 to 2. Further, it preferably has an optical density in the visible region of from 0.005 to 0.5, more preferably from 0.001 to 0.3. Examples of antihalation dye used for the back layer are similar to those mentioned for the aforementioned antihalation layer.

A backside resistive heating layer described in U.S. Pat. Nos. 4,460,681 and 4,374,921 may also be used in the light-sensitive heat-developable photographic image system.

In the present invention, the layers such as the image-forming layer, protective layer and back layer each may contain a hardening agent. Examples of the hardening agent include polyisocyanates described in U.S. Pat. No. 4,281,060 and JP-A-6-208193, epoxy compounds described in U.S. Pat. Nos. 4,791,042, and vinyl sulfone-based compounds described in JP-A-62-89048.

The heat-developable image-recording material of the present invention may be developed by any method but the development is usually performed by elevating the temperature of the image-recording material after the imagewise exposure. Preferred embodiments of the heat-developing apparatus used include, as a type of contacting a heat-developable image-forming material with a heat source such as heat roller or heat drum, the heat-developing apparatuses described in JP-B-5-56499, Japanese Patent No. 684453, JP-A-9-292695, JP-A-9-297385 and International Patent Publication WO95/30934, and as a non-contacting type, the heat-developing apparatuses described in JP-A-7-13294, International Patent Publications WO97/28489, WO97/28488 and WO97/28487. Of these, a non-contacting type heat-developing apparatus is preferred. The development temperature is preferably from 80 to 250° C., more preferably from 100 to 140° C. The development time is preferably from 1 to 180 seconds, more preferably from 10 to 90 seconds.

For preventing the heat-developable image-recording material of the present invention from uneven processing due to the above-described change in the dimension at the time of heat development, a method comprising heating the material at a temperature of from 80° C. to less than 115° C. (preferably 113° C. or lower) for 5 seconds or more such that an image is not formed and then heat-developing it at 110° C. or more to form an image (so-called multi-stage heating method) is effective.

The heat-developable image-recording material of the present invention may be light-exposed by any method but the light source for the exposure is preferably a laser ray. The laser ray for use in the present invention is preferably one from a gas laser, a YAG laser, a dye laser, a semiconductor laser or the like. The semiconductor laser and a second harmonic generation device may be used.

The heat-developable image-recording material of the present invention has a low haze at the exposure and is liable to incur generation of interference fringes. For preventing the generation of interference fringes, a technique of entering a laser ray obliquely with respect to the image-recording material disclosed in JP-A-5-113548 and a method of using a multimode laser disclosed in International Patent Publication WO95/31754 are known and these techniques are preferably used.

The heat-developable image-recording material of the present invention is preferably exposed such that the laser rays are overlapped and the scanning lines are not viewed as described in *SPIE*, Vol. 169, "Laser Printing", pages 116 to 128 (1979), JP-A-4-51043 and WO95/31754.

An exemplary structure of heat-developing apparatus used for the heat development of the heat-developable image-recording material of the present invention is shown in FIG. 1. FIG. 1 represents a side view of a heat-developing apparatus. The apparatus comprises a cylindrical heat drum, which is internally provided with a halogen lamp 1 as a heat source of the heating means, and a continuous belt 4 for transportation, which is put on a plurality of feed rollers 3, is pressed against the circumferential surface of the heat drum 2. A heat-developable image-recording material 5 is transferred between the continuous belt 4 and the heat drum 2. During the transfer, the heat-developable image-recording material 5 is heated to a development temperature, and undergone the heat development. In this operation, the direction of the lamp is optimized, so that precise temperature control along the transverse direction can be obtained.

A straightening guide panel 7 is provided in the proximity of exit 6, where the heat-developable image-recording material 5 is fed out from the gap between the heat drum 2 and the continuous belt 4 while released from the curved circumferential surface of the heat drum 2, and the guide panel 7 straightens the heat-developable image-recording material 5 into a flat form. The atmospheric temperature around the straightening guide panel 7 is controlled so that the temperature of the heat-developable image-recording material 5 should not be lowered to a temperature below a certain level.

A pair of feed rollers 8 for transferring the heat-developable image-recording material 5 is provided downstream the exit 6, and flat guide panels 9 are provided next to, and downstream from the feed rollers 8, and guide the heat-developable image-recording material 5 maintained flat. Further, another pair of feed rollers 10 is provided downstream from, and next to the flat guide panels 9. The flat guide panels 9 have such a length that the heat-developable image-recording material 5 should be cooled during the transfer between them. That is, the heat-developable image-recording material 5 is cooled to a temperature of 30° C. or lower during the transfer between them. As a cooling means for the flat guide panels 9, cooling fans 11 are provided.

While the heat-development apparatus is explained with reference to the drawing, it is not limited to the one shown in the drawing, and any one of heat-development apparatuses of various structures such as one disclosed in JP-A-7-13294 can be used. When a multiple-step heat treatment is employed, two or more of heat sources of different temperatures may be provided in such an apparatus mentioned above to afford continuous heating with different temperatures.

The present invention will be explained in more detail with reference to the following examples. However, the present invention is not limited to the following examples.

EXAMPLES

Synthesis Example 1

To 100 g of maleinated poly-1,2-butadiene (NISSO-PB BN-1015, Nippon Soda), 2.5 g of butyl cellosolve, 0.5 g of butanol, 160 g of water, 2.3 g of 25% by weight aqueous ammonia, and uniformly dissolved. The solution was heated to 70° C., added with a solution containing 0.21 g of potassium persulfate dissolved in 20 g of water, and then added with 50 g of butyl methacrylate under nitrogen gas flow over two hours. After emulsion polymerization was performed for one hour, the reaction mixture was added with a solution containing 0.10 g of potassium persulfate dissolved in 10 g of water, and heated to 80° C. for three hours. A milk-white latex of good quality was provided. The provided latex showed pH of 8.5, solid content of 23.4% by weight, and an average particle size of 80 μm (light scattering method).

Synthesis Example 2

Synthesis was performed in the same manner as in Synthesis Example 1, except that a mixture of 40 g of butyl methacrylate and 10 g of butyl acrylate was used instead of 50 g of butyl methacrylate. The provided latex was a milk-white latex of good quality showing pH of 8.9, solid content of 23.4% by weight, and an average particle size of 81 im (light scattering method).

Synthesis Example 3

A solution containing 1 g of sodium dodecylbenzenesulfonate and 4 g of 1 N aqueous sodium hydroxide in 110 g of water was heated to 70° C., added with a solution of 0.25 g of potassium persulfate dissolved in 20 g of water, and then added with a mixture of 45.0 g of methyl methacrylate, 5.0 g of N-methylolacrylamide, 5 g of methanol and 5 g of water under nitrogen gas flow over two hours. After emulsion polymerization was performed for one hour, the reaction mixture was added with a solution containing 0.12 g of potassium persulfate dissolved in 10 g of water and 0.1 g of 1 N aqueous sodium hydroxide, and heated to 80° C. for three hours. Then, the reaction mixture was allowed to cool to room temperature, and gradually added with 0.1 N aqueous sodium hydroxide so that the mixture should have a pH of 6.5–7.0. This procedure afforded a white latex of good quality. The provided latex showed pH of 6.8, solid content of 25.7% by weight, and an average particle size of 129 μm (light scattering method).

Other self-crosslinkable polymer latexes were also synthesized in a similar manner.

Example 1

1. Preparation of silver halide emulsion (Emulsion A)

In 700 ml of water, 11 g of gelatin (calcium content: 2700 ppm), 30 mg of potassium bromide and 10 mg of sodium benzenethiosulfonate were dissolved, and after adjusting the pH to 5.0 at a temperature of 55° C., 159 ml of an aqueous solution containing 18.6 g of silver nitrate and an aqueous solution containing 1 mol/l of potassium bromide were added by the control double jet method over 6 minutes and 30 seconds while keeping the pAg at 7.7. Subsequently, 476 ml of an aqueous solution containing 55.5 g of silver nitrate and an aqueous halogen salt solution containing 1 mol/l of potassium bromide were added by the control double jet method over 28 minutes and 30 seconds while keeping the pAg at 7.7. Thereafter, the pH was lowered to cause coagulation precipitation to thereby effect desalting, 0.17 g of Compound A and 23.7 g of deionized gelatin (calcium content: 20 ppm or less) were added, and the pH and the pAg were adjusted to 5.9 and 8.0, respectively. The grains obtained were cubic grains having an average grain size of 0.11 μm, a coefficient of variation of the projected area of 8% and a (100) face ratio of 93%.

The temperature of the silver halide grains obtained as described above was elevated to 60° C., and 76 μmol of sodium benzenethiosulfonate per mol of Ag was added to the grains. After 3 minutes, 154 μmol of sodium persulfate was further added, and then the grains were ripened for 100 minutes.

Thereafter, Sensitizing dye A and Compound B were added in an amount of $6.4\times10^{-4}$ mol and $6.4\times10^{-3}$ mol, respectively, per mol of silver halide with stirring while keeping the emulsion at 40° C. After 20 minutes, the emulsion was rapidly cooled to 30° C. to complete the preparation of Silver halide emulsion A.

Sensitizing dye A:

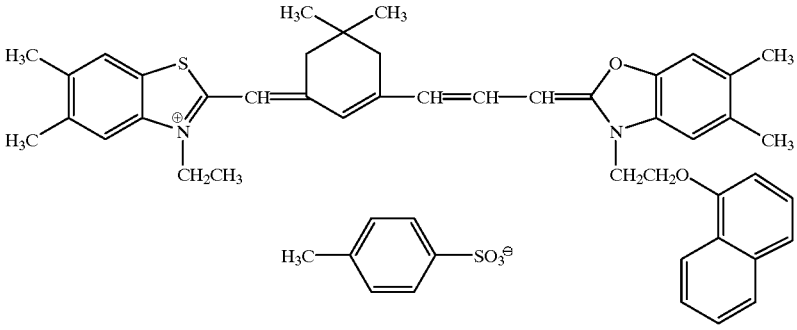

Compound A:

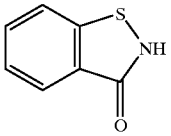

Compound B:

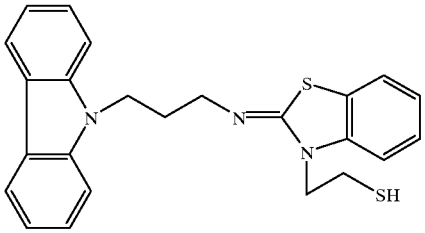

2. Preparation of organic acid silver dispersion (Organic acid silver A)

To a stirred mixture of 4.4 g of arachic acid, 39.4 g of behenic acid, 700 ml of distilled water, and 70 ml of tert-butanol at 85° C., 103 ml of aqueous 1N NaOH solution was added over 60 minutes, and allowed to react for 240 minutes, and then the temperature of th e mixture was lowered to 75° C. Subsequently, 112.5 ml of an aqueous solution containing 19.2 g of silver nitrate was added over 45 seconds and left as it is for 20 minutes, and then the temperature was lowered to 30° C. Thereafter, the solid content was separated by suction filtration, and washed with water until the conductivity of the filtered water became 30 $\mu$S/cm. The solid content obtained as described above was not dried but handled as a wet cake. To this wet cake corresponding to 100 g of the dry solid content, 5 g of polyvinyl alcohol (PVA-205, trade name) and water were added to make the total amount of 500 g, and the resulting mixed solution was preliminarily dispersed in a homomixer.

Then, the preliminarily dispersed stock solution was treated three times in a dispersing machine (Microfluidizer M-110S-EH, trade name, manufactured by Microfluidex International Corporation, using G10Z interaction chamber) under a pressure controlled to 1,750 kg/cm$^2$ to obtain Organic acid silver dispersion A. The organic acid silver grains contained in the organic acid silver dispersion obtained as described above were acicular grains having an average short axis length of 0.04 $\mu$m, an average long axis length of 0.8 $\mu$m and a coefficient of variation of 30%. The grain size was measured by Master Sizer X manufactured by Malvern Instruments Ltd. During the cooling operation, a desired dispersion temperature was established by controlling the temperature of the refrigerant by means of coiled heat exchangers fixed before and after the interaction chamber.

3. Preparation of solid microparticle dispersion of 1,1-bis (2-hydroxy-3,5-dimethylphenyl)-3,5,5-trimethylhexane:

To 20 g of 1,1-bis(2-hydroxy-3,5-dimethylphenyl)-3,5,5-trimethylhexane, 3.0 g of MP Polymer (MP-203, produced by Kuraray) and 77 ml of water were added and thoroughly stirred. The resulting mixture as a slurry was left stand for 3 hours. Thereafter, 360 g of 0.5-mm zirconia beads were prepared and placed together with the slurry in a vessel. The contents in the vessel were dispersed in a dispersing machine (¼G Sand Grinder Mill, manufactured by Imex) for 3 hours to prepare a reducing agent solid microparticle dispersion. In this dispersion, 80% by weight of the particles had a particle size of from 0.3 to 1.0 $\mu$m.

4. Preparation of solid microparticle dispersion of tribromomethylphenylsulfone:

To 30 g of tribromomethylphenylsulfone, 0.5 g of hydroxypropylmethylcellulose, 0.5 g of Compound C and 88.5 g of water were added and thoroughly stirred. The resulting mixture as a slurry was left stand for 3 hours. Thereafter, an antifoggant solid microparticle dispersion was prepared in the same manner as in the preparation of a reducing agent solid microparticle dispersion. In the dispersion, 80% by weight of A the particles had a particle size of from 0.3 to 1.0 $\mu$m.

Compound C:

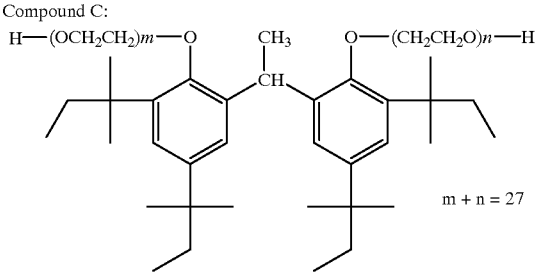

5. Preparation of application solution for image-forming layer:

Following components were added to Organic acid silver A (1 mol in terms of silver) prepared above.

| | | |
|---|---|---|
| Binder: SBR latex (LACSTAR 3307B, produced by Dai-Nippon Ink & Chemicals, Inc.) | 470 | g (solid content) |
| 1,1-Bis(2-hydroxy-3,5-dimethyl-phenyl)-3,5,5-trimethylhexane | 110 | g |
| Surfactant: Compound D | 5g | |
| Tribromomethylsulfone | 25 | g |
| Sodium benzenethiosulfonate | 0.25 | g |
| Hydrophilic polymer: Compound E | 46 | g |
| 6-iso-Butylphthalazine | 0.12 | mol |
| Nucleating agent: Compound F | 1.8 | g |
| Compound G | 6.5 | g |
| Compound H | 8.5 | g |
| Dye A | 0.62 | g |
| Silver halide emulsion A | 0.05 | mol in terms of Ag |

The mixture was added with water, and adjusted to pH 6.5 with 1 N sulfuric acid to afford an application solution for image-forming layer.

Compound D:

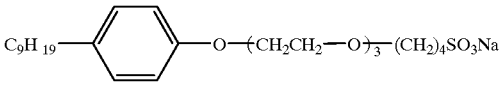

Compound E:

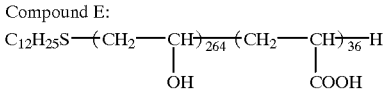

Compound F:

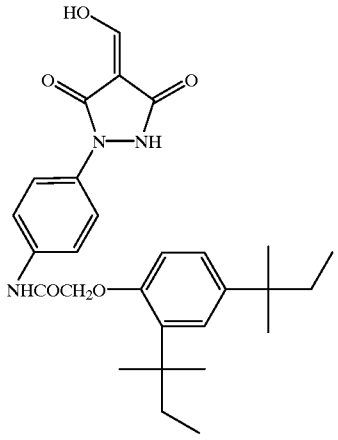

-continued

Compound G:

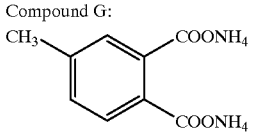

Compound H:

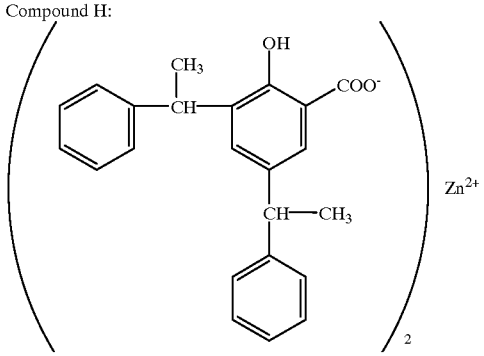

Dye A:

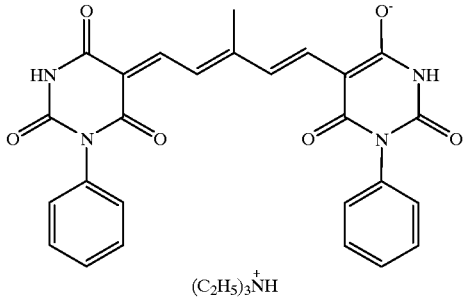

6. Preparation of application solution for emulsion surface protection layer:

To 180 g of the latex of Synthesis Example 1, 0.125 g of Compound I, 2.5 g of 30% by weight solution of carnauba wax (CELLOSOL 524, Chukyo Oil and Fat), 2.3 g of polyvinyl alcohol (PVA-235, Kuraray Co., Ltd.), and 0.5 g of matting agent (polymethyl methacrylate, average particle size; 5 $\mu$m) were added to prepare an application solution.

Compound I:

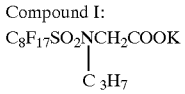

7. Preparation of PET support with back/undercoat layers:

(1) Support

PET having IV (intrinsic viscosity) of 0.66 (determined at 25° C. in a 6/4 (by weight) mixture of phenol/tetrachloroethane) was obtained using a terephthalic acid and ethylene glycol in a conventional manner. The PET was pelletized, dried at 130° C. for 4 hours, melted at 300° C., extruded from a T die, and then rapidly cooled to prepare an unstretched film so as to have a thickness of 120 $\mu$m after the heat setting.

This film was longitudinally stretched 3.3 times using rollers different in the peripheral speed and then transversely stretched 4.5 times by a tenter at a temperature of 110° C. and 130° C., respectively. Subsequently, the film was heat-set at 240° C. for 20 seconds, and then relaxed by 4% in the transverse direction at the same temperature. Thereafter, the chuck part of the tenter was slit and the film was knurled at the both edges and then taken up at 4.8 kg/cm$^2$. Thus, a roll having a width of 2.4 m, a length of 3,500 m and a thickness of 120 $\mu$m was obtained.

| | |
|---|---|
| (2) Undercoat layer (a) | |
| Polymer latex (1) (styrene/butadiene/hydroxyethyl methacrylate/divinylbenzene = 67/30/2.5/0.5 (% by weight)) | 160 mg/m$^2$ |
| 2,4-Dichloro-6-hydroxy-s-triazine | 4 mg/m$^2$ |
| Matting agent (polystyrene, average particle size: 2.4 $\mu$m) | 3 mg/m$^2$ |
| (3) Undercoat layer (b) | |
| Alkali-treated gelatin ($Ca^{2+}$ content: 30 ppm, jelly strength: 230 g) | 50 mg/m$^2$ |
| (4) Electroconductive layer | |
| JURIMER ET-410 (Nippon Jun'yaku) | 96 mg/m$^2$ |
| Gelatin | 50 mg/m$^2$ |
| Compound A | 0.2 mg/m$^2$ |
| Polyoxyethylene phenyl ether | 10 mg/m$^2$ |
| SUMITEX RESIN M-3 (water-soluble melamine compound, Sumitomo Chemical) | 18 mg/m$^2$ |
| Dye A | amount affording optical density at 780 nm of 1.0 |
| $SnO_2$/Sb (9/1 by weight, acicular microparticles, long axis/short axis = 20 to 30, Ishihara Sangyo Kaisha Ltd.) | 160 mg/m$^2$ |
| Matting agent (polymethyl methacrylate, average particle size of 5 $\mu$m) | 7 mg/m$^2$ |
| (5) Protective layer | |
| Polymer Latex (2) (59/9/26/5/1 (% by weight) copolymer of methyl methacrylate/styrene/2-ethylhexyl acrylate/2-hydroxyethyl methacrylate/methacrylic acid) | 1,000 mg/m$^2$ |
| Polystyrenesulfonate (molecular weight: 1,000 to 5,000) | 2.6 mg/m$^2$ |
| CELLOSOL 524 (produced by Chukyo Oil & Fat) | 25 mg/m$^2$ |
| SUMITEX RESIN M-3 (water-soluble melamine compound, Sumitomo Chemical) | 218 mg/m$^2$ |

On one side of the support, the undercoat layer (a) and the undercoat layer (b) were sequentially coated and dried at 180° C. for 4 minutes. Subsequently, on the surface opposite to the surface having the coated undercoat layer (a) and undercoat layer (b), the electroconductive layer and the protective layer were sequentially coated and dried at 180° C. for 30 seconds to manufacture a PET support with back/undercoat layers.

The PET support with back/undercoat layers obtained as described above was introduced into a heat treatment zone set at 150° C. and having a total length of 30 m, and transported by gravity at a tension of 14 g/cm$^2$ and a transportation speed of 20 m/min. Thereafter, the support was passed through a zone at 40° C. for 15 seconds, and taken up at a take-up tension of 10 kg/cm$^2$.

8. Preparation of heat-developable image-forming material:

On the undercoat layers (a) and (b) of the PET support with back/undercoat layer (a) and undercoat layer (b), the coating solution for the image-forming layer was coated, and the coating solution for the emulsion surface protection layer was coated thereon successively as laminated layers, so that the coated silver amount should be 1.6 g/m$^2$, and the coated polymer latex amount of the protective layer should be 2 g/m$^2$ as a solid amount. Then, the layers were dried at a drying temperature of 65° C. for 3 minutes to prepare a sample. This sample was referred to as Sample No. 1.

Sample No. 2 of the heat-developable image-recording material was prepared in the same manner as used for Sample No. 1, except that 180 g of the latex of Synthesis Example 2 was used instead of the latex of Synthesis Example 1 used for the <<Preparation of application solution for emulsion surface protection layer>>.

Sample No. 3 of the heat-developable image-recording material was prepared in the same manner as used for Sample No. 1, except that 175 g of the latex of Synthesis Example 3 was used instead of the latex of Synthesis Example 1 used for the <<Preparation of application solution for emulsion surface protection layer>>.

Sample No. 4 of the heat-developable image-recording material (comparative example) was prepared in the same manner as used for Sample No. 1, except that 95.3 g of a polymer latex (solid content; 44% by weight) of methyl methacrylate/styrene/2-ethylhexyl acrylate/2-hydroxyethyl methacrylate/acrylic acid=59/9/26/5/1 (% by weight) was used instead of the latex of Synthesis Example 1 used for the <<Preparation of application solution for emulsion surface protection layer>>, and 6.7 g of Compound J was used as a film-forming aid.

Compound J:

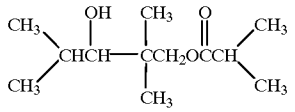

9. Evaluation of photographic performance

The obtained samples were evaluated for photographic properties, suitability for heat development, and suitability for opequing according to the following evaluation methods.

(1) Evaluation of photographic performance (Light exposure)

The obtained samples were exposed to a xenon flash light having an emission time of $10^{-6}$ second through an interference filter having a peak at 780 nm and a step wedge.

(Heat development)

The light-exposed samples were heat-developed at 117° C. for 20 seconds in such a heat-developing apparatus as shown in FIG. 1. In the drum-type heat developing apparatus of FIG. 1, the direction of the lamp was optimized, so that temperature control precision of ±1° C. along the transverse direction could be obtained. The atmospheric temperature was controlled so that the temperature around the straightening guide panels 7 should not be 90° C. or lower.

(Evaluation of photographic performance)

The images obtained were evaluated by a Macbeth densitometer TD904 (visible density). The measurement results were evaluated for Dmin, sensitivity (a reciprocal of the ratio of the exposure amount necessary for giving a density higher than Dmin by 1.0), and contrast. The contrast was expressed by a gradient of a straight line connecting the points at the density of 0.3 and the density of 3.0, with the abscissa being a logarithm of the exposure amount.

(2) Heat development suitability

Easiness of peeling the samples from the heat drum was evaluated by feeding a sample into the heat developing apparatus shown in FIG. 1 so that the surface having the image-forming layer should face the heat drum. The evaluation levels of ○ and Δ are practically acceptable levels.

○: Spontaneously peeled.

Δ: Spontaneously peeled after peeling is triggered.

×: Forced peeling is required.

(3) Opaquing suitability

Image portions of samples were rubbed five or six times with a writing brush containing toluene, and damages of image portions were evaluated after the toluene was dried. The evaluation levels of ○ and Δ are practically acceptable levels.

○: No change of images.

Δ: Images are slightly damaged.

×: Images are damaged, and disruption of film is observed.

The results are shown in Table 1.

TABLE 1

| Sample No. | Photographic performance: Relative sensitivity* | Photographic performance: Contrast | Photographic performance: Dmin | Heat development suitability | Opaquing suitability |
|---|---|---|---|---|---|
| 1 (Invention) | 100 | 13 | 0.10 | ○ | ○ |
| 2 (Invention) | 100 | 13 | 0.10 | ○ | ○ |
| 3 (Invention) | 100 | 13 | 0.10 | Δ | ○ |
| 4 (Comparative) | 100 | 13 | 0.10 | x | x |

*Relative vaiue based on the sensitivity of Sample No. 1 taken as 100.

From the results shown in Table 1, it can be seen that the heat-developable image-recording materials of the present invention, which utilize a self-crosslinkable polymer latex for the protective layer, are heat-developable image-recording materials exhibiting good heat development suitability and opaquing suitability without impairing phorographic performance. In particular, when a polymer latex produced from maleinated poly-1,2-butadiene is used, good characteristics can be obtained.

Example 2

Samples were prepared in the same manner as used for Sample No.4, except that the emulsion surface protection layer was prepared in the same manner as used for Sample No. 4 by utilizing the polymer latex used for the emulsion surface protection layer of Sample No. 4 (Comparative Example), i.e, a polymer latex of methyl methacrylate/styrene/2-ethylhexyl acrylate/2-hydroxyethyl methacrylate/acrylic acid=59/9/26/5/1 (% by weight), as a non-self-crosslinkable polymer latex, and using each ratio of the non-self-crosslinkable and self-crosslinkable polymer latexes (ratio of solid content) shown in Table 2. These samples were evaluated for photographic performance, suitability for heat development, and suitability for opequing in the same manner as in Example 1. The results are shown in Table 2.

TABLE 2

| Sample No. | Self-crosslinkable latex | Solid content ratio of [self-crosslinkable latex/(non-self-crosslinkable latex*1 + self-crosslinkable latex)] (% by weight) | Photographic performance: Relative sensitivity*2 | Photographic performance: Contrast | Photographic performance: Dmin | Heat development suitability | Opaquing suitability |
|---|---|---|---|---|---|---|---|
| 21 (Comparative) | None | 0 | 100 | 13 | 0.10 | × | × |
| 22 (Invention) | Synthesis Example 1 | 20 | 100 | 13 | 0.10 | × | Δ |
| 23 (Invention) | Synthesis Example 1 | 40 | 100 | 13 | 0.10 | Δ | Δ |
| 24 (Invention) | Synthesis Example 1 | 60 | 100 | 13 | 0.10 | ○ | ○ |
| 25 (Invention) | Synthesis Example 1 | 80 | 100 | 13 | 0.10 | ○ | ○ |
| 26 (Invention) | Synthesis Example 1 | 100 | 100 | 13 | 0.10 | ○ | ○ |
| 27 (Invention) | Synthesis Example 2 | 20 | 100 | 13 | 0.10 | × | Δ |
| 28 (Invention) | Synthesis Example 2 | 40 | 100 | 13 | 0.10 | Δ | Δ |
| 29 (Invention) | Synthesis Example 2 | 60 | 100 | 13 | 0.10 | ○ | ○ |
| 30 (Invention) | Synthesis Example 2 | 80 | 100 | 13 | 0.10 | ○ | ○ |
| 31 (Invention) | Synthesis Example 2 | 100 | 100 | 13 | 0.10 | ○ | ○ |
| 32 (Invention) | Synthesis Example 3 | 20 | 100 | 13 | 0.10 | × | Δ |
| 33 (Invention) | Synthesis Example 3 | 40 | 100 | 13 | 0.10 | Δ | Δ |
| 34 (Invention) | Synthesis Example 3 | 60 | 100 | 13 | 0.10 | Δ | ○ |
| 35 (Invention) | Synthesis Example 3 | 80 | 100 | 13 | 0.10 | Δ | ○ |
| 36 (Invention) | Synthesis Example 3 | 100 | 100 | 13 | 0.10 | Δ | ○ |

*1Polymer latex of methyl methacrylate/styrene/2-ethylhexyl acrylate/2-hydroxyethyl methacrylate/acrylic acid = 59/9/26/5/1 (% by weight) (Sample No. 4 in Example 1, Comparative Example).
*2Relative value based on the sensitivity of Sample No. 21 taken as 100.

As clearly seen from the results shown in Table 2, the samples of the present invention which utilize a self-crosslinkable polymer latex exhibit good opaquing suitability without impairing photographic performance.

It can further be seen that heat development suitability is further improved when a self-crosslinkable polymer latex is used in an amount of 40% by weight or more of the total polymer latex.

Example 3

Six kinds of samples corresponding to Sample Nos. 26, 31 and 36, but using a binder SBR latex of the image-forming layer of which 60% or 100% by weight was replaced with one of the latexes of Synthesis Examples 1, 2 and 3, and evaluated in the same manner as in Example 1. As a result, it was found that they exhibited, like the corresponding samples of Example 2, good heat development suitability and opaquing suitability without impairing photographic performance.

While the present invention has been explained in detail with reference to the specific embodiments, it is evident to those skilled in the art that various alterations and modifications can be made without departing from the concept and scope of the present invention, and it should be understood that such alterations and modifications also fall within the scope of the present invention.

The disclosure of Japanese Patent Application No. 10-210385, based on which the present application claims Convention Priority, is herein incorporated by reference in its entirety.

What is claimed is:

1. A heat-developable image-recording material comprising, on a support, at least one image-forming layer containing an organic silver salt, a reducing agent, and a light-sensitive silver halide, and at least one protective layer provided on the image-forming layer, wherein the image-forming layer and the protective layer contain a polymer latex as a binder, and the polymer latex of the image-forming layer and/or the protective layer comprises a self-crosslinkable polymer latex.

2. The heat-developable image-recording material of claim 1, which comprises the self-crosslinkable polymer latex as the polymer latex of the protective layer.

3. The heat-developable image-recording material of claim 1, wherein content of the self-crosslinkable polymer latex in the image-forming layer and/or the protective layer as a solid content based on the polymer latex component is 40% by weight to 100% by weight.

4. The heat-developable image-recording material of claim 1, wherein content of the self-crosslinkable polymer latex in the image-forming layer and/or the protective layer as a solid content based on the polymer latex component of each layer is 60% by weight to 100% by weight.

5. The heat-developable image-recording material of claim 1, wherein content of the self-crosslinkable polymer latex in the image-forming layer and/or the protective layer as a solid content based on the polymer latex component of each layer is 80% by weight to 100% by weight.

6. The heat-developable image-recording material of claim 1, wherein the self-crosslinkable polymer latex is a latex of polymer having a poly-1,2-butadiene structure.

7. The heat-developable image-recording material of claim 6, wherein the latex of polymer having a poly-1,2-butadiene structure is a latex obtained by polymerization of one or more kinds of vinyl monomers in the presence of maleinated poly-1,2-butadiene.

8. The heat-developable image-recording material of claim 7, wherein the vinyl monomers are selected from methacrylates, acrylates, carboxyl group-containing vinyl monomers, amide group-containing vinyl monomers, styrenes, halogenated ethylenes, vinyl esters and polymerizable aliphatic hydrocarbons.

9. The heat-developable image-recording material of claim 1, wherein the self-crosslinkable polymer latex is a latex of polymer prepared by using an alkali neutralization product of maleinated poly-1,2-butadiene.

* * * * *